US011306722B2

(12) United States Patent
Walton et al.

(10) Patent No.: US 11,306,722 B2
(45) Date of Patent: Apr. 19, 2022

(54) COMPRESSOR WITH MECHANICAL SEAL

(71) Applicant: HICOR TECHNOLOGIES, INC., Houston, TX (US)

(72) Inventors: John Walton, Portland, ME (US); Phil Nelson, Houston, TX (US); Jeremy Pitts, Solon, OH (US)

(73) Assignee: FORUMS US, INC., Houston, TX (US)

( * ) Notice: Subject to any disclaimer, the term of this patent is extended or adjusted under 35 U.S.C. 154(b) by 111 days.

(21) Appl. No.: 16/566,657

(22) Filed: Sep. 10, 2019

(65) Prior Publication Data

US 2020/0025202 A1 Jan. 23, 2020

Related U.S. Application Data

(62) Division of application No. 15/563,061, filed as application No. PCT/US2016/024803 on Mar. 29, 2016, now abandoned.

(Continued)

(51) Int. Cl.
*F03C 2/00* (2006.01)
*F03C 4/00* (2006.01)

(Continued)

(52) U.S. Cl.
CPC ..... *F04C 29/0007* (2013.01); *F01C 21/0809* (2013.01); *F04C 18/46* (2013.01);

(Continued)

(58) Field of Classification Search
CPC ..... F04C 18/356; F04C 18/3562; F04C 18/3564; F04C 18/46; F04C 27/001;

(Continued)

(56) References Cited

U.S. PATENT DOCUMENTS 3,451,381 A * 6/1969 Armstrong ..... F01C 19/10 418/138
4,629,403 A 12/1986 Wood (Continued)

FOREIGN PATENT DOCUMENTS

CN 1191277 A 8/1998
CN 103492720 1/2014

(Continued)

OTHER PUBLICATIONS

Office Action dated Oct. 8, 2019 in related U.S. Appl. No. 15/563,061, 10 pages.

(Continued)

*Primary Examiner* — Theresa Trieu
(74) *Attorney, Agent, or Firm* — Pillsbury Winthrop Shaw Pittman LLP

(57) ABSTRACT

A compressor includes: a casing with an inner wall defining a compression chamber, an inlet leading into the compression chamber, and an outlet leading out of the compression chamber; a rotor rotatably coupled to the casing for rotation relative to the casing; and a gate coupled to the casing for movement relative to the casing. The gate may be pivotally, or translationally coupled to the casing. A hydrostatic bearing may be disposed between the gate and casing. A plurality of compressors may be mechanically linked together such that their compression cycles are out of phase.

4 Claims, 51 Drawing Sheets

Related U.S. Application Data

(60) Provisional application No. 62/139,884, filed on Mar. 30, 2015.

(51) Int. Cl.

| | |
|---|---|
| ***F04C 2/00*** | (2006.01) |
| ***F04C 18/00*** | (2006.01) |
| ***F04C 29/00*** | (2006.01) |
| ***F01C 21/08*** | (2006.01) |
| ***F04C 27/00*** | (2006.01) |
| ***F04C 27/02*** | (2006.01) |
| ***F04C 18/46*** | (2006.01) |

(52) U.S. Cl.
CPC ..... *F04C 27/001* (2013.01); *F04C 27/02* (2013.01); *F04C 2240/54* (2013.01)

(58) Field of Classification Search
CPC ..... F04C 27/005; F04C 27/02; F04C 23/008; F04C 29/0007; F04C 29/042; F04C 29/12; F01C 21/0809; F01C 21/0827; F01C 21/0863; F16J 15/16; F16J 15/3204; F16J 15/3232; F16J 15/3236
See application file for complete search history.

(56) References Cited

U.S. PATENT DOCUMENTS

| | | | | |
|---|---|---|---|---|
| 4,657,491 | A * | 4/1987 | Frank | F04C 27/001 418/136 |
| 4,867,658 | A | 9/1989 | Sugita et al. | |
| 5,007,813 | A | 4/1991 | Da Costa | |
| 5,540,199 | A * | 7/1996 | Penn | F01C 21/0809 123/243 |
| 6,250,899 | B1 | 6/2001 | Lee et al. | |
| 6,481,720 | B1 * | 11/2002 | Yoshida | F16J 15/3212 277/559 |
| 9,027,934 | B2 | 5/2015 | Lindner-Silwester et al. | |
| 2004/0119241 | A1 | 6/2004 | Castleman | |
| 2005/0063855 | A1 | 3/2005 | Niikura et al. | |
| 2005/0076641 | A1 | 4/2005 | Kimura et al. | |
| 2005/0274350 | A1 * | 12/2005 | Gorski | F01C 21/0854 418/268 |
| 2006/0103076 | A1 * | 5/2006 | Hashimoto | F16J 15/3236 277/558 |
| 2010/0310400 | A1 | 12/2010 | Hou | |
| 2011/0057528 | A1 | 3/2011 | Grimseth et al. | |
| 2011/0200473 | A1 * | 8/2011 | Pekrul | F01C 21/08609 418/145 |
| 2012/0051958 | A1 | 3/2012 | Santos et al. | |
| 2012/0211945 | A1 | 8/2012 | Lindner-Silwester et al. | |

FOREIGN PATENT DOCUMENTS

| | | | |
|---|---|---|---|
| DE | 102007037666 | A1 | 2/2009 |
| EP | 2759709 | A1 | 7/2014 |
| FR | 402111 | A | 9/1909 |
| FR | 890933 | A | 2/1944 |
| FR | 908605 | A | 4/1946 |
| JP | S58-134694 | U | 9/1983 |
| JP | S59-86756 | A | 5/1984 |
| JP | S62-101895 | | 5/1987 |
| JP | S63-12683 | U | 1/1988 |
| JP | 2-140489 | A | 5/1990 |
| JP | H6-346880 | A | 12/1994 |
| JP | 2003-097205 | A | 4/2003 |
| JP | 2012-515298 | A | 7/2012 |
| JP | 2012-172847 | A | 9/2012 |
| JP | 2013-536916 | A | 9/2013 |
| WO | 89/02533 | A2 | 3/1989 |
| WO | 2013/131011 | | 9/2013 |

OTHER PUBLICATIONS

Office Action dated Dec. 24, 2019 in related Japanese Patent Application No. 2017-548268, 6 pages.
International Search Report PCT/US2016/024803 dated Oct. 12, 2016.
Written Opinion of the International Searching Authority PCT/US2016/024803 dated Oct. 12, 2016.
Requirement for Restriction/Election dated Jul. 10, 2019 in related U.S. Appl. No. 15/563,061, 7 pages.
Third Office Action issued in corresponding Chinese Patent Application No. 201680025835.X, dated Mar. 20, 2020.
Final Office Action issued in corresponding U.S. Appl. No. 15/563,061, dated Apr. 7, 2020.
Non-Final Office Action issued in corresponding Japanese Patent Application No. 2017-548268, dated Jun. 23, 2020.
Examination Report issued in corresponding Australian Patent Application No. 2020207876, dated May 27, 2021.
Non-Final Office Action issued in corresponding Japanese Patent Application No. 2020-157698, dated Aug. 31, 2021.
First Office Action issued in corresponding Chinese Patent Application No. 202010487274.3, dated Sep. 3, 2021.

* cited by examiner

Fig. 37
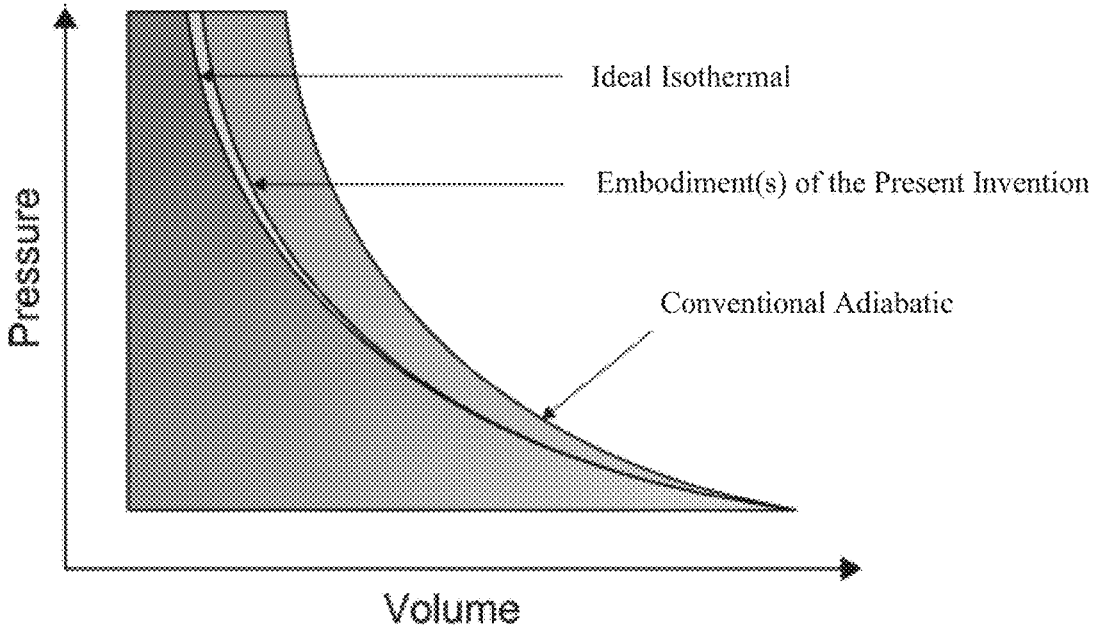
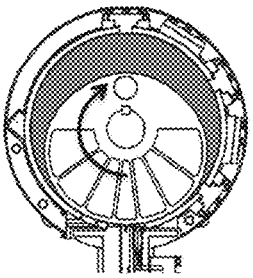
Fig. 38A
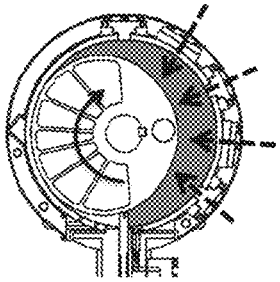
Fig. 38B
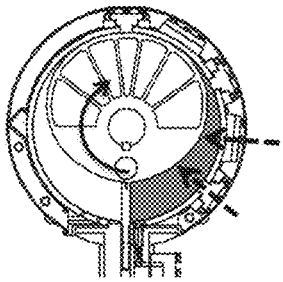
Fig. 38C
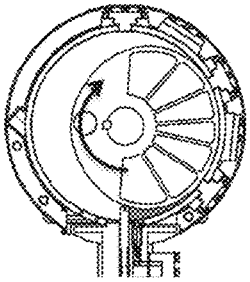
Fig. 38D

COMPRESSOR WITH MECHANICAL SEAL

CROSS-REFERENCE TO RELATED APPLICATION

This application is a divisional of U.S. patent application Ser. No. 15/563,061, filed Sep. 29, 2017, which is a U.S. National Phase of PCT/US2016/024803, filed Mar. 29, 2016, which claims the benefit of priority to U.S. Provisional Application Ser. No. 62/139,884, filed on Mar. 30, 2015, the contents of each are hereby incorporated herein by reference in their entirety.

BACKGROUND

Technical Field

The invention generally relates to fluid pumps, such as compressors and expanders.

Related Art

Compressors have typically been used for a variety of applications, such as air compression, vapor compression for refrigeration, and compression of industrial gases. Compressors can be split into two main groups, positive displacement and dynamic. Positive displacement compressors reduce the compression volume in the compression chamber to increase the pressure of the fluid in the chamber. This is done by applying force to a drive shaft that is driving the compression process. Dynamic compressors work by transferring energy from a moving set of blades to the working fluid.

Positive displacement compressors can take a variety of forms. They are typically classified as reciprocating or rotary compressors. Reciprocating compressors are commonly used in industrial applications where higher pressure ratios are necessary. They can easily be combined into multistage machines, although single stage reciprocating compressors are not typically used at pressures above 80 psig. Reciprocating compressors use a piston to compress the vapor, air, or gas, and have a large number of components to help translate the rotation of the drive shaft into the reciprocating motion used for compression. This can lead to increased cost and reduced reliability. Reciprocating compressors also suffer from high levels of vibration and noise. This technology has been used for many industrial applications such as natural gas compression.

Rotary compressors use a rotating component to perform compression. As noted in the art, rotary compressors typically have the following features in common: (1) they impart energy to the gas being compressed by way of an input shaft moving a single or multiple rotating elements; (2) they perform the compression in an intermittent mode; and (3) they do not use inlet or discharge valves. (Brown, Compressors: Selection and Sizing, 3rd Ed., at 6). As further noted in Brown, rotary compressor designs are generally suitable for designs in which less than 20:1 pressure ratios and 1000 CFM flow rates are desired. For pressure ratios above 20:1, Royce suggests that multistage reciprocating compressors should be used instead.

Typical rotary compressor designs include the rolling piston, screw compressor, scroll compressor, lobe, liquid ring, and rotary vane compressors. Each of these traditional compressors has deficiencies for producing high pressure, near isothermal conditions.

The design of a rotating element/rotor/lobe against a radially moving element/piston to progressively reduce the volume of a fluid has been utilized as early as the mid-19th century with the introduction of the "Yule Rotary Steam Engine." Developments have been made to small-sized compressors utilizing this methodology into refrigeration compression applications. However, current Yule-type designs are limited due to problems with mechanical spring durability (returning the piston element) as well as chatter (insufficient acceleration of the piston in order to maintain contact with the rotor).

For commercial applications, such as compressors for refrigerators, small rolling piston or rotary vane designs are typically used. (P N Ananthanarayanan, Basic Refrigeration and Air Conditioning, 3rd Ed., at 171-72.) In these designs, a closed oil-lubricating system is typically used.

Rolling piston designs typically allow for a significant amount of leakage between an eccentrically mounted circular rotor, the interior wall of the casing, and/or the vane that contacts the rotor. By spinning the rolling piston faster, the leakages are deemed acceptable because the desired pressure and flow rate for the application can be easily reached even with these losses. The benefit of a small self-contained compressor is more important than seeking higher pressure ratios.

Rotary vane designs typically use a single circular rotor mounted eccentrically in a cylinder slightly larger than the rotor. Multiple vanes are positioned in slots in the rotor and are kept in contact with the cylinder as the rotor turns typically by spring or centrifugal force inside the rotor. The design and operation of these type of compressors may be found in Mark's Standard Handbook for Mechanical Engineers, Eleventh Edition, at 14:33-34.

In a sliding-vane compressor design, vanes are mounted inside the rotor to slide against the casing wall. Alternatively, rolling piston designs utilize a vane mounted within the cylinder that slides against the rotor. These designs are limited by the amount of restoring force that can be provided and thus the pressure that can be yielded.

Each of these types of prior art compressors has limits on the maximum pressure differential that it can provide. Typical factors include mechanical stresses and temperature rise. One proposed solution is to use multistaging. In multistaging, multiple compression stages are applied sequentially. Intercooling, or cooling between stages, is used to cool the working fluid down to an acceptable level to be input into the next stage of compression. This is typically done by passing the working fluid through a heat exchanger in thermal communication with a cooler fluid. However, intercooling can result in some condensation of liquid and typically requires filtering out of the liquid elements. Multistaging greatly increases the complexity of the overall compression system and adds costs due to the increased number of components required. Additionally, the increased number of components leads to decreased reliability and the overall size and weight of the system are markedly increased.

For industrial applications, single- and double-acting reciprocating compressors and helical-screw type rotary compressors are most commonly used. Single-acting reciprocating compressors are similar to an automotive type piston with compression occurring on the top side of the piston during each revolution of the crankshaft. These machines can operate with a single-stage discharging between 25 and 125 psig or in two stages, with outputs ranging from 125 to 175 psig or higher. Single-acting reciprocating compressors are rarely seen in sizes above 25 HP. These types of compressors are typically affected by vibration and mechanical stress and require frequent maintenance. They also suffer from low efficiency due to insufficient cooling.

Double-acting reciprocating compressors use both sides of the piston for compression, effectively doubling the machine's capacity for a given cylinder size. They can operate as a single-stage or with multiple stages and are typically sized greater than 10 HP with discharge pressures above 50 psig. Machines of this type with only one or two cylinders require large foundations due to the unbalanced reciprocating forces. Double-acting reciprocating compressors tend to be quite robust and reliable, but are not sufficiently efficient, require frequent valve maintenance, and have extremely high capital costs.

Lubricant-flooded rotary screw compressors operate by forcing fluid between two intermeshing rotors within a housing which has an inlet port at one end and a discharge port at the other. Lubricant is injected into the chamber to lubricate the rotors and bearings, take away the heat of compression, and help to seal the clearances between the two rotors and between the rotors and housing. This style of compressor is reliable with few moving parts. However, it becomes quite inefficient at higher discharge pressures (above approximately 200 psig) due to the intermeshing rotor geometry being forced apart and leakage occurring. In addition, lack of valves and a built-in pressure ratio leads to frequent over or under compression, which translates into significant energy efficiency losses.

Rotary screw compressors are also available without lubricant in the compression chamber, although these types of machines are quite inefficient due to the lack of lubricant helping to seal between the rotors. They are a requirement in some process industries such as food and beverage, semiconductor, and pharmaceuticals, which cannot tolerate any oil in the compressed air used in their processes. Efficiency of dry rotary screw compressors are 15-20% below comparable injected lubricated rotary screw compressors and are typically used for discharge pressures below 150 psig.

Using cooling in a compressor is understood to improve upon the efficiency of the compression process by extracting heat, allowing most of the energy to be transmitted to the gas and compressing with minimal temperature increase. Liquid injection has previously been utilized in other compression applications for cooling purposes. Further, it has been suggested that smaller droplet sizes of the injected liquid may provide additional benefits.

In U.S. Pat. No. 4,497,185, lubricating oil was intercooled and injected through an atomizing nozzle into the inlet of a rotary screw compressor. In a similar fashion, U.S. Pat. No. 3,795,117 uses refrigerant, though not in an atomized fashion, that is injected early in the compression stages of a rotary screw compressor. Rotary vane compressors have also attempted finely atomized liquid injection, as seen in U.S. Pat. No. 3,820,923.

Published International Pat. App. No. WO 2010/017199 and U.S. Pat. Pub. No. 2011/0023814 relate to a rotary engine design using a rotor, multiple gates to create the chambers necessary for a combustion cycle, and an external cam-drive for the gates. The force from the combustion cycle drives the rotor, which imparts force to an external element. Engines are designed for a temperature increase in the chamber and high temperatures associated with the combustion that occurs within an engine. Increased sealing requirements necessary for an effective compressor design are unnecessary and difficult to achieve. Combustion forces the use of positively contacting seals to achieve near perfect sealing, while leaving wide tolerances for metal expansion, taken up by the seals, in an engine. Further, injection of liquids for cooling would be counterproductive and coalescence is not addressed.

Liquid mist injection has been used in compressors, but with limited effectiveness. In U.S. Pat. No. 5,024,588, a liquid injection mist is described, but improved heat transfer is not addressed. In U.S. Pat. Publication. No. U.S. 2011/0023977, liquid is pumped through atomizing nozzles into a reciprocating piston compressor's compression chamber prior to the start of compression. It is specified that liquid will only be injected through atomizing nozzles in low pressure applications. Liquid present in a reciprocating piston compressor's cylinder causes a high risk for catastrophic failure due to hydrolock, a consequence of the incompressibility of liquids when they build up in clearance volumes in a reciprocating piston, or other positive displacement, compressor. To prevent hydrolock situations, reciprocating piston compressors using liquid injection will typically have to operate at very slow speeds, adversely affecting the performance of the compressor.

U.S. Patent Application Publication No. 2013-0209299, titled "Compressor With Liquid Injection Cooling" discloses another rotary compressor with liquid injection cooling. The entire contents of U.S. Patent Application Publication No. 2013-0209299 are incorporated herein by reference in its entirety.

BRIEF SUMMARY

The presently preferred embodiments are directed to rotary compressor designs. These designs are particularly suited for high pressure applications, typically above 200 psig with pressure ratios typically above that for existing high-pressure positive displacement compressors.

One or more embodiments provides a compressor that includes: a casing with an inner wall defining a compression chamber; a drive shaft and rotor rotatably coupled to the casing for common rotation relative to the casing, the rotor having a non-circular profile; and a gate coupled to the casing for pivotal movement relative to the casing, the gate comprising a sealing edge, the gate being operable to move relative to the casing to locate the sealing edge proximate to the rotor as the rotor rotates such that the gate separates an inlet volume and a compression volume in the compression chamber.

One or more embodiments provides a compressor that includes: a casing with an inner wall defining a compression chamber, an inlet leading into the compression chamber, and an outlet leading out of the compression chamber; a drive shaft and rotor rotatably coupled to the casing for common rotation relative to the casing, the rotor having a non-circular profile; a gate coupled to the casing for movement relative to the casing, the gate comprising a sealing edge, the gate being operable to move relative to the casing to locate the sealing edge proximate to the rotor as the rotor rotates such that the gate separates an inlet volume and a compression volume in the compression chamber, the inlet and outlet being disposed on opposite sides of the sealing edge from each other; and an outlet manifold in fluid communication with the outlet, wherein the outlet is elongated in a direction parallel to a rotational axis of the drive shaft, wherein the outlet manifold defines an interior passageway, and wherein the passageway varies in cross-sectional shape between an entrance into the manifold and an exit out of the manifold, and wherein the outlet manifold comprises a plurality of vanes disposed in the interior passageway to direct the flow of working fluid through the outlet manifold.

One or more embodiments provides a compressor that includes: a casing with an inner wall defining a compression chamber, an inlet leading into the compression chamber, and an outlet leading out of the compression chamber; a rotor coupled to the casing for rotation relative to the casing; a gate movably coupled to one of the casing and rotor for movement relative to the one of the casing and rotor, the gate comprising a sealing edge, the gate being operable to locate the sealing edge proximate to the other of the casing and rotor as the rotor rotates; and a hydrostatic bearing arrangement disposed between (1) the gate and (2) the one of the casing and rotor to reduce friction when the gate moves during operation of the compressor.

One or more embodiments provides a compressor that includes: a compression chamber casing with an inner wall defining a compression chamber, an inlet leading into the compression chamber, and an outlet leading out of the compression chamber; a drive shaft and rotor rotatably coupled to the compression chamber casing for common rotation relative to the compression chamber casing; a gate coupled to the compression chamber casing for movement relative to the compression chamber casing, the gate comprising a sealing edge, the gate being operable to move relative to the compression chamber casing to locate the sealing edge proximate to the rotor as the rotor rotates such that the gate separates an inlet volume and a compression volume in the compression chamber, the inlet and outlet being disposed on opposite sides of the sealing edge from each other; and a gate positioning system coupled to the gate, the gate positioning system being shaped and configured to reciprocally move the gate during rotation of the rotor so that the sealing edge remains proximate to the rotor during rotation of the rotor.

According to various embodiments, the gate positioning system includes a cam shaft rotatably coupled to the compression chamber casing for rotation relative to the compression chamber casing, the cam shaft being spaced from the drive shaft, the cam shaft being connected to the drive shaft so as to be rotationally driven by the drive shaft, a cam rotatably coupled to the compression chamber casing for concentric rotation with the cam shaft relative to the compression chamber casing, a cam follower mounted to the gate for movement with the gate relative to the compression chamber casing, the cam follower abutting the cam so that rotation of the cam causes the cam follower and gate to move relative to the compression chamber casing.

One or more embodiments provides a compressor system that includes: a plurality of compressors. Each compressor may include a casing with an inner wall defining a compression chamber, an inlet leading into the compression chamber, and an outlet leading out of the compression chamber, a rotor rotatably coupled to the casing for rotation relative to the casing, and a gate coupled to the casing for movement relative to the casing, the gate comprising a sealing edge, the gate being operable to move relative to the casing to locate the sealing edge proximate to the rotor as the rotor rotates such that the gate separates an inlet volume and a compression volume in the compression chamber, the inlet and outlet being disposed on opposite sides of the sealing edge from each other. The system includes a mechanical linkage between the rotors of the plurality of compressors, the mechanical linkage connecting between the rotors such that compression cycles of the plurality of compressors are out of phase with each other.

One or more embodiments provides a compressor that includes: a casing with an inner wall defining a compression chamber, an inlet leading into the compression chamber, and an outlet leading out of the compression chamber; a drive shaft and rotor rotatably coupled to the casing for common rotation relative to the casing such that when the rotor is rotated, the compressor compresses working fluid that enters the compression chamber from the inlet, and forces compressed working fluid out of the compression chamber through the outlet; and a mechanical seal located at an interface between the drive shaft and casing where the drive shaft passes through the casing.

According to various embodiments, the mechanical seal includes: first, second, and third seals disposed sequentially along a leakage path between the drive shaft and casing rotor, a source of pressurized hydraulic fluid, and a hydraulic fluid passageway that connects the source to a space along the leakage path between the second and third seals so as to keep the space pressurized with hydraulic fluid.

One or more embodiments provides a non-circular seal for sealing an interface between two moving parts. The seal includes a non-circular structural base (e.g., comprising steel) having a closed perimeter; and a low friction sealing material (e.g., graphite or Teflon) bonded to the base.

One or more embodiments provides a compressor that includes: a casing with an inner wall defining a compression chamber, an inlet leading into the compression chamber, and an outlet leading out of the compression chamber; a rotor rotatably coupled to the casing for rotation relative to the casing such that when the rotor is rotated, the compressor compresses working fluid that enters the compression chamber from the inlet, and forces compressed working fluid out of the compression chamber through the outlet; a gate coupled to the casing for reciprocating movement relative to the casing, the gate comprising a sealing edge, the gate being operable to move relative to the casing to locate the sealing edge proximate to the rotor as the rotor rotates such that the gate separates an inlet volume and a compression volume in the compression chamber; and a mechanical seal located at an interface between the gate and casing. The mechanical seal includes: first, second, and third seals disposed sequentially along a leakage path between the gate and casing, a source of pressurized hydraulic fluid, and a hydraulic fluid passageway that connects the source to a space along the leakage path between the second and third seals so as to keep the space pressurized with hydraulic fluid.

According to various embodiments, the mechanical seal further includes a vent disposed between the first and second seals, the vent being fluidly connected to the inlet so as to direct working fluid that leaks from the compression chamber past the first seal back to the inlet.

According to various embodiments, the first, second, and third seals are all supported by a removable housing, such that the first, second, and third seals and housing can be installed into the casing as a single unit.

According to various embodiments, the mechanical seal comprises n sequential seals along the leakage path between the gate and casing, wherein $3 \leq n \leq 50$, wherein n includes the first, second, and third seals, wherein one or more spaces between adjacent ones of the seals are filled with pressurized hydraulic fluid, and wherein one or more spaces between adjacent ones of the seals comprise a vent that is fluidly connected on the inlet.

These and other aspects of various non-limiting embodiments of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein are drawn to scale. It is to be expressly understood, however, that the drawings are for the purpose of illustration and description only and are not intended as a definition of the limits of the invention. In addition, it should be appreciated that structural features shown or described in any one embodiment herein can be used in other embodiments as well. As used in the specification and in the claims, the singular form of "a", "an", and "the" include plural referents unless the context clearly dictates otherwise.

All closed-ended (e.g., between A and B) and open-ended (greater than C) ranges of values disclosed herein explicitly include all ranges that fall within or nest within such ranges. For example, a disclosed range of 1-10 is understood as also disclosing, among other ranged, 2-10, 1-9, 3-9, etc.

BRIEF DESCRIPTION OF THE DRAWINGS

Embodiments of the invention can be better understood with reference to the following drawings and description. The components in the figures are not necessarily to scale, emphasis instead being placed upon illustrating the principles of various embodiments of the invention. Moreover, in the figures, like referenced numerals designate corresponding parts throughout the different views.

FIG. 37 is a graph of the pressure-volume curve achieved by a compressor according to one or more embodiments of the present invention relative to adiabatic and isothermal compression.

FIGS. 38A-38D show the sequential compression cycle and liquid coolant injection locations, directions, and timing according to one or more embodiments of the invention.

DETAILED DESCRIPTION OF THE EMBODIMENTS

Figure 1:
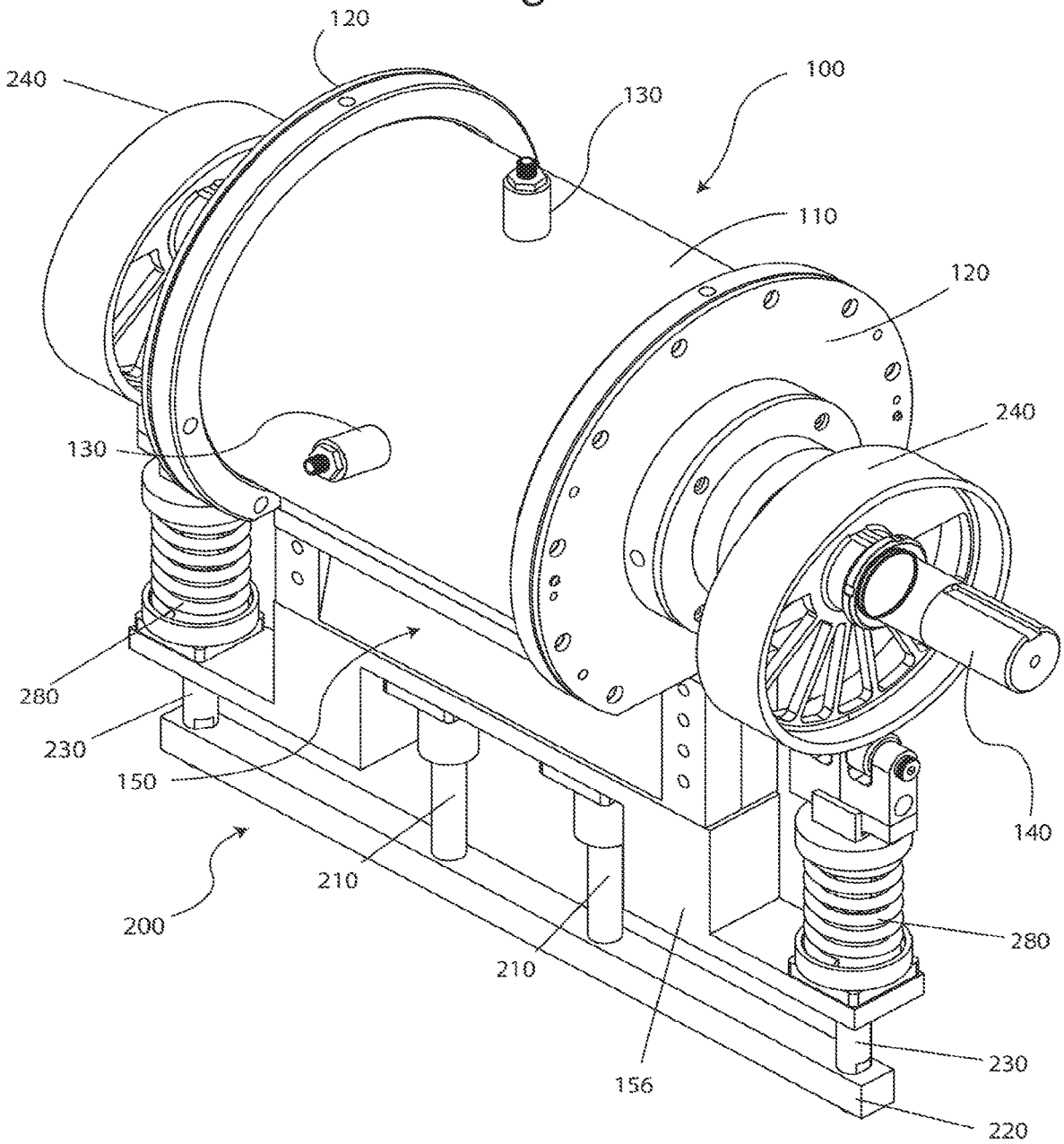
FIG. 1 is a perspective view of a rotary compressor with a spring-backed cam drive in accordance with an embodiment of the present invention.
Figure 2:
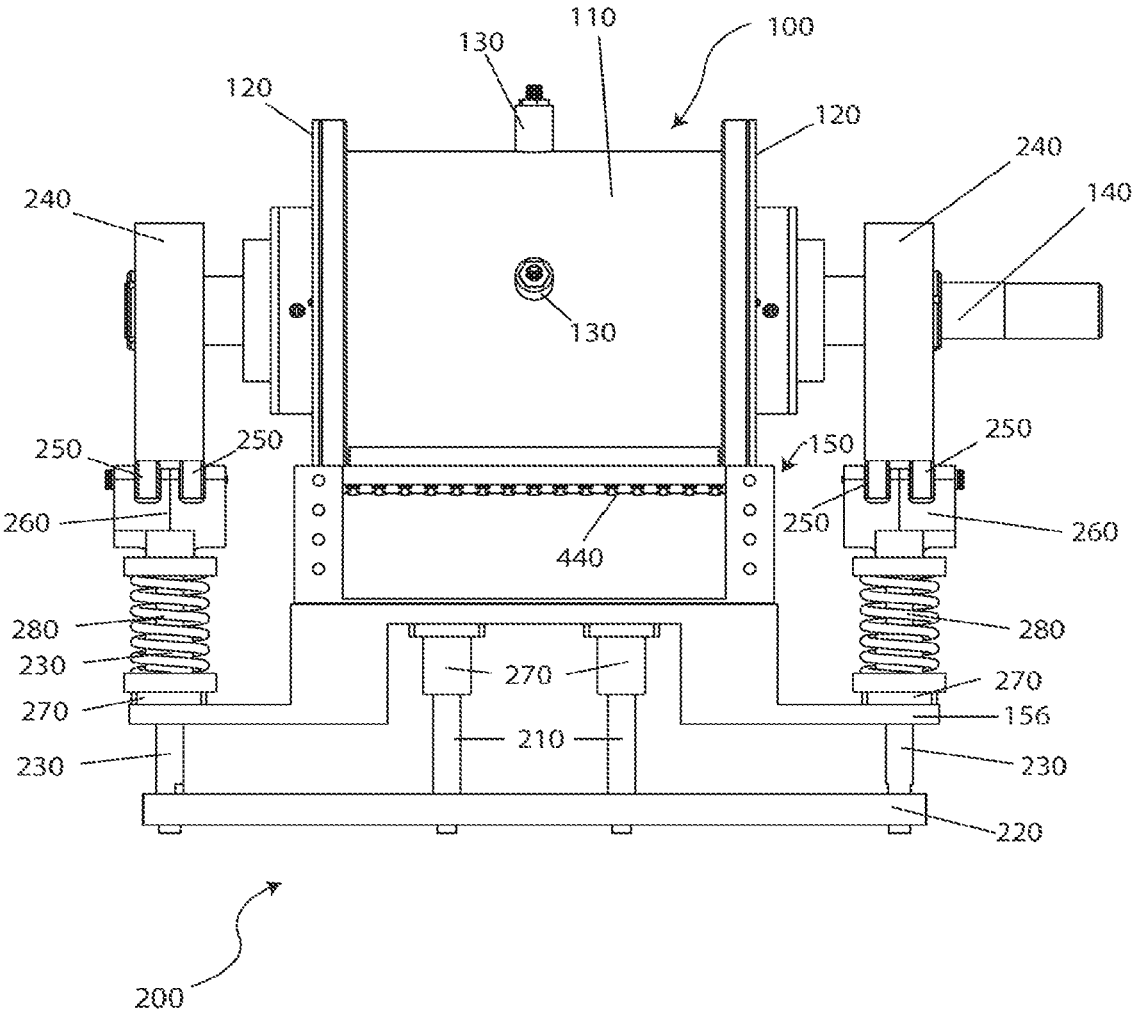
FIG. 2 is a right-side view of a rotary compressor with a spring-backed cam drive in accordance with an embodiment of the present invention.

To the extent that the following terms are utilized herein, the following definitions are applicable:

Balanced rotation: the center of mass of the rotating mass is located on the axis of rotation.

Chamber volume: any volume that can contain fluids for compression.

Compressor: a device used to increase the pressure of a compressible fluid. The fluid can be either gas or vapor, and can have a wide molecular weight range.

Concentric: the center or axis of one object coincides with the center or axis of a second object Concentric rotation: rotation in which one object's center of rotation is located on the same axis as the second object's center of rotation.

Positive displacement compressor: a compressor that collects a fixed volume of gas within a chamber and compresses it by reducing the chamber volume.

Proximate: sufficiently close to restrict fluid flow between high pressure and low pressure regions. Restriction does not need to be absolute; some leakage is acceptable.

Rotor: A rotating element driven by a mechanical force to rotate about an axis. As used in a compressor design, the rotor imparts energy to a fluid.

Rotary compressor: A positive-displacement compressor that imparts energy to the gas being compressed by way of an input shaft moving a single or multiple rotating elements FIGS. 1 through 7 show external views of an embodiment of the present invention in which a rotary compressor includes spring backed cam drive gate positioning system. Main housing 100 includes a main casing 110 and end plates 120, each of which includes a hole through which drive shaft 140 passes axially. Liquid injector assemblies 130 are located on holes in the main casing 110. The main casing includes a hole for the inlet flange 160, and a hole for the gate casing 150.

Figure 28:
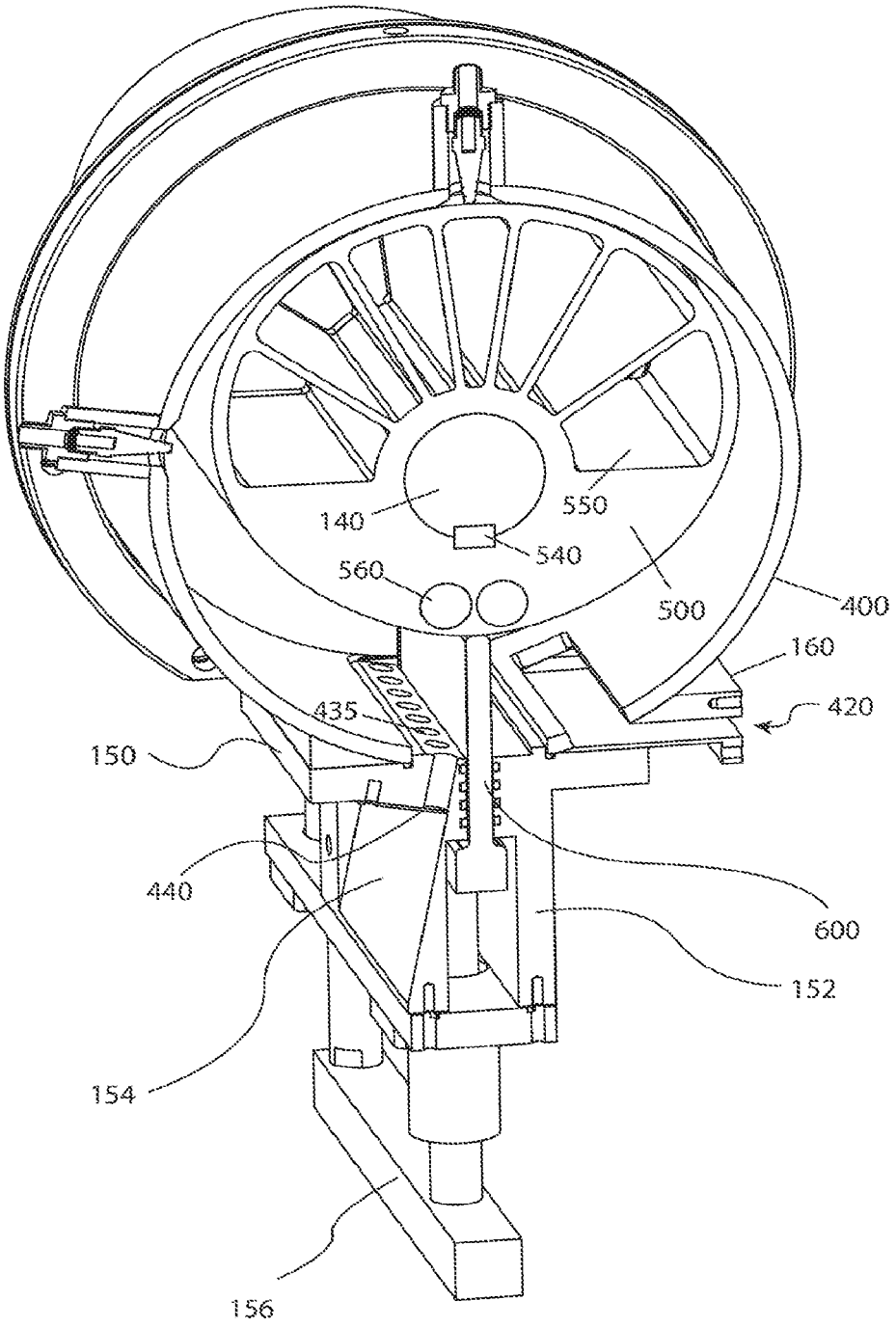
FIG. 28 is perspective, cross-sectional view of a rotary compressor in accordance with an embodiment of the present invention.

Gate casing 150 is connected to and positioned below main casing 110 at a hole in main casing 110. The gate casing 150 is comprised of two portions: an inlet side 152 and an outlet side 154. Other embodiments of gate casing 150 may only consist of a single portion. As shown in FIG. 28, the outlet side 154 includes outlet ports 435, which are holes which lead to outlet valves 440. Alternatively, an outlet valve assembly may be used.

Referring back to FIGS. 1-7, the spring-backed cam drive gate positioning system 200 is attached to the gate casing 150 and drive shaft 140. The gate positioning system 200 moves gate 600 in conjunction with the rotation of rotor 500. A movable assembly includes gate struts 210 and cam struts 230 connected to gate support arm 220 and bearing support plate 156. The bearing support plate 156 seals the gate casing 150 by interfacing with the inlet and outlet sides through a bolted gasket connection. Bearing support plate 156 is shaped to seal gate casing 150, mount bearing housings 270 in a sufficiently parallel manner, and constrain compressive springs 280. In one embodiment, the interior of the gate casing 150 is hermetically sealed by the bearing support plate 156 with o-rings, gaskets, or other sealing materials. Other embodiments may support the bearings at other locations, in which case an alternate plate may be used to seal the interior of the gate casing. Shaft seals, mechanical seals, or other sealing mechanisms may be used to seal around the gate struts 210 which penetrate the bearing support plate 156 or other sealing plate. Bearing housings 270, also known as pillow blocks, are concentric to the gate struts 210 and the cam struts 230.

In the illustrated embodiment, the compressing structure comprises a rotor 500. However, according to alternative embodiments, alternative types of compressing structures (e.g., gears, screws, pistons, etc.) may be used in connection with the compression chamber to provide alternative compressors according to alternative embodiments of the invention.

Two cam followers 250 are located tangentially to each cam 240, providing a downward force on the gate. Drive shaft 140 turns cams 240, which transmits force to the cam followers 250. The cam followers 250 may be mounted on a through shaft, which is supported on both ends, or cantilevered and only supported on one end. The cam followers 250 are attached to cam follower supports 260, which transfer the force into the cam struts 230. As cams 240 turn, the cam followers 250 are pushed down, thus moving the cam struts 230 down. This moves the gate support arm 220 and the gate strut 210 down. This, in turn, moves the gate 600 down.

Springs 280 provide a restorative upward force to keep the gate 600 timed appropriately to seal against the rotor 500. As the cams 240 continue to turn and no longer effectuate a downward force on the cam followers 250, springs 280 provide an upward force. As shown in this embodiment, compression springs are utilized. As one of ordinary skill in the art would appreciate, tension springs and the shape of the bearing support plate 156 may be altered to provide for the desired upward or downward force. The upward force of the springs 280 pushes the cam follower support 260 and thus the gate support arm 220 up which in turn moves the gate 600 up.

Due to the varying pressure angle between the cam followers 250 and cams 240, the preferred embodiment may utilize an exterior cam profile that differs from the rotor 500 profile. This variation in profile allows for compensation for the changing pressure angle to ensure that the tip of the gate 600 remains proximate to the rotor 500 throughout the entire compression cycle.

Figure 3:
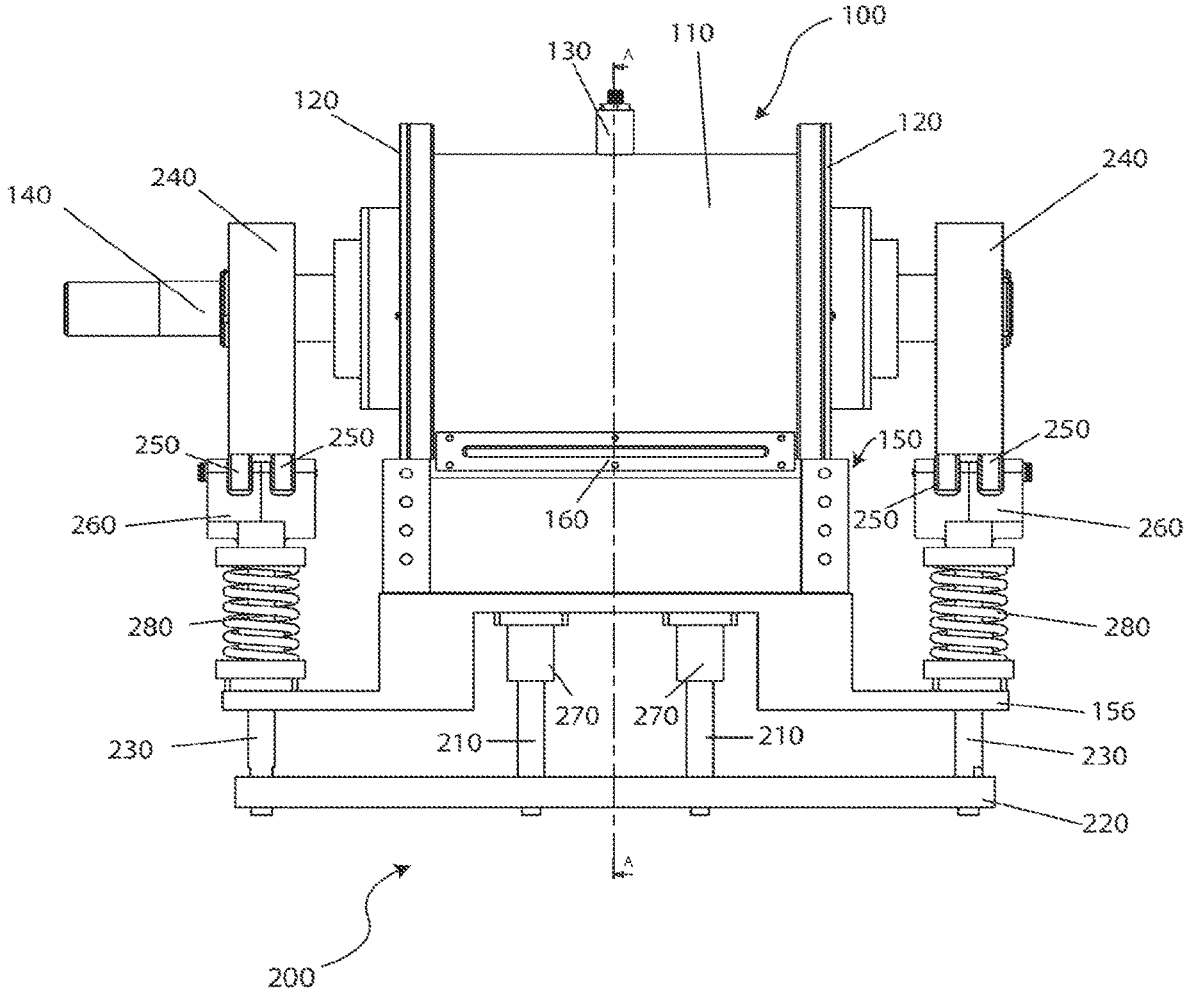
FIG. 3 is a left-side view of a rotary compressor with a spring-backed cam drive in accordance with an embodiment of the present invention.
Figure 4:
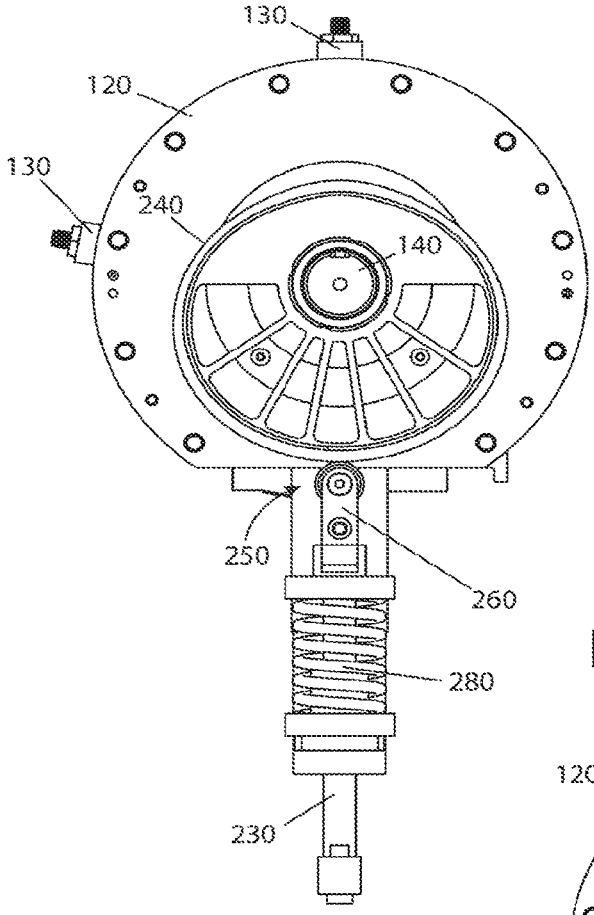
FIG. 4 is a front view of a rotary compressor with a spring-backed cam drive in accordance with an embodiment of the present invention.
Figure 5:
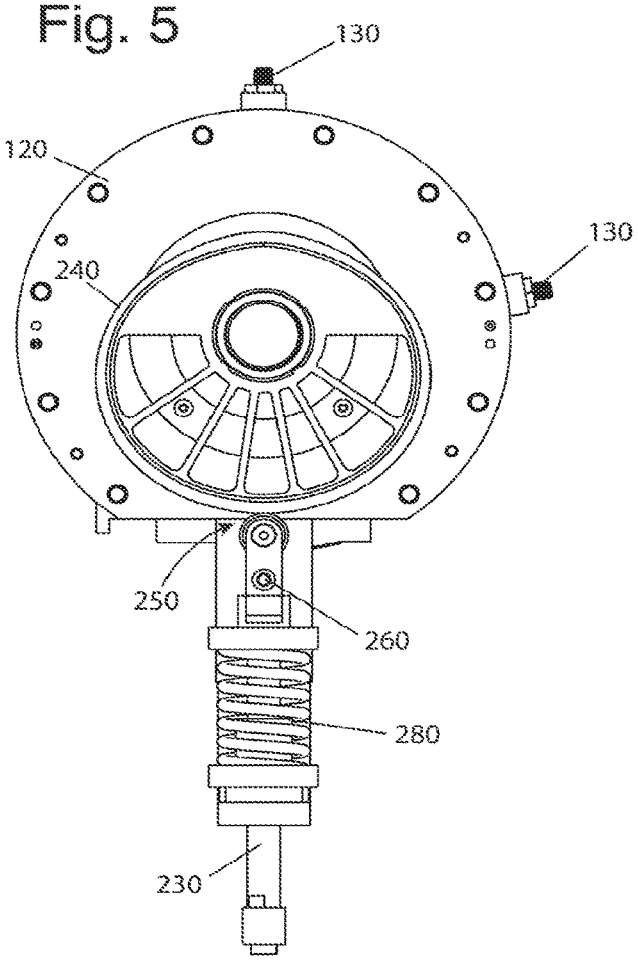
FIG. 5 is a back view of a rotary compressor with a spring-backed cam drive in accordance with an embodiment of the present invention.
Figure 6:
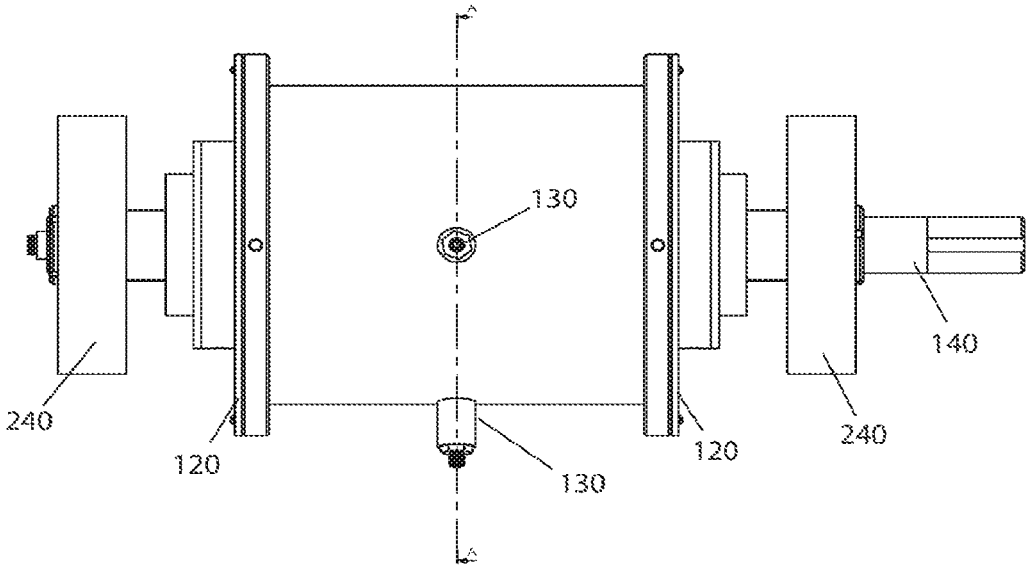
FIG. 6 is a top view of a rotary compressor with a spring-backed cam drive in accordance with an embodiment of the present invention.
Figure 7:
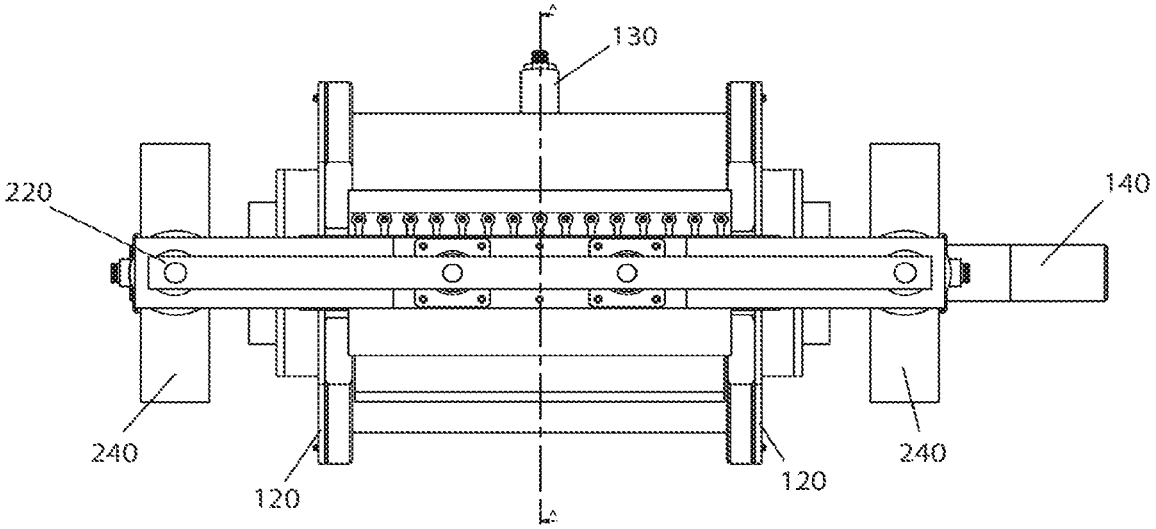
FIG. 7 is a bottom view of a rotary compressor with a spring-backed cam drive in accordance with an embodiment of the present invention.
Figure 8:
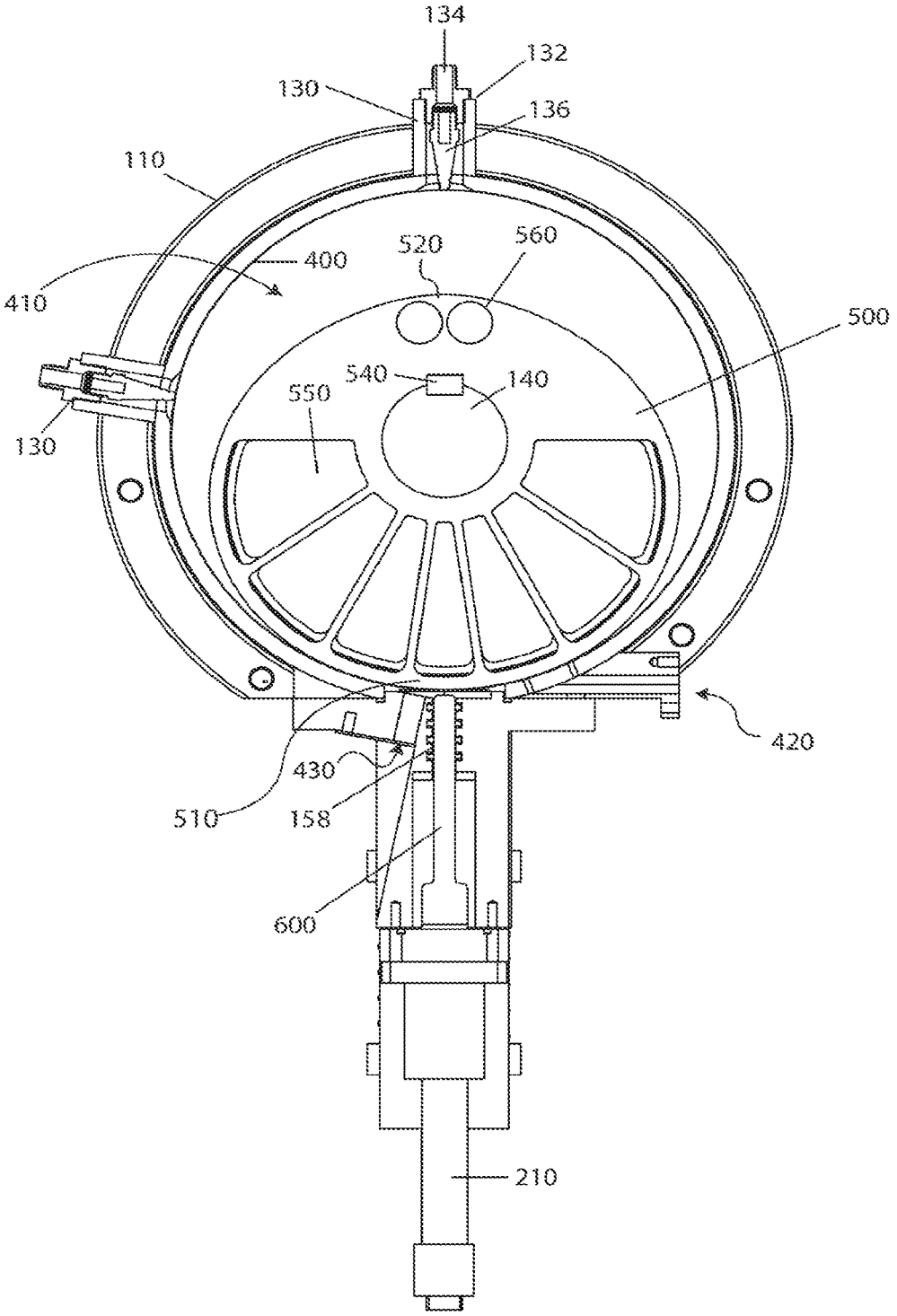
FIG. 8 is a cross-sectional view of a rotary compressor with a spring-backed cam drive in accordance with an embodiment of the present invention.

Line A in FIGS. 3, 6, and 7 shows the location for the cross-sectional view of the compressor in FIG. 8. As shown in FIG. 8, the main casing 110 has a cylindrical shape. Liquid injector housings 132 are attached to, or may be cast as a part of, the main casing 110 to provide for openings in the rotor casing 400. Because it is cylindrically shaped in this embodiment, the rotor casing 400 may also be referenced as the cylinder. The interior wall defines a rotor casing volume 410 (also referred to as the compression chamber). The rotor 500 concentrically rotates with drive shaft 140 and is affixed to the drive shaft 140 by way of key 540 and press fit. Alternate methods for affixing the rotor 500 to the drive shaft 140, such as polygons, splines, or a tapered shaft may also be used.

Figure 9:
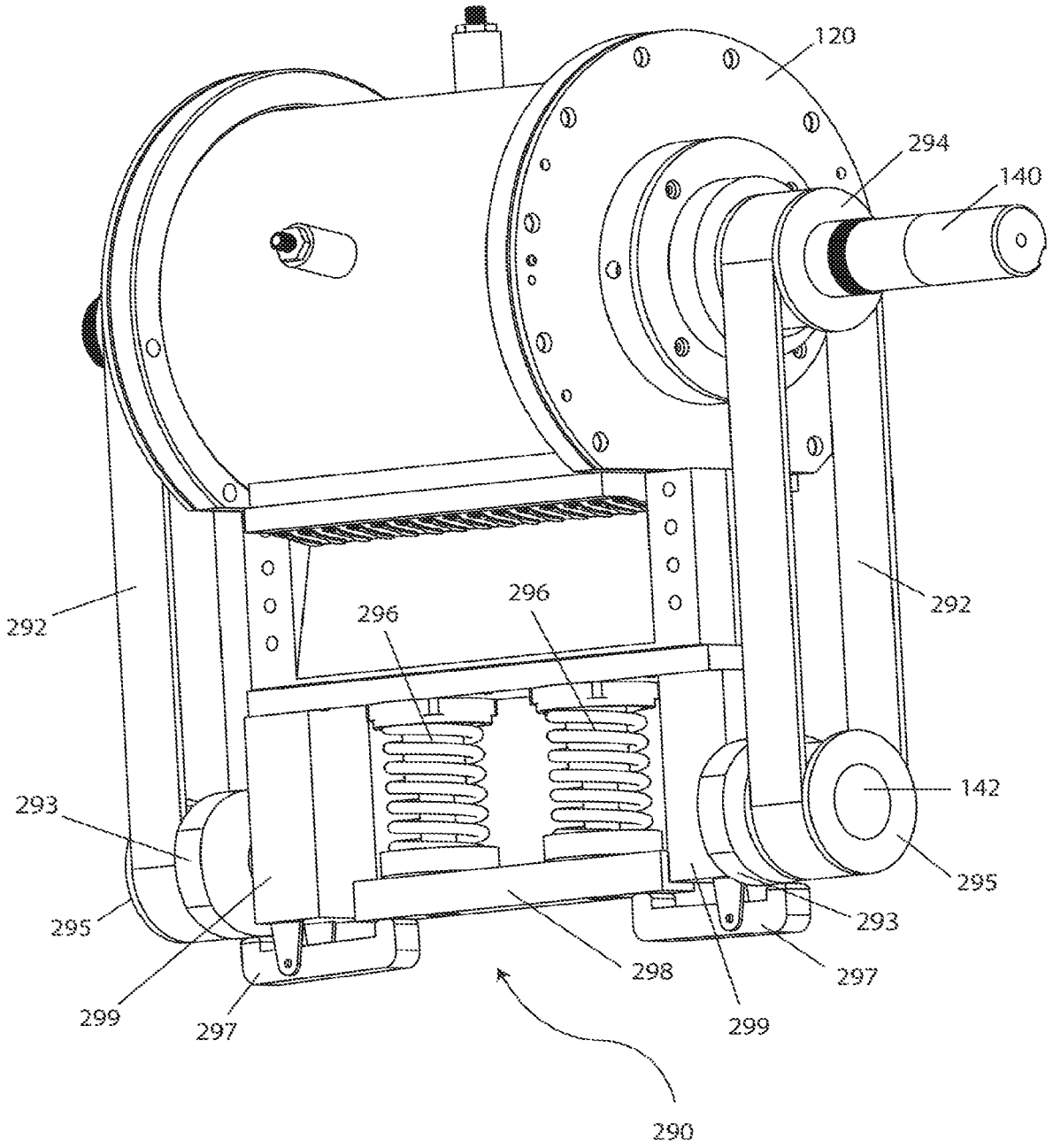
FIG. 9 is a perspective view of rotary compressor with a belt-driven, spring-biased gate positioning system in accordance with an embodiment of the present invention.
Figure 10:
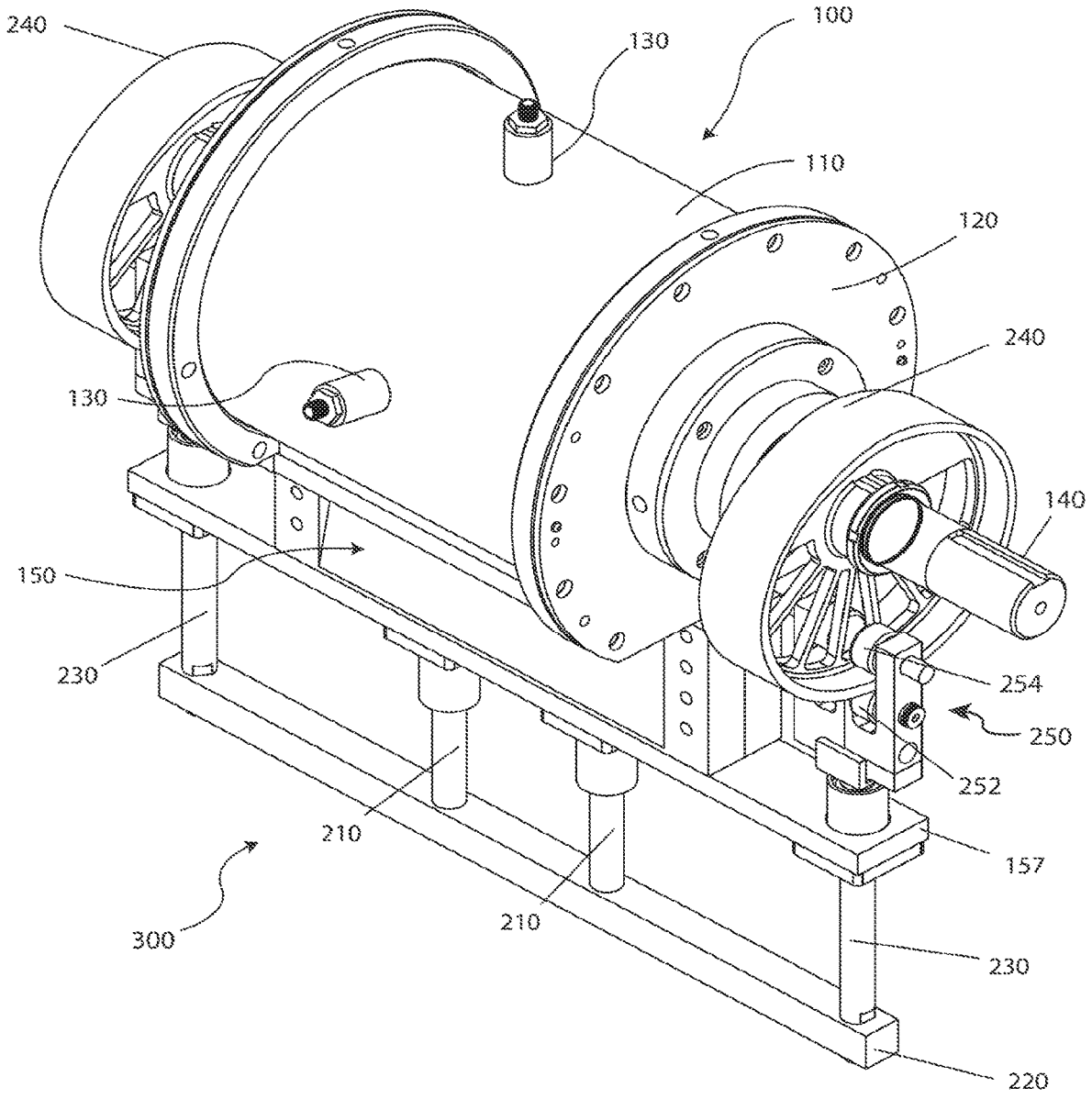
FIG. 10 is a perspective view of a rotary compressor with a dual cam follower gate positioning system in accordance with an embodiment of the present invention.
Figure 11:
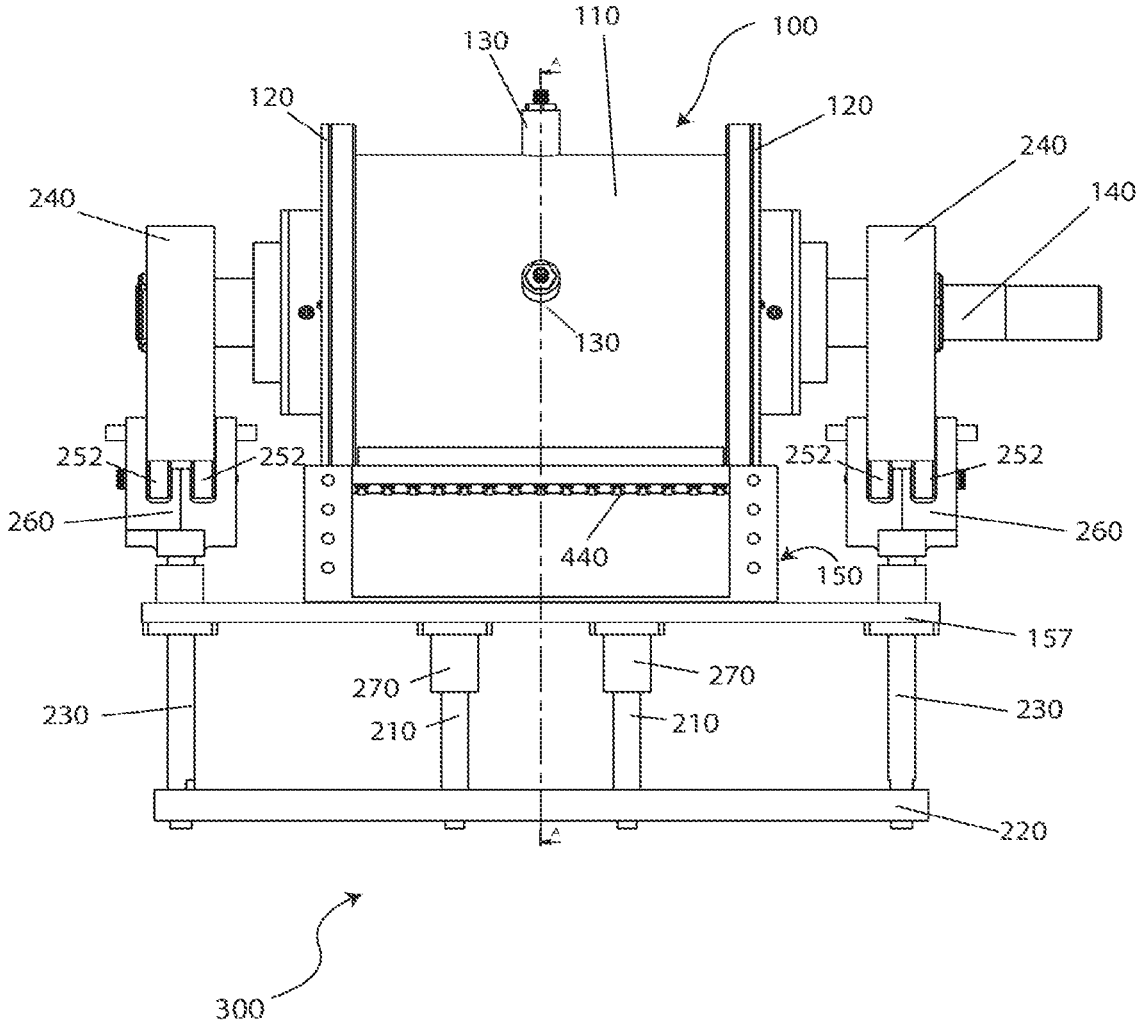
FIG. 11 is a right-side view of a rotary compressor with a dual cam follower gate positioning system in accordance with an embodiment of the present invention.
Figure 12:
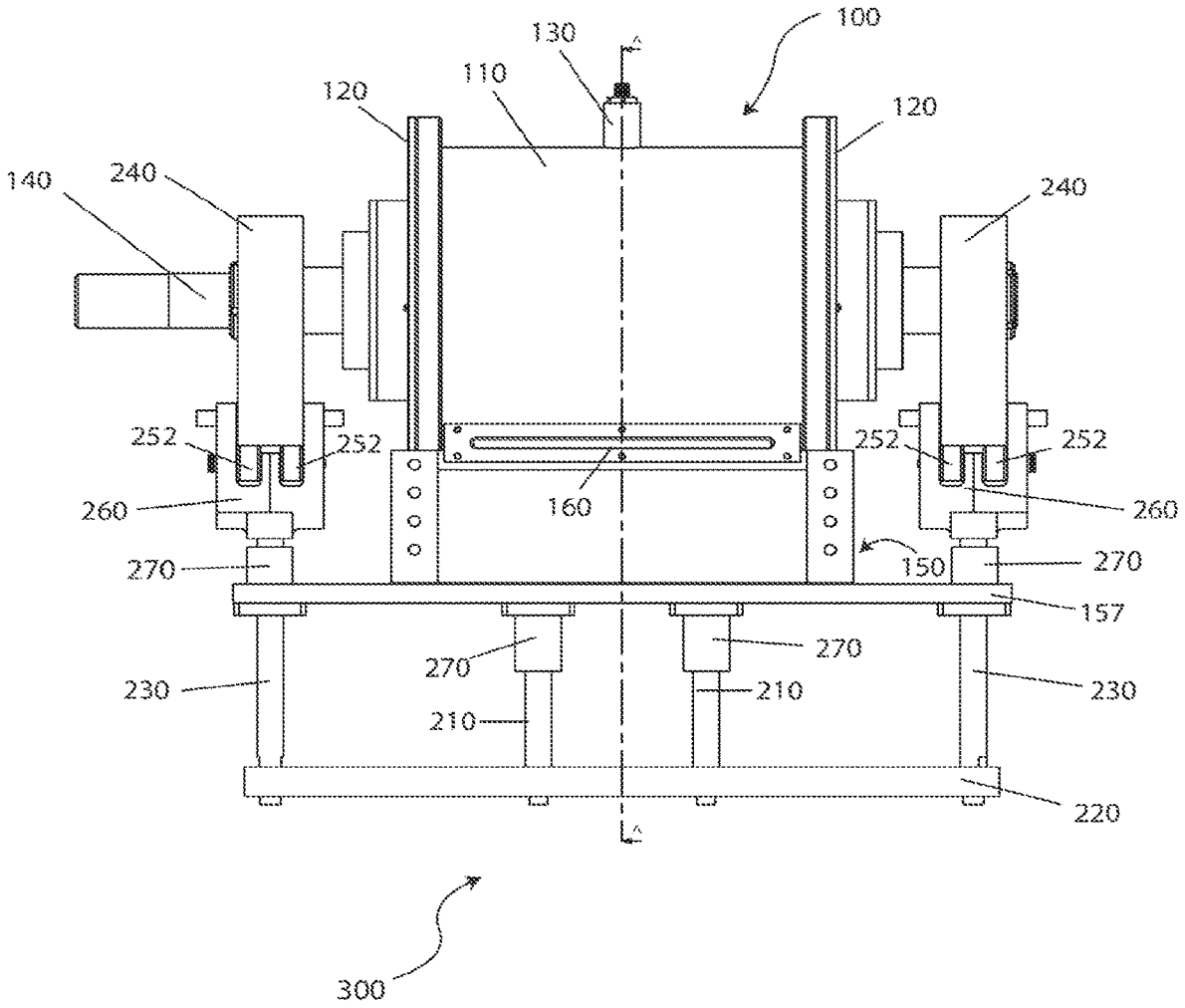
FIG. 12 is a left-side view of a rotary compressor with a dual cam follower gate positioning system in accordance with an embodiment of the present invention.
Figure 13:
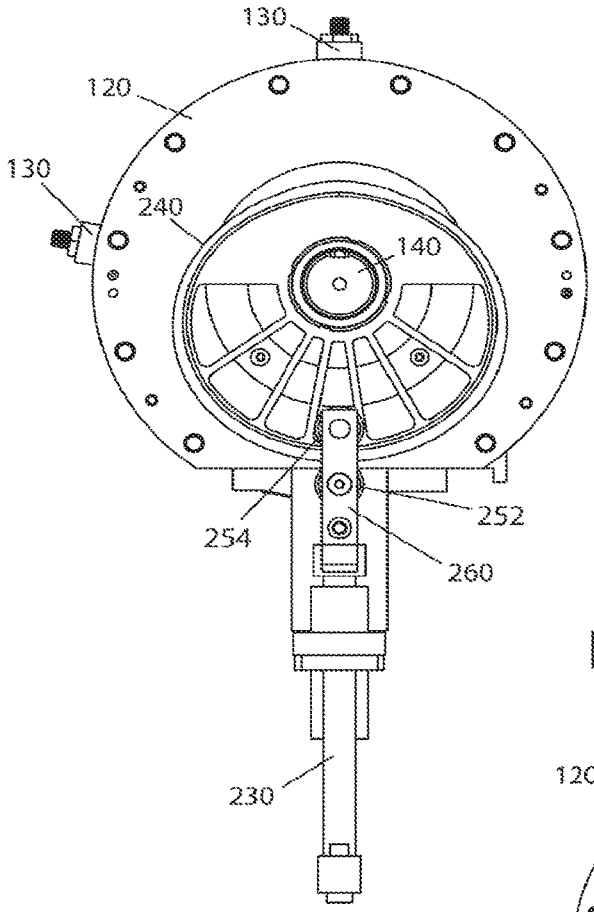
FIG. 13 is a front view of a rotary compressor with a dual cam follower gate positioning system in accordance with an embodiment of the present invention.
Figure 14:
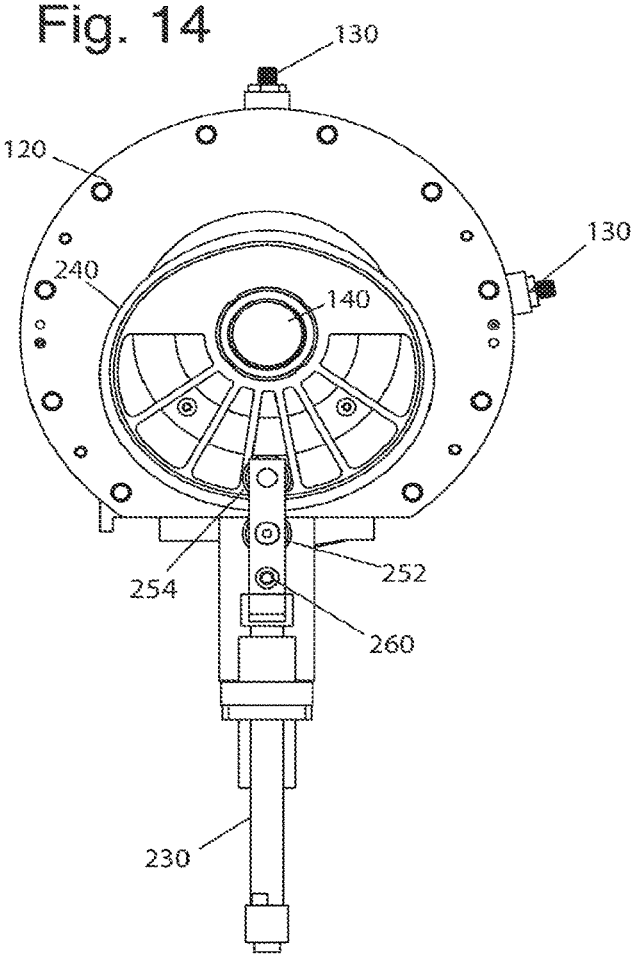
FIG. 14 is a back view of a rotary compressor with a dual cam follower gate positioning system in accordance with an embodiment of the present invention.
Figure 15:
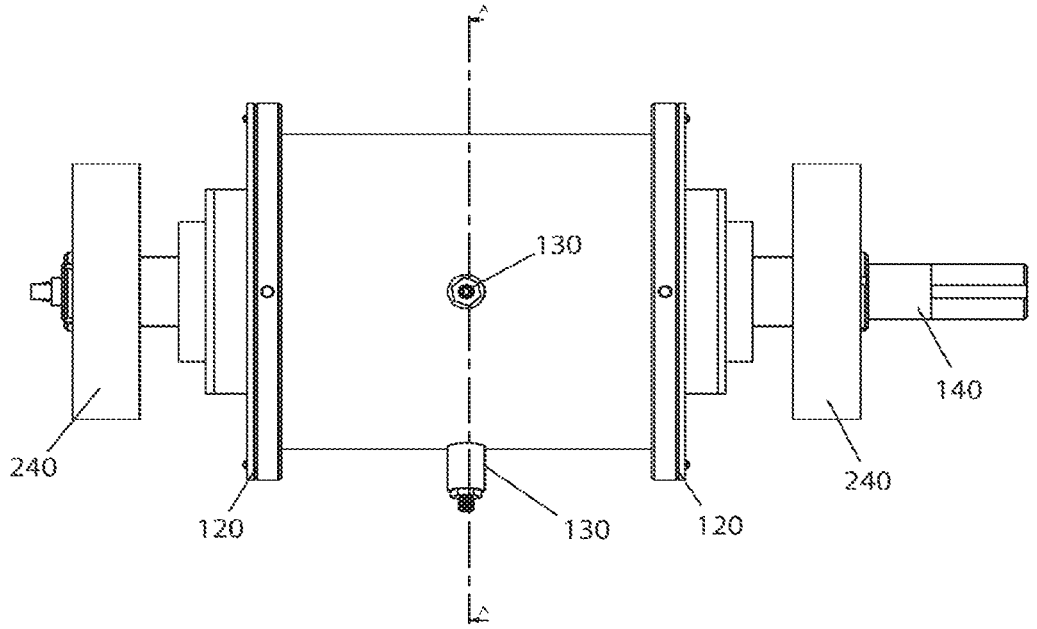
FIG. 15 is a top view of a rotary compressor with a dual cam follower gate positioning system in accordance with an embodiment of the present invention.
Figure 16:
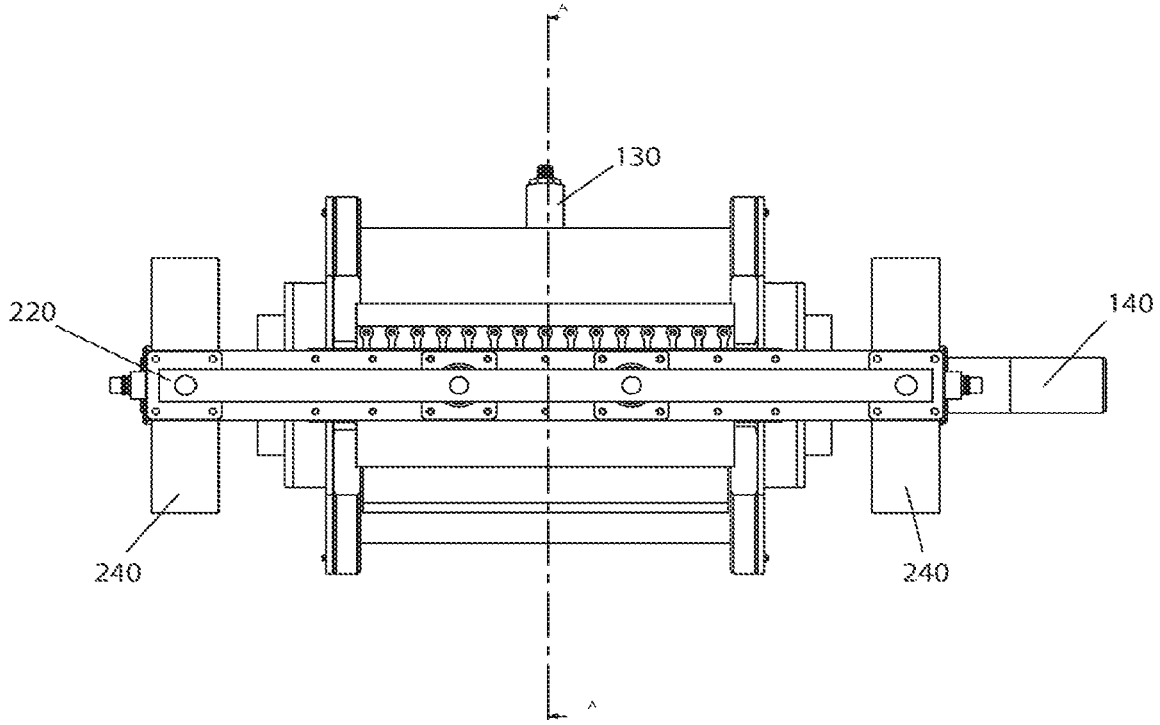
FIG. 16 is a bottom view of a rotary compressor with a dual cam follower gate positioning system in accordance with an embodiment of the present invention.

FIG. 9 shows an embodiment of the present invention in which a timing belt with spring gate positioning system is utilized. This embodiment 290 incorporates two timing belts 292 each of which is attached to the drive shaft 140 by way of sheaves 294. The timing belts 292 are attached to secondary shafts 142 by way of sheaves 295. Gate strut springs 296 are mounted around gate struts. Rocker arms 297 are mounted to rocker arm supports 299. The sheaves 295 are connected to rocker arm cams 293 to push the rocker arms 297 down. As the inner rings push down on one side of the rocker arms 297, the other side pushes up against the gate support bar 298. The gate support bar 298 pushes up against the gate struts and gate strut springs 296. This moves the gate up. The springs 296 provide a downward force pushing the gate down.

FIGS. 10 through 17 show external views of a rotary compressor embodiment utilizing a dual cam follower gate positioning system. The main housing 100 includes a main casing 110 and end plates 120, each of which includes a hole through which a drive shaft 140 passes axially. Liquid injector assemblies 130 are located on holes in the main casing 110. The main casing 110 also includes a hole for the inlet flange 160 and a hole for the gate casing 150. The gate casing 150 is mounted to and positioned below the main casing 110 as discussed above.

A dual cam follower gate positioning system 300 is attached to the gate casing 150 and drive shaft 140. The dual cam follower gate positioning system 300 moves the gate 600 in conjunction with the rotation of the rotor 500. In a preferred embodiment, the size and shape of the cams is nearly identical to the rotor in cross-sectional size and shape. In other embodiments, the rotor, cam shape, curvature, cam thickness, and variations in the thickness of the lip of the cam may be adjusted to account for variations in the attack angle of the cam follower. Further, large or smaller cam sizes may be used. For example, a similar shape but smaller size cam may be used to reduce roller speeds.

A movable assembly includes gate struts 210 and cam struts 230 connected to gate support arm 220 and bearing support plate 156. In this embodiment, the bearing support plate 157 is straight. As one of ordinary skill in the art would appreciate, the bearing support plate can utilize different geometries, including structures designed to or not to perform sealing of the gate casing 150. In this embodiment, the bearing support plate 157 serves to seal the bottom of the gate casing 150 through a bolted gasket connection. Bearing housings 270, also known as pillow blocks, are mounted to bearing support plate 157 and are concentric to the gate struts 210 and the cam struts 230. In certain embodiments, the components comprising this movable assembly may be optimized to reduce weight, thereby reducing the force necessary to achieve the necessary acceleration to keep the tip of gate 600 proximate to the rotor 500. Weight reduction could additionally and/or alternatively be achieved by removing material from the exterior of any of the moving components, as well as by hollowing out moving components, such as the gate struts 210 or the gate 600.

Drive shaft 140 turns cams 240, which transmit force to the cam followers 250, including upper cam followers 252 and lower cam followers 254. The cam followers 250 may be mounted on a through shaft, which is supported on both ends, or cantilevered and only supported on one end. In this embodiment, four cam followers 250 are used for each cam 240. Two lower cam followers 252 are located below and follow the outside edge of the cam 240. They are mounted using a through shaft. Two upper cam followers 254 are located above the previous two and follow the inside edge of the cams 240. They are mounted using a cantilevered connection.

The cam followers 250 are attached to cam follower supports 260, which transfer the force into the cam struts 230. As the cams 240 turn, the cam struts 230 move up and down. This moves the gate support arm 220 and gate struts 210 up and down, which in turn, moves the gate 600 up and down.

Figure 17:
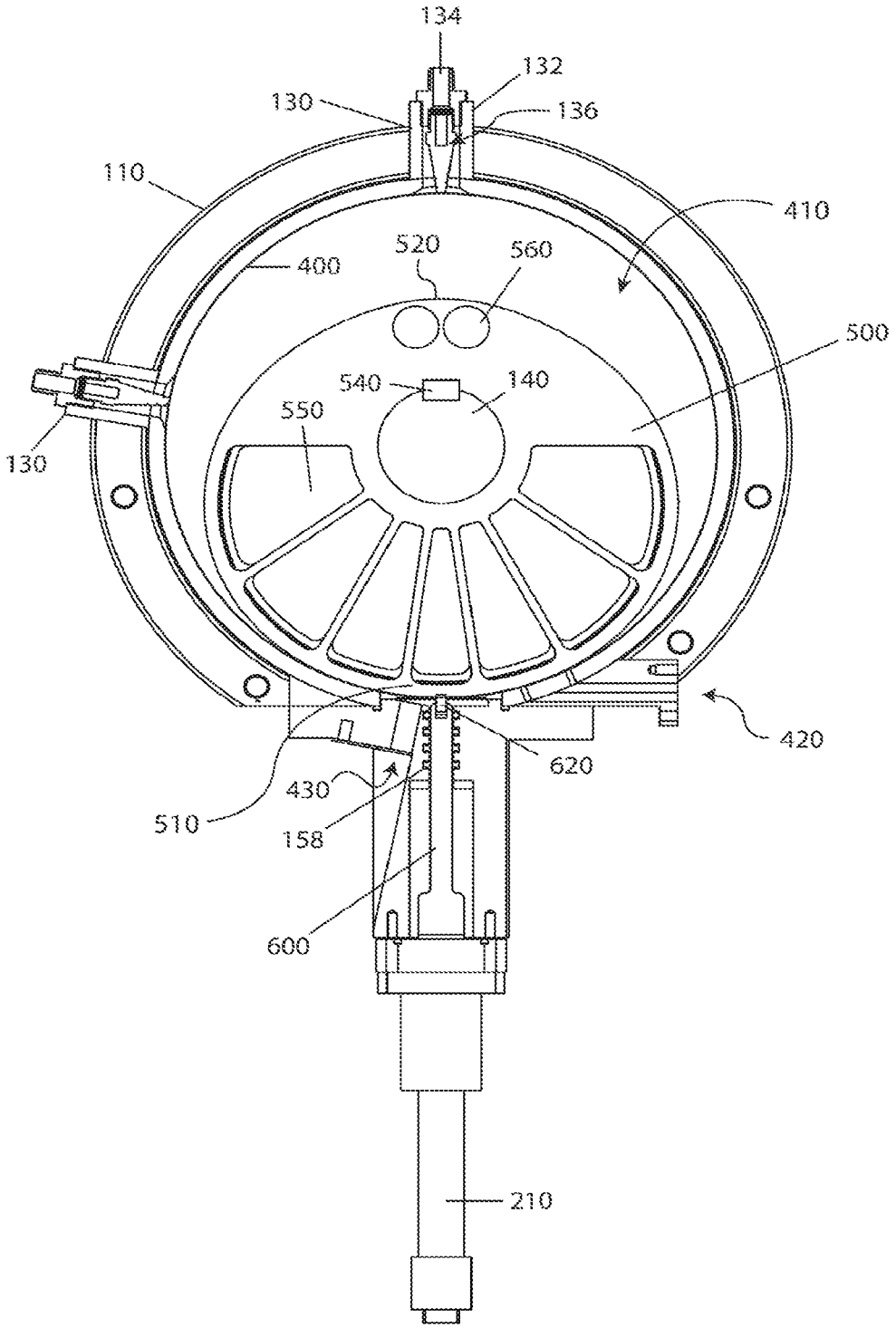
FIG. 17 is a cross-sectional view of a rotary compressor with a dual cam follower gate positioning system in accordance with an embodiment of the present invention.

Line A in FIGS. 11, 12, 15, and 16 show the location for the cross-sectional view of the compressor in FIG. 17. As shown in FIG. 17, the main casing 110 has a cylindrical shape. Liquid injector housings 132 are attached to or may be cast as a part of the main casing 110 to provide for openings in the rotor casing 400. The rotor 500 concentrically rotates around drive shaft 140.

Figure 18:
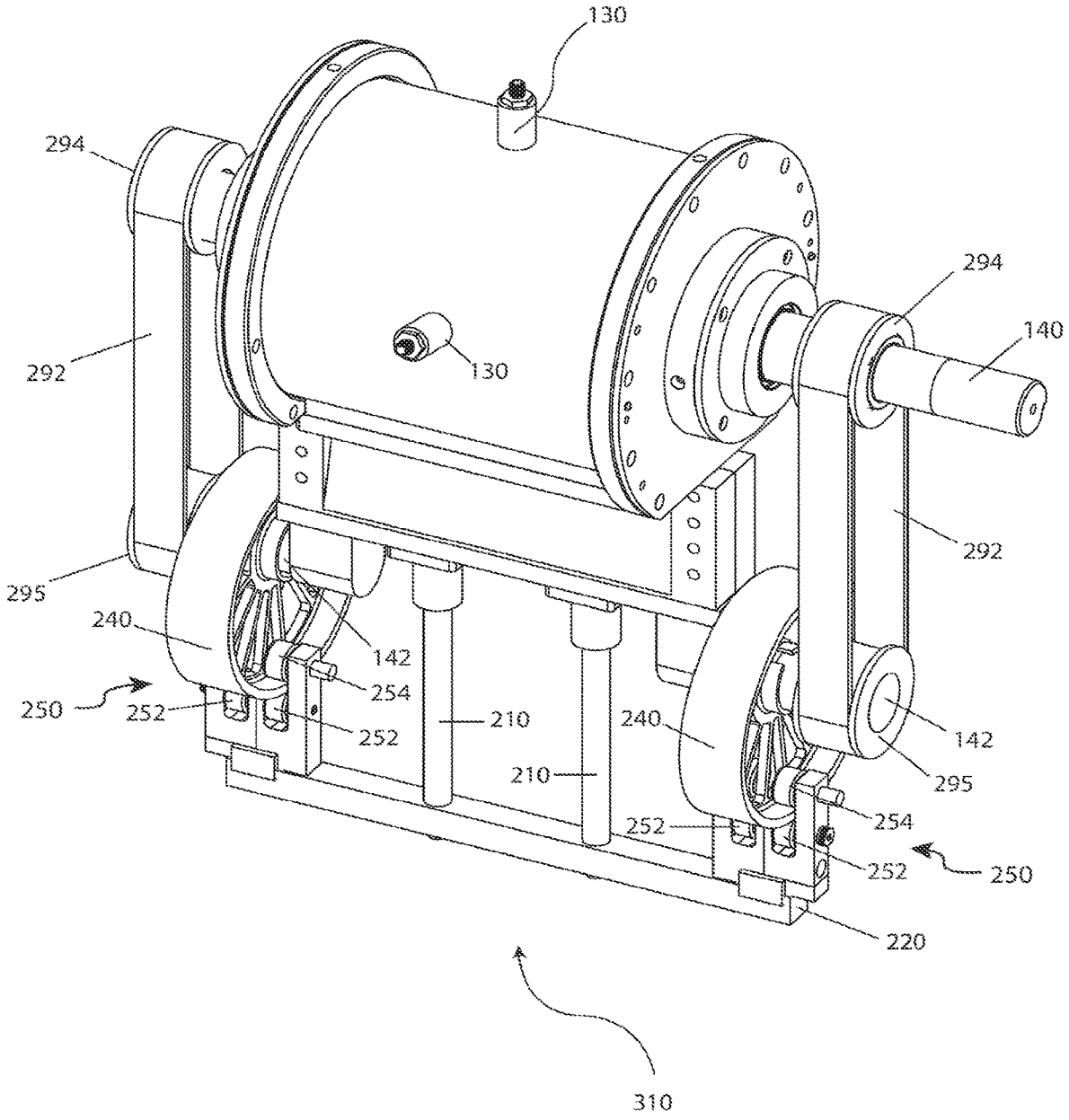
FIG. 18 is perspective view of a rotary compressor with a belt-driven gate positioning system in accordance with an embodiment of the present invention.
Figure 19:
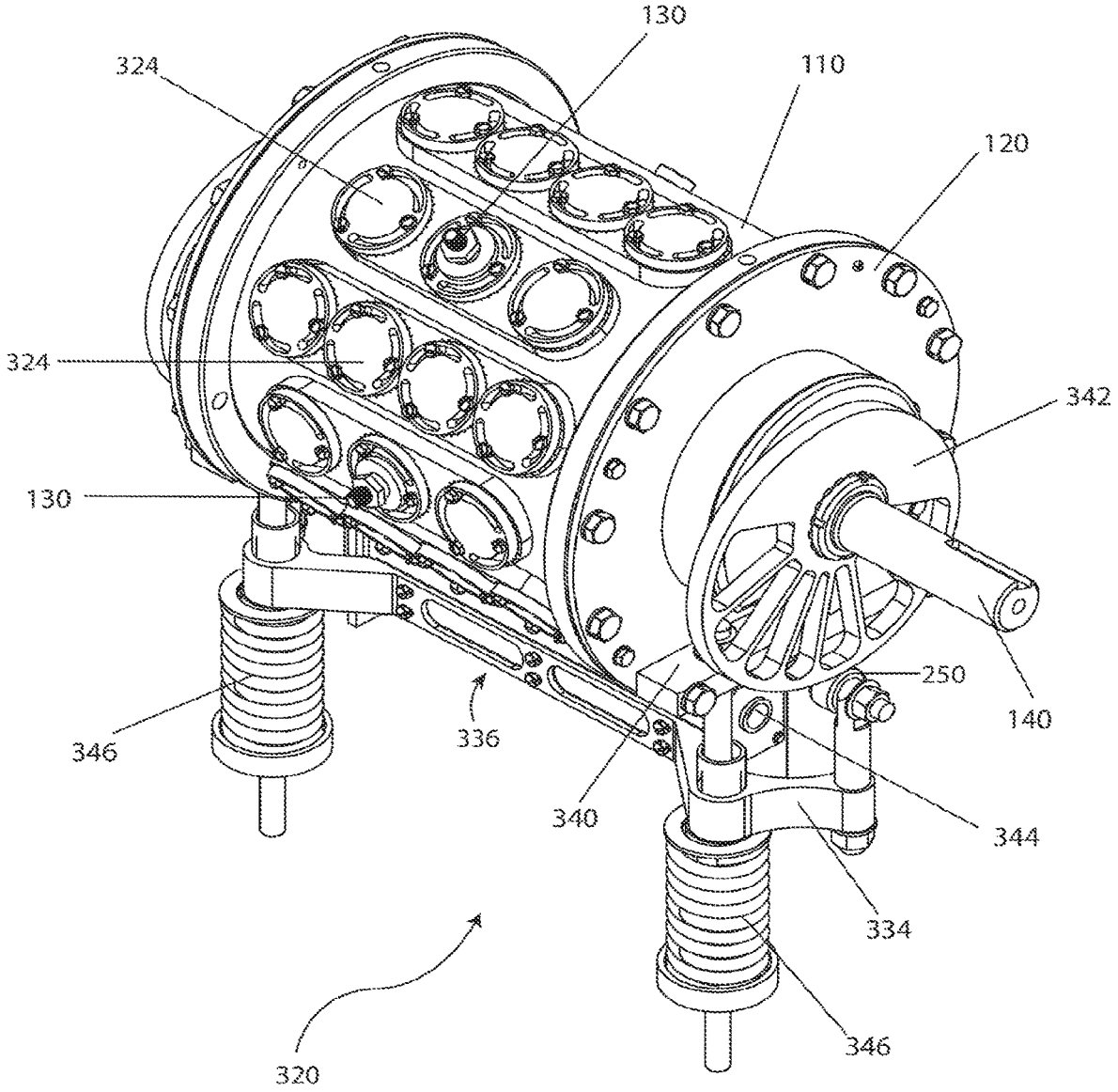
FIG. 19 is perspective view of a rotary compressor with an offset gate guide positioning system in accordance with an embodiment of the present invention.
Figure 20:
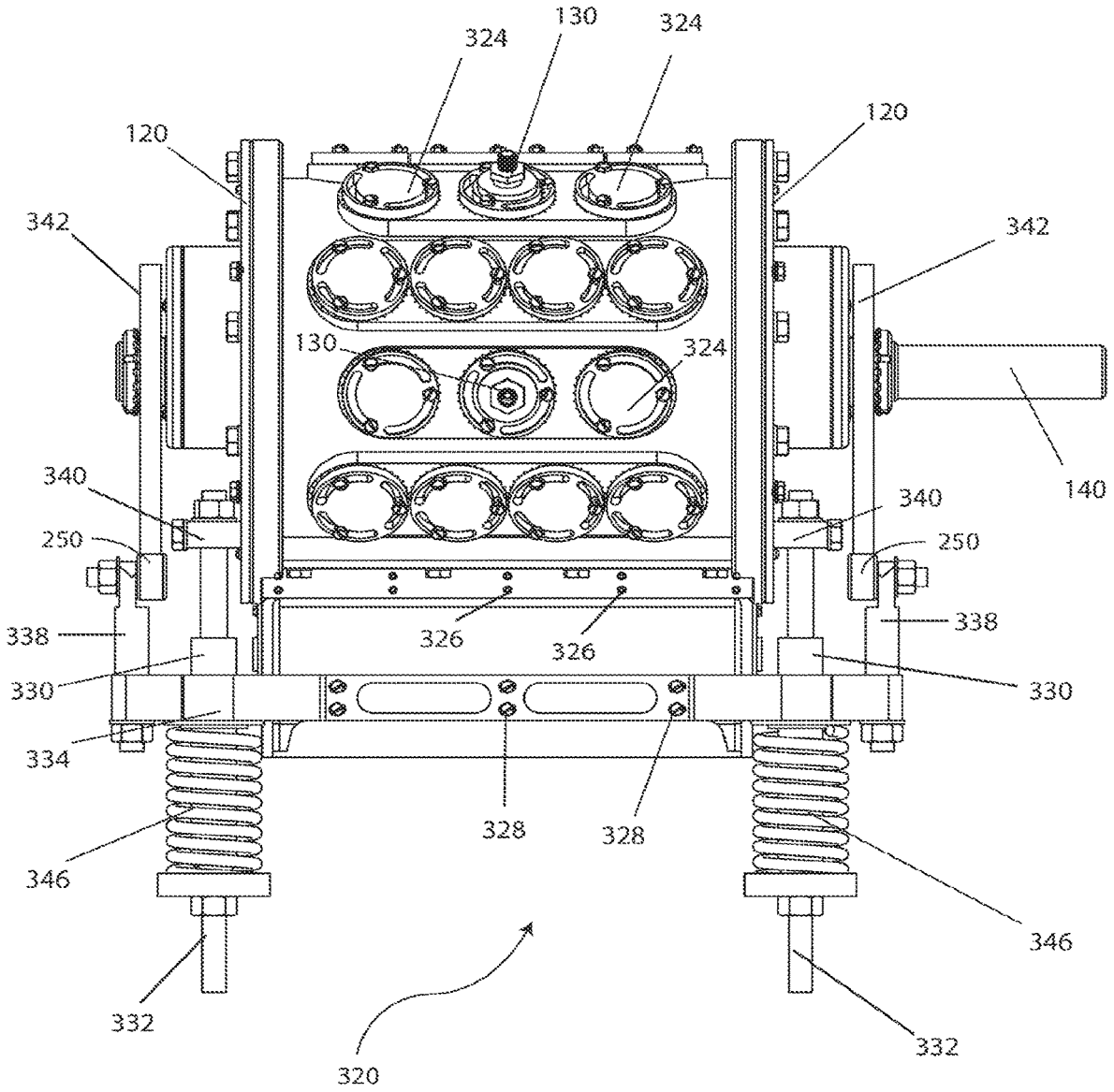
FIG. 20 is a right-side view of a rotary compressor with an offset gate guide positioning system in accordance with an embodiment of the present invention.
Figure 21:
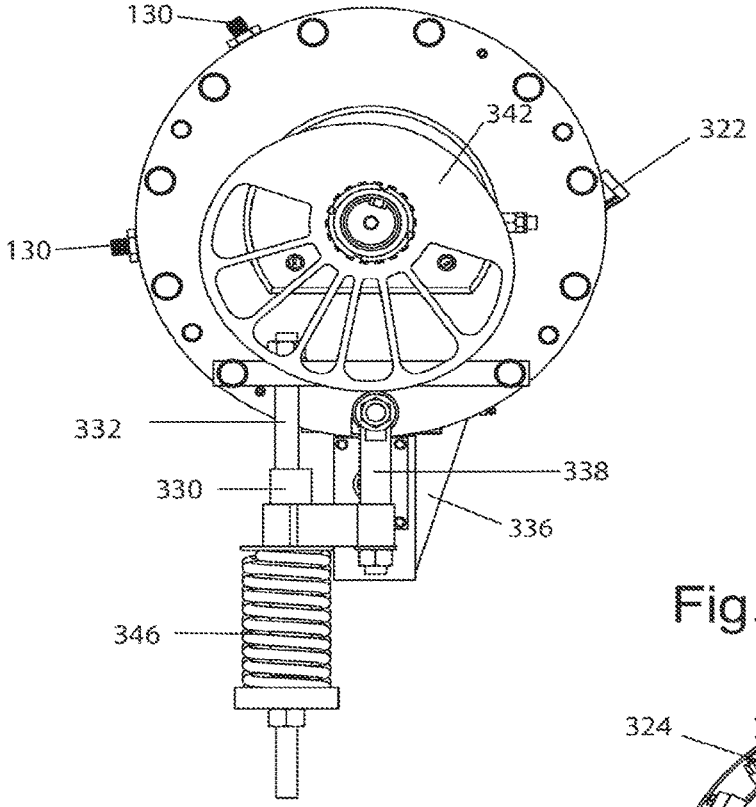
FIG. 21 is a front view of a rotary compressor with an offset gate guide positioning system in accordance with an embodiment of the present invention.
Figure 22:
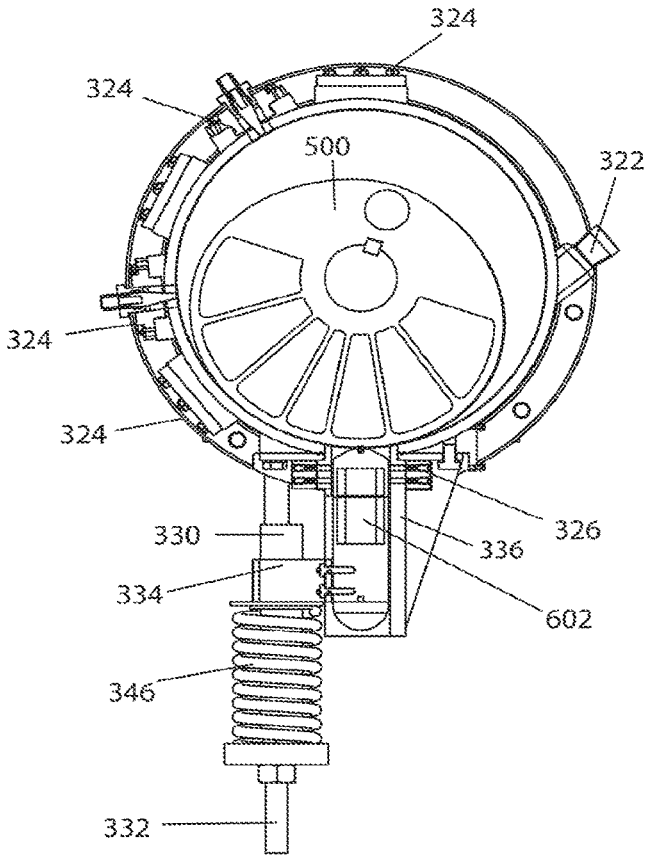
FIG. 22 is a cross-sectional view of a rotary compressor with an offset gate guide positioning system in accordance with an embodiment of the present invention.

An embodiment using a belt driven system 310 is shown in FIG. 18. Timing belts 292 are connected to the drive shaft 140 by way of sheaves 294. The timing belts 292 are each also connected to secondary shafts 142 by way of another set of sheaves 295. The secondary shafts 142 drive the external cams 240, which are placed below the gate casing 150 in this embodiment. Sets of upper and lower cam followers 254 and 252 are applied to the cams 240, which provide force to the movable assembly including gate struts 210 and gate support arm 220. As one of ordinary skill in the art would appreciate, belts may be replaced by chains or other materials.

An embodiment of the present invention using an offset gate guide system is shown in FIGS. 19 through 22 and 33. Outlet of the compressed gas and injected fluid is achieved through a ported gate system 602 comprised of two parts bolted together to allow for internal lightening features. Fluid passes through channels 630 in the upper portion of the gate 602 and travels to the lengthwise sides to outlet through an exhaust port 344 in a timed manner with relation to the angle of rotation of the rotor 500 during the cycle. Discrete point spring-backed scraper seals 326 provide sealing of the gate 602 in the single piece gate casing 336. Liquid injection is achieved through a variety of flat spray nozzles 322 and injector nozzles 130 across a variety of liquid injector port 324 locations and angles.

Reciprocating motion of the two-piece gate 602 is controlled through the use of an offset spring-backed cam follower control system 320 to achieve gate motion in concert with rotor rotation. Single cams 342 drive the gate system downwards through the transmission of force on the cam followers 250 through the cam struts 338. This results in controlled motion of the crossarm 334, which is connected by bolts (some of which are labeled as 328) with the two-piece gate 602. The crossarm 334 mounted linear bushings 330, which reciprocate along the length of cam shafts 332, control the motion of the gate 602 and the crossarm 334. The cam shafts 332 are fixed in a precise manner to the main casing through the use of cam shaft support blocks 340. Compression springs 346 are utilized to provide a returning force on the crossarm 334, allowing the cam followers 250 to maintain constant rolling contact with the cams, thereby achieving controlled reciprocating motion of the two-piece gate 602.

Figure 23:
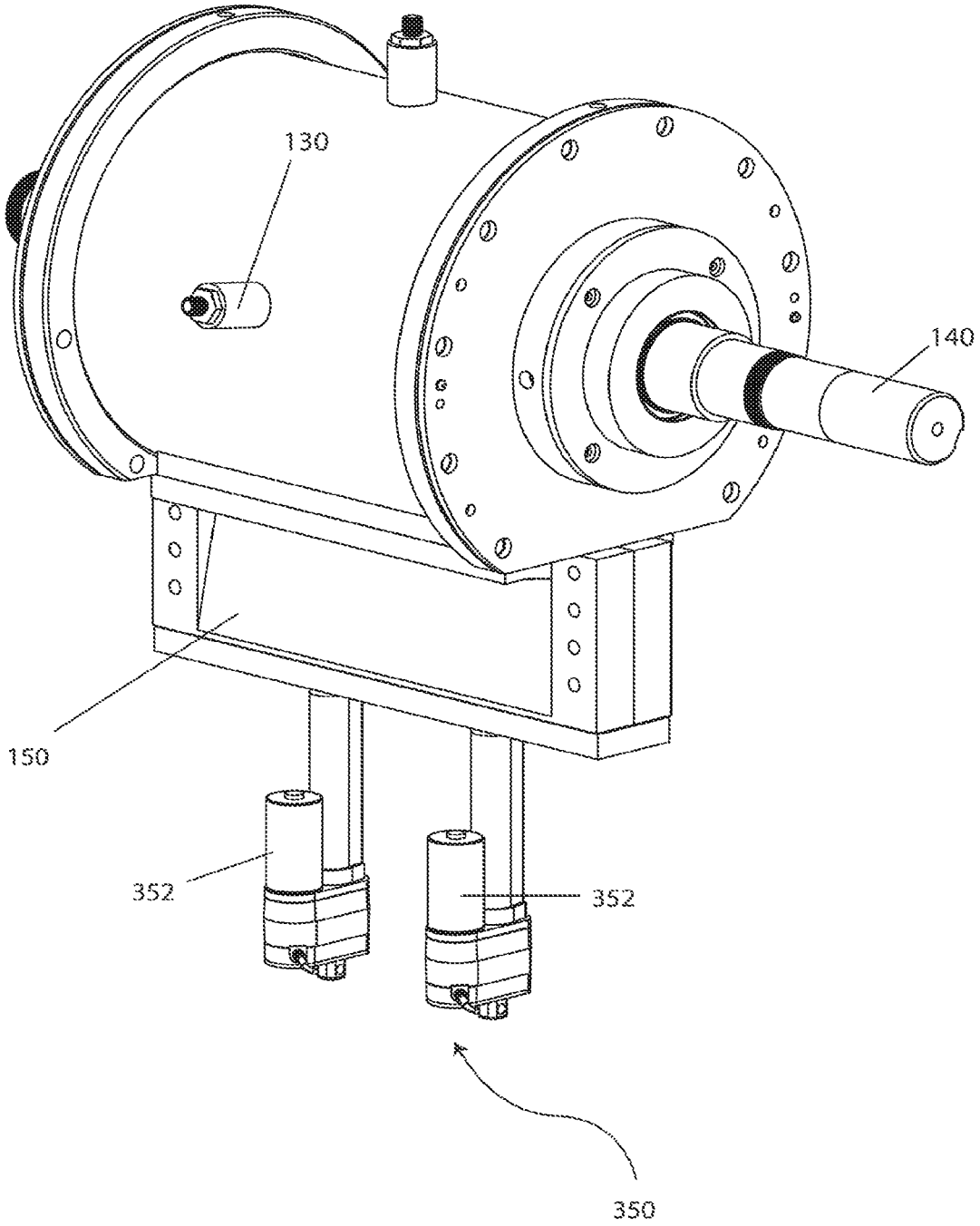
FIG. 23 is perspective view of a rotary compressor with a linear actuator gate positioning system in accordance with an embodiment of the present invention.

FIG. 23 shows an embodiment using a linear actuator system 350 for gate positioning. A pair of linear actuators 352 is used to drive the gate. In this embodiment, it is not necessary to mechanically link the drive shaft to the gate as with other embodiments. The linear actuators 352 are controlled so as to raise and lower the gate in accordance with the rotation of the rotor. The actuators may be electronic, hydraulic, belt-driven, electromagnetic, gas-driven, variable-friction, or other means. The actuators may be computer controlled or controlled by other means.

Figure 24A:
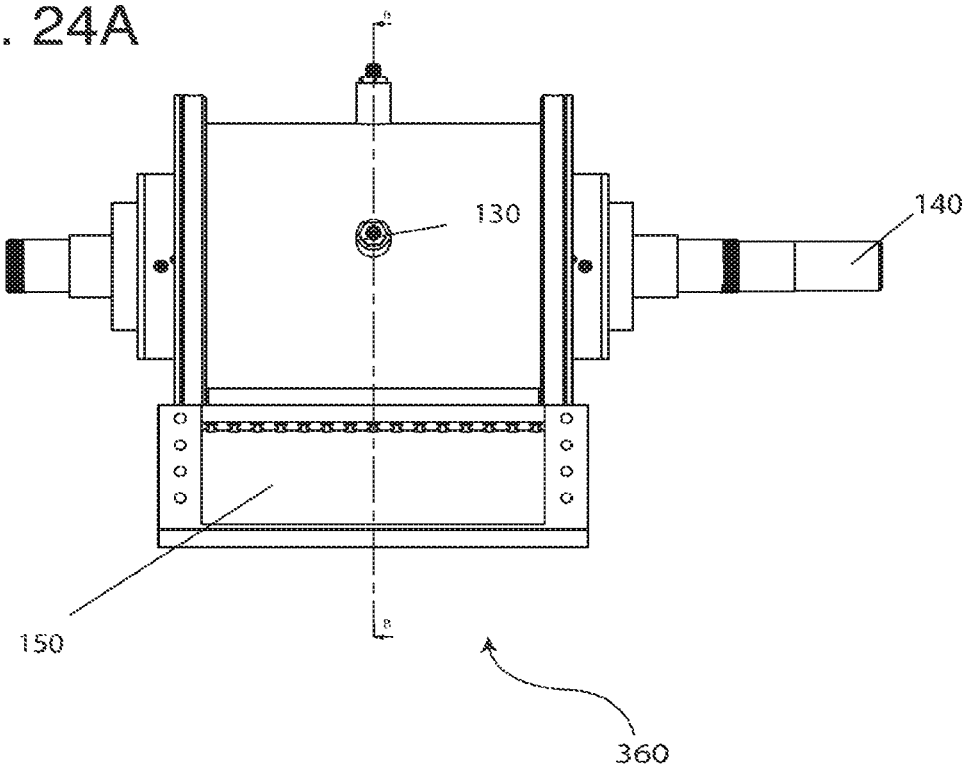
FIGS. 24A and B are right side and cross-section views, respectively, of a rotary compressor with a magnetic drive gate positioning system in accordance with an embodiment of the present invention
Figure 24B:
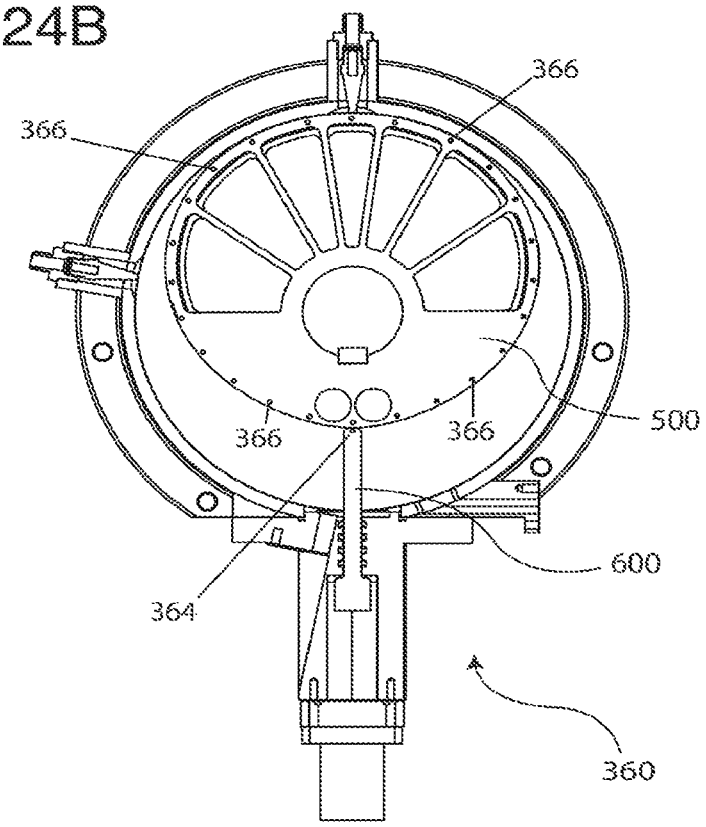

FIGS. 24A and B show a magnetic drive system 360. The gate system may be driven, or controlled, in a reciprocating motion through the placement of magnetic field generators, whether they are permanent magnets or electromagnets, on any combination of the rotor 500, gate 600, and/or gate casing 150. The purpose of this system is to maintain a constant distance from the tip of the gate 600 to the surface of the rotor 500 at all angles throughout the cycle. In a preferred magnetic system embodiment, permanent magnets 366 are mounted into the ends of the rotor 500 and retained. In addition, permanent magnets 364 are installed and retained in the gate 600. Poles of the magnets are aligned so that the magnetic force generated between the rotor's magnets 366 and the gate's magnets 364 is a repulsive force, forcing the gate 600 down throughout the cycle to control its motion and maintain constant distance. To provide an upward, returning force on the gate 600, additional magnets (not shown) are installed into the bottom of the gate 600 and the bottom of the gate casing 150 to provide an additional repulsive force. The magnetic drive systems are balanced to precisely control the gate's reciprocating motion.

Alternative embodiments may use an alternate pole orientation to provide attractive forces between the gate and rotor on the top portion of the gate and attractive forces between the gate and gate casing on the bottom portion of the gate. In place of the lower magnet system, springs may be used to provide a repulsive force. In each embodiment, electromagnets may be used in place of permanent magnets. In addition, switched reluctance electromagnets may also be utilized. In another embodiment, electromagnets may be used only in the rotor and gate. Their poles may switch at each inflection point of the gate's travel during its reciprocating cycle, allowing them to be used in an attractive and repulsive method.

Alternatively, direct hydraulic or indirect hydraulic (hydropneumatic) can be used to apply motive force/energy to the gate to drive it and position it adequately. Solenoid or other flow control valves can be used to feed and regulate the position and movement of the hydraulic or hydropneumatic elements. Hydraulic force may be converted to mechanical force acting on the gate through the use of a cylinder based or direct hydraulic actuators using membranes/diaphragms.

Figure 25:
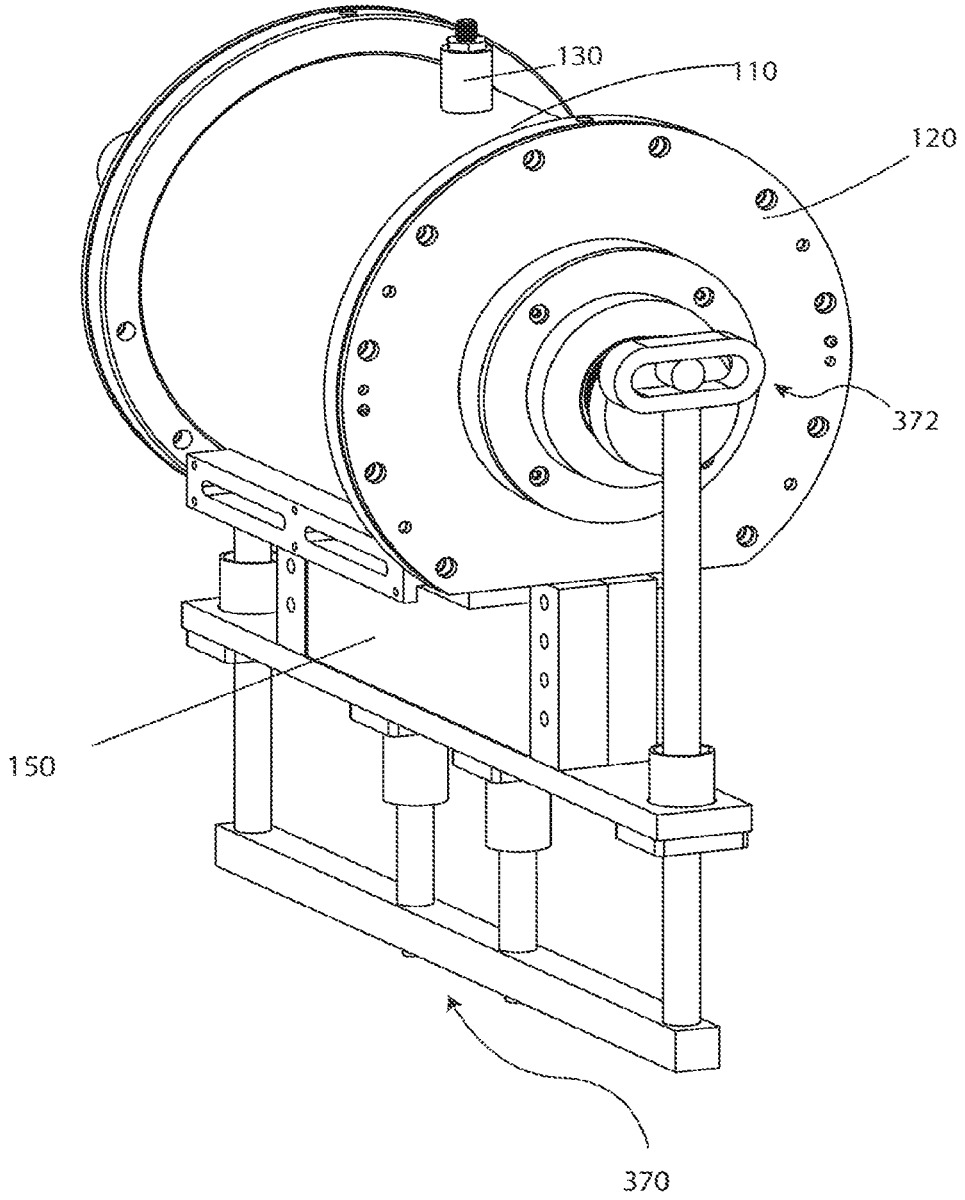
FIG. 25 is perspective view of a rotary compressor with a scotch yoke gate positioning system in accordance with an embodiment of the present invention.

FIG. 25 shows an embodiment using a scotch yoke gate positioning system 370. Here, a pair of scotch yokes 372 is connected to the drive shaft and the bearing support plate. A roller rotates at a fixed radius with respect to the shaft. The roller follows a slot within the yoke 372, which is constrained to a reciprocating motion. The yoke geometry can be manipulated to a specific shape that will result in desired gate dynamics.

As one of skill in the art would appreciate, these alternative drive mechanisms do not require any particular number of linkages between the drive shaft and the gate. For example, a single spring, belt, linkage bar, or yoke could be used. Depending on the design implementation, more than two such elements could be used.

FIGS. 26A-26F show a compression cycle of an embodiment utilizing a tip seal 620. As the drive shaft 140 turns, the rotor 500 and gate strut 210 push up gate 600 so that it is timed with the rotor 500. As the rotor 500 turns clockwise, the gate 600 rises up until the rotor 500 is in the 12 o'clock position shown in FIG. 26C. As the rotor 500 continues to turn, the gate 600 moves downward until it is back at the 6 o'clock position in FIG. 26F. The gate 600 separates the portion of the cylinder that is not taken up by rotor 500 into two components: an intake component 412 and a compression component 414. In one embodiment, tip seal 620 may not be centered within the gate 600, but may instead be shifted towards one side so as to minimize the area on the top of the gate on which pressure may exert a downwards force on the gate. This may also have the effect of minimizing the clearance volume of the system. In another embodiment, the end of the tip seal 620 proximate to the rotor 500 may be rounded, so as to accommodate the varying contact angle that will be encountered as the tip seal 620 contacts the rotor 500 at different points in its rotation.

Figure 26C:
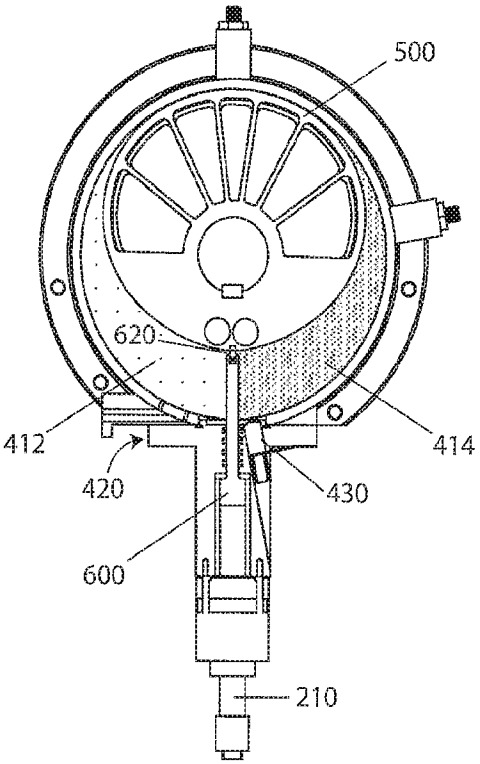
FIGS. 26A-F are cross-sectional views of the inside of an embodiment of a rotary compressor with a contacting tip seal in a compression cycle in accordance with an embodiment of the present invention.
Figure 26B:
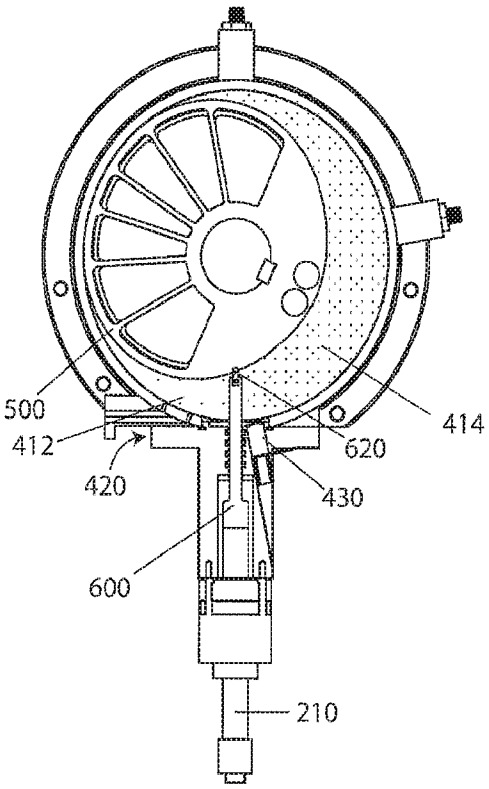
Figure 26A:
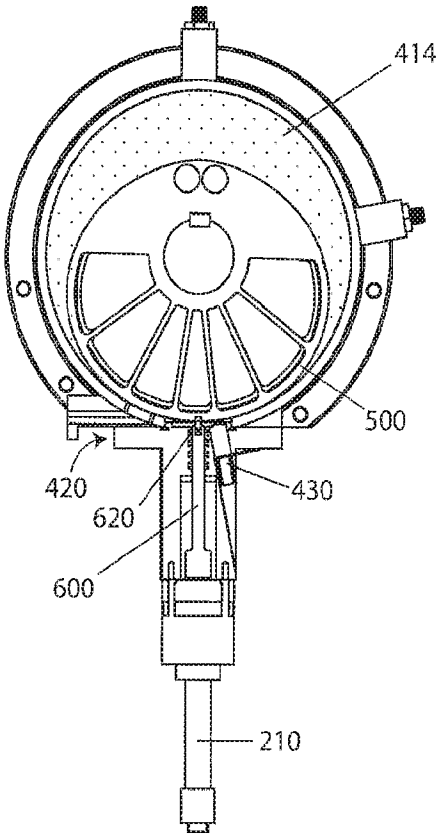
Figure 26F:
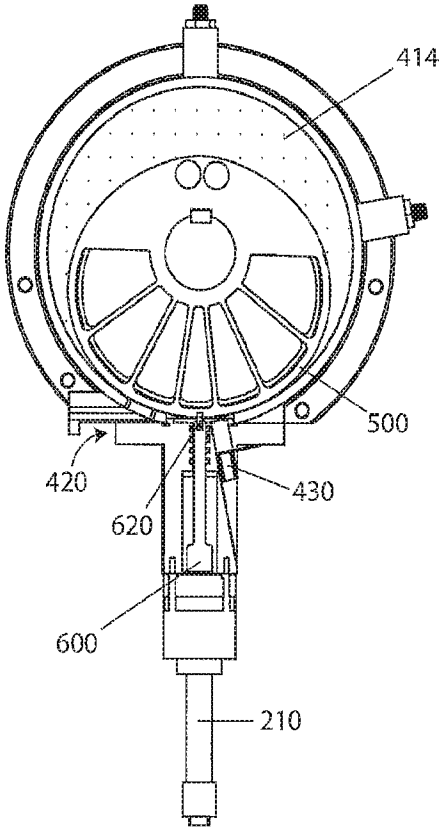
Figure 26E:
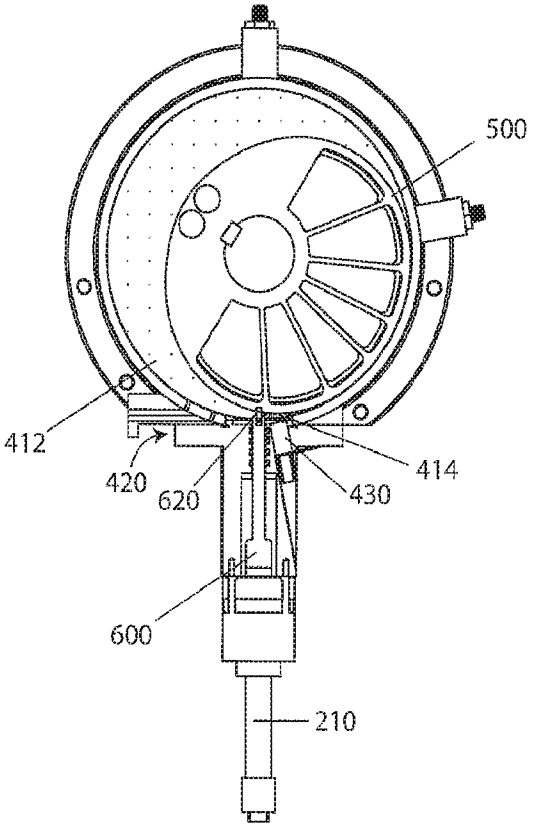
Figure 26D:
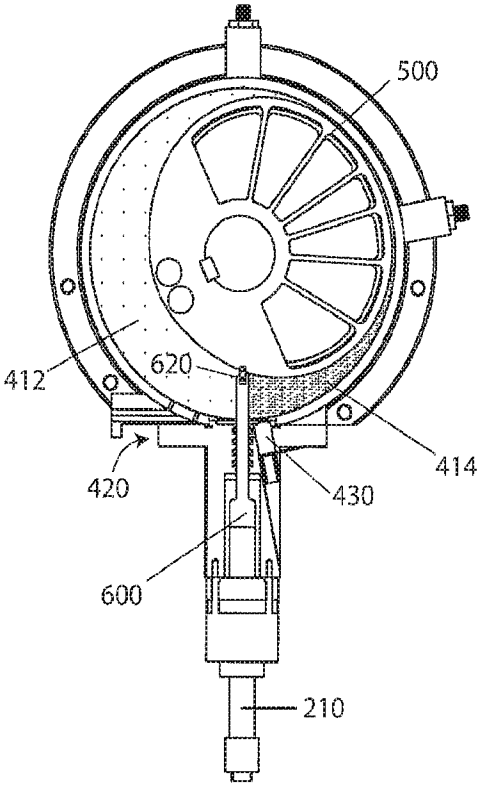
Figure 27C:
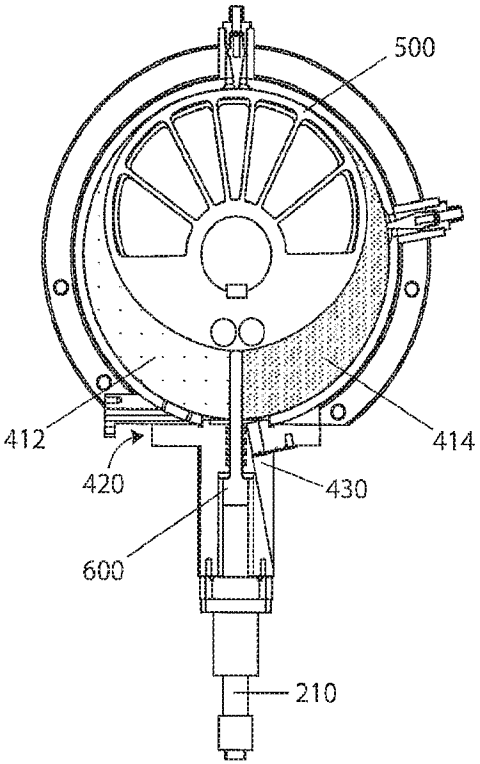
FIGS. 27A-F are cross-sectional views of the inside of an embodiment of a rotary compressor without a contacting tip seal in a compression cycle in accordance with another embodiment of the present invention.
Figure 27B:
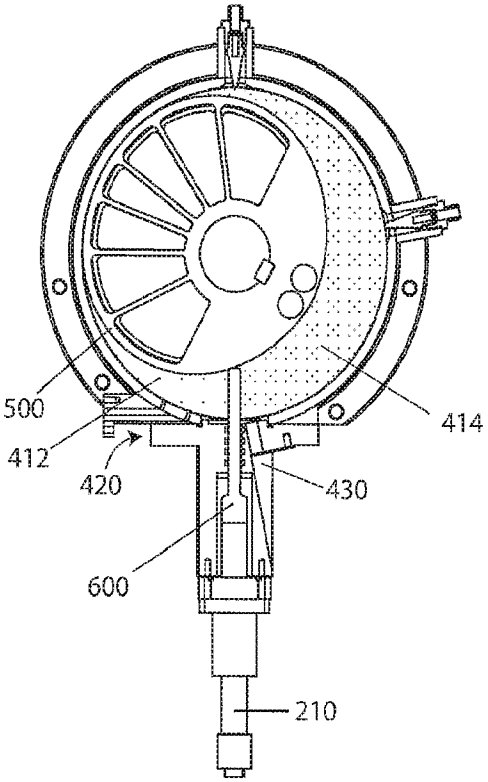
Figure 27A:
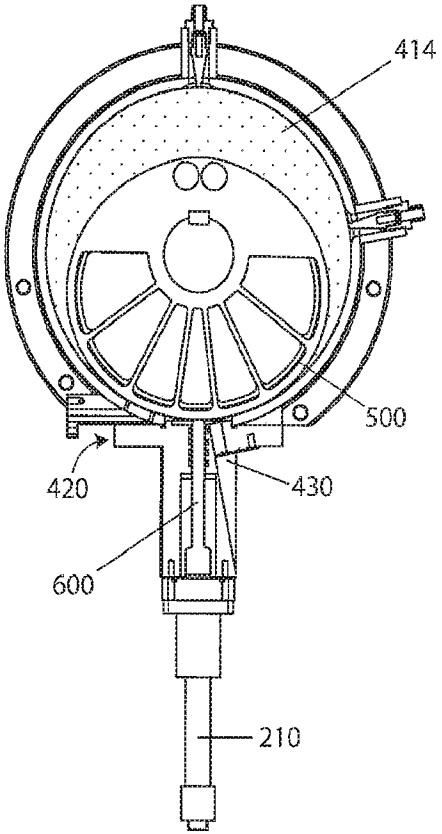
Figure 27F:
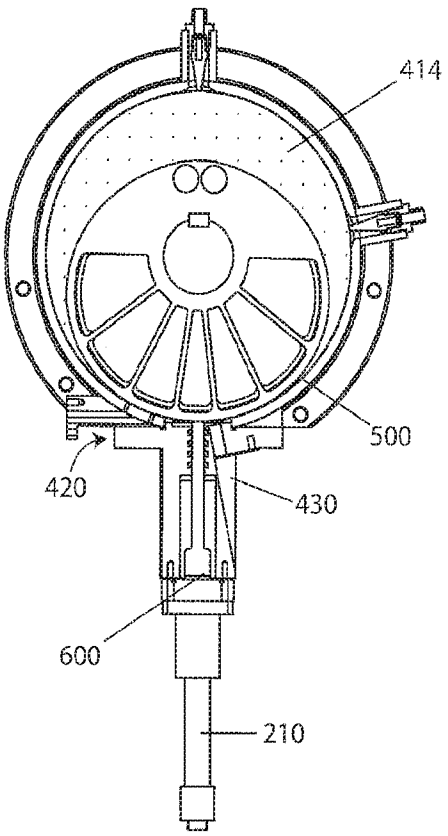
Figure 27E:
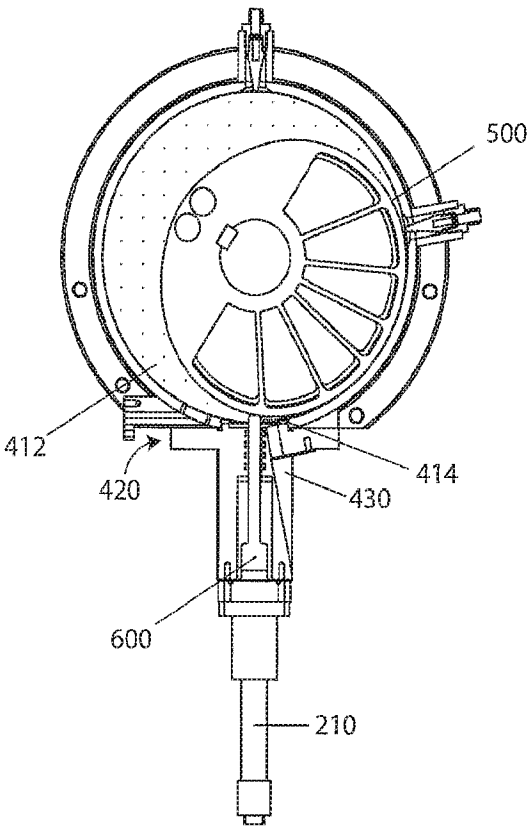
Figure 27D:
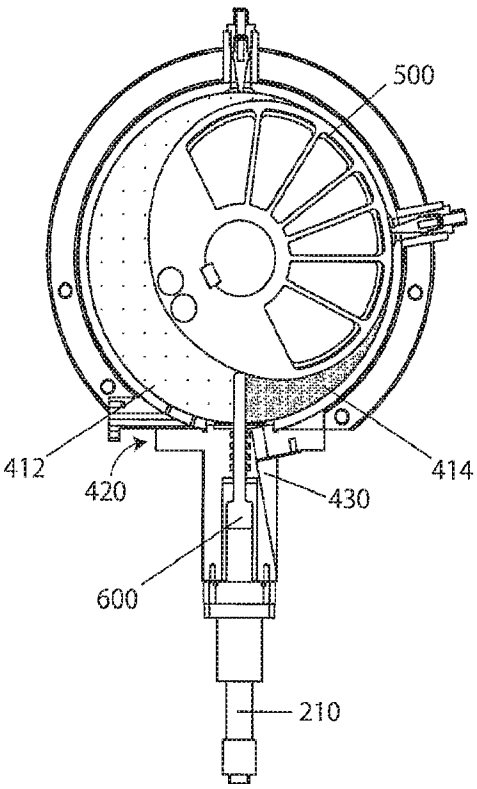

FIGS. 26A-F depict steady state operation. Accordingly, in FIG. 26A, where the rotor 500 is in the 6 o'clock position, the compression volume 414, which constitutes a subset of the rotor casing volume 410, already has received fluid. In FIG. 26B, the rotor 500 has turned clockwise and gate 600 has risen so that the tip seal 620 makes contact with the rotor 500 to separate the intake volume 412, which also constitutes a subset of the rotor casing volume 410, from the compression volume 414. Embodiments using the roller tip 650 discussed below instead of tip seal 620 would operate similarly. As the rotor 500 turns, as shown further in FIGS. 26C-E, the intake volume 412 increases, thereby drawing in more fluid from inlet 420, while the compression volume 414 decreases. As the volume of the compression volume 414 decreases, the pressure increases. The pressurized fluid is then expelled by way of an outlet 430. At a point in the compression cycle when a desired high pressure is reached, the outlet valve opens and the high pressure fluid can leave the compression volume 414. In this embodiment, the valve outputs both the compressed gas and the liquid injected into the compression chamber.

FIGS. 27A-27F show an embodiment in which the gate 600 does not use a tip seal. Instead, the gate 600 is timed to be proximate to the rotor 500 as it turns. The close proximity of the gate 600 to the rotor 500 leaves only a very small path for high pressure fluid to escape. Close proximity in conjunction with the presence of liquid (due to the liquid injectors 136 or an injector placed in the gate itself) allow the gate 600 to effectively create an intake fluid component 412 and a compression component 414. Embodiments incorporating notches 640 would operate similarly.

FIG. 28 shows a cross-sectional perspective view of the rotor casing 400, the rotor 500, and the gate 600. The inlet port 420 shows the path that gas can enter. The outlet 430 is comprised of several holes that serve as outlet ports 435 that lead to outlet valves 440. The gate casing 150 consists of an inlet side 152 and an outlet side 154. A return pressure path (not shown) may be connected to the inlet side 152 of the gate casing 150 and the inlet port 420 to ensure that there is no back pressure build up against gate 600 due to leakage through the gate seals. As one of ordinary skill in the art would appreciate, it is desirable to achieve a hermetic seal, although perfect hermetic sealing is not necessary.

In alternate embodiments, the outlet ports 435 may be located in the rotor casing 400 instead of the gate casing 150. They may be located at a variety of different locations within the rotor casing. The outlet valves 440 may be located closer to the compression chamber, effectively minimizing the volume of the outlet ports 430, to minimize the clearance volume related to these outlet ports. A valve cartridge may be used which houses one or more outlet valves 440 and connects directly to the rotor casing 400 or gate casing 150 to align the outlet valves 440 with outlet ports 435. This may allow for ease of installing and removing the outlet valves 440.

Figure 29:
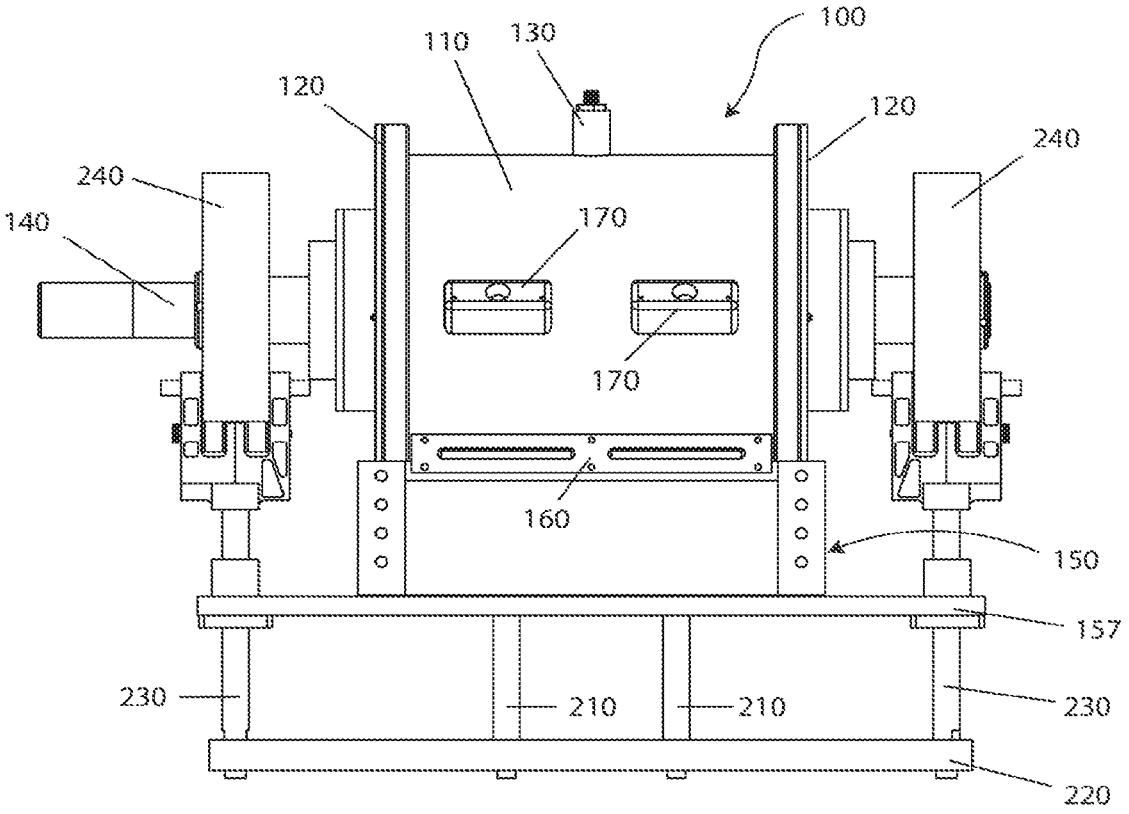
FIG. 29 is a left-side view of an additional liquid injectors embodiment of the present invention.

FIG. 29 shows an alternative embodiment in which flat spray liquid injector housings 170 are located on the main casing 110 at approximately the 3 o'clock position. These injectors can be used to inject liquid directly onto the inlet side of the gate 600, ensuring that it does not reach high temperatures. These injectors also help to provide a coating of liquid on the rotor 500, helping to seal the compressor.

Figure 30:
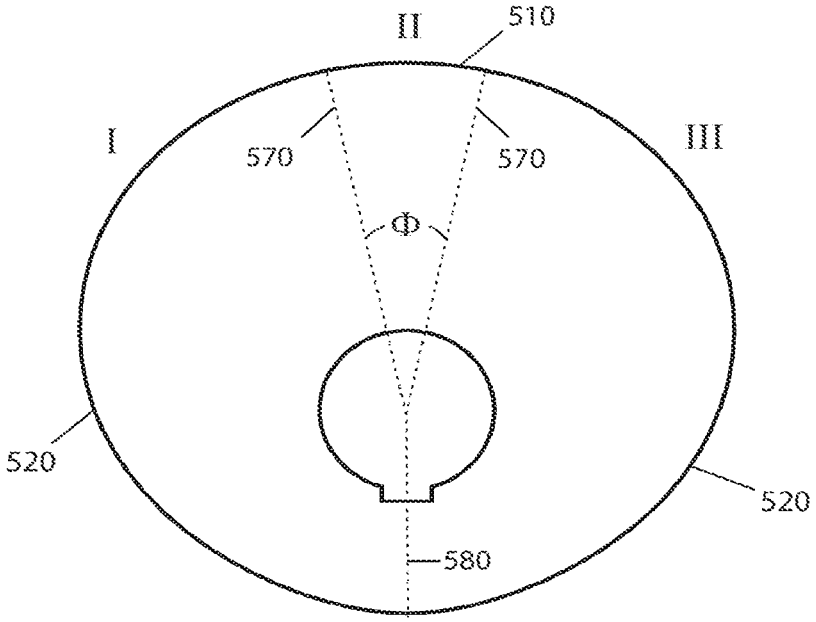
FIG. 30 is a cross-section view of a rotor design in accordance with an embodiment of the present invention.

As discussed above, the preferred embodiments utilize a rotor that concentrically rotates within a rotor casing. In the preferred embodiment, the rotor 500 is a right cylinder with a non-circular cross-section that runs the length of the main casing 110. FIG. 30 shows a cross-sectional view of the sealing and non-sealing portions of the rotor 500. The profile of the rotor 500 is comprised of three sections. The radii in sections I and III are defined by a cycloidal curve. This curve also represents the rise and fall of the gate and defines an optimum acceleration profile for the gate. Other embodiments may use different curve functions to define the radius such as a double harmonic function. Section II employs a constant radius 570, which corresponds to the maximum radius of the rotor. The minimum radius 580 is located at the intersection of sections I and III, at the bottom of rotor 500. In a preferred embodiment, Φ is 23.8 degrees. In alternative embodiments, other angles may be utilized depending on the desired size of the compressor, the desired acceleration of the gate, and desired sealing area.

The radii of the rotor 500 in one preferred embodiment can be calculated using the following functions:

$$r(t) = \begin{cases} r_I = r_{min} + h\left[\frac{t_I}{T} + \sin\left(\frac{2\pi t_I}{T}\right)\right] \\ r_{II} = r_{max} \\ r_{III} = r_{min} + h\left[\frac{t_{III}}{T} + \sin\left(\frac{2\pi t_{III}}{T}\right)\right] \end{cases}$$

According to an alternative embodiment, the radii of the rotor 500 is calculated as a 3-4-5-polynomial function.

In a preferred embodiment, the rotor 500 is symmetrical along one axis. It may generally resemble a cross-sectional egg shape. The rotor 500 includes a hole 530 in which the drive shaft 140 and a key 540 may be mounted. The rotor 500 has a sealing section 510, which is the outer surface of the rotor 500 corresponding to section II, and a non-sealing section 520, which is the outer surface of the rotor 500 corresponding to sections I and III. The sections I and III have a smaller radius than sections II creating a compression volume. The sealing portion 510 is shaped to correspond to the curvature of the rotor casing 400, thereby creating a dwell seal that effectively minimizes communication between the outlet 430 and inlet 420. Physical contact is not required for the dwell seal. Instead, it is sufficient to create a tortuous path that minimizes the amount of fluid that can pass through. In a preferred embodiment, the gap between the rotor and the casing in this embodiment is less than 0.008 inches. As one of ordinary skill in the art would appreciate, this gap may be altered depending on tolerances, both in machining the rotor 500 and rotor housing 400, temperature, material properties, and other specific application requirements.

Additionally, as discussed below, liquid is injected into the compression chamber. By becoming entrained in the gap between the sealing portion 510 and the rotor casing 400, the liquid can increase the effectiveness of the dwell seal.

Figure 31A:
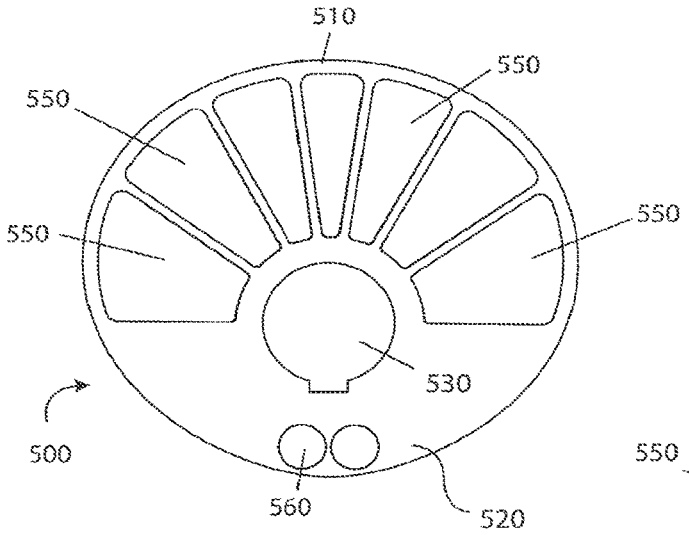
FIGS. 31A-D are cross-sectional views of rotor designs in accordance with various embodiments of the present invention.

As shown in FIG. 31A, the rotor 500 is balanced with cut out shapes and counterweights. Holes, some of which are marked as 550, lighten the rotor 500. These lightening holes may be filled with a low density material to ensure that liquid cannot encroach into the rotor interior. Alternatively, caps may be placed on the ends of rotor 500 to seal the lightening holes. Counterweights, one of which is labeled as 560, are made of a denser material than the remainder of the rotor 500. The shapes of the counterweights can vary and do not need to be cylindrical.

The rotor design provides several advantages. As shown in the embodiment of FIG. 31A, the rotor 500 includes 7 cutout holes 550 on one side and two counterweights 560 on the other side to allow the center of mass to match the center of rotation. An opening 530 includes space for the drive shaft and a key. This weight distribution is designed to achieve balanced, concentric motion. The number and location of cutouts and counterweights may be changed depending on structural integrity, weight distribution, and balanced rotation parameters. In various embodiments, cutouts and/or counterweights or neither may be used required to achieve balanced rotor rotation.

The cross-sectional shape of the rotor 500 allows for concentric rotation about the drive shaft's axis of rotation, a dwell seal 510 portion, and open space on the non-sealing side for increased gas volume for compression. Concentric rotation provides for rotation about the drive shaft's principal axis of rotation and thus smoother motion and reduced noise.

Figure 31B:
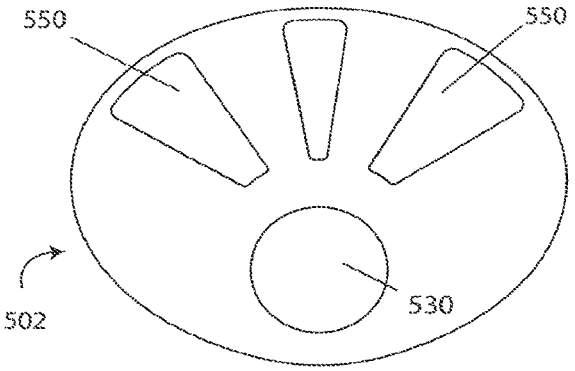
Figure 31C:
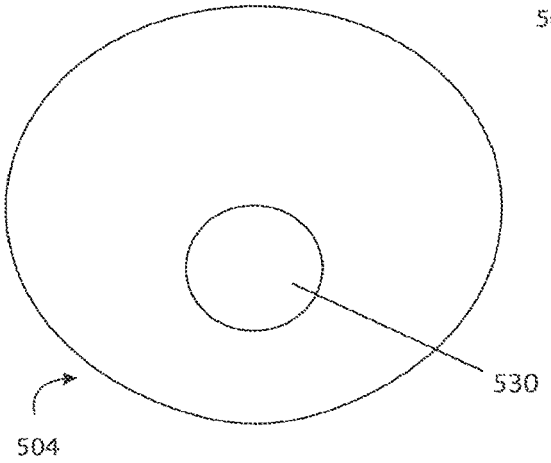
Figure 31D:
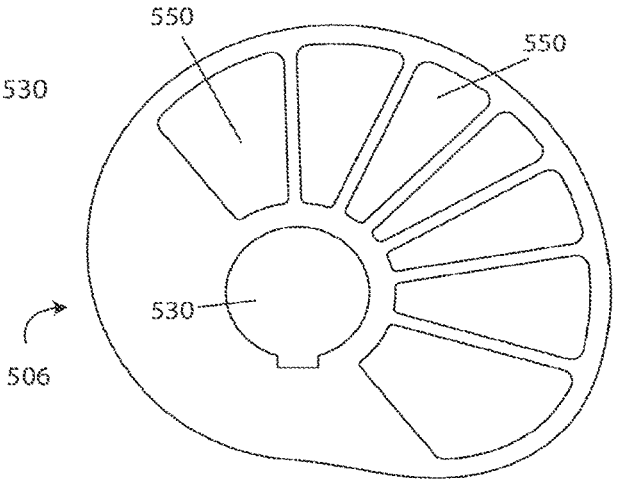

An alternative rotor design 502 is shown in FIG. 31B. In this embodiment, a different arc of curvature is implemented utilizing three holes 550 and a circular opening 530. Another alternative design 504 is shown in FIG. 31C. Here, a solid rotor shape is used and a larger hole 530 (for a larger drive shaft) is implemented. Yet another alternative rotor design 506 is shown in FIG. 31D incorporating an asymmetrical shape, which would smooth the volume reduction curve, allowing for increased time for heat transfer to occur at higher pressures. Alternative rotor shapes may be implemented for different curvatures or needs for increased volume in the compression chamber.

The rotor surface may be smooth in embodiments with contacting tip seals to minimize wear on the tip seal. In alternative embodiments, it may be advantageous to put surface texture on the rotor to create turbulence that may improve the performance of non-contacting seals. In other embodiments, the rotor casing's interior cylindrical wall may further be textured to produce additional turbulence, both for sealing and heat transfer benefits. This texturing could be achieved through machining of the parts or by utilizing a surface coating. Another method of achieving the texture would be through blasting with a waterjet, sandblast, or similar device to create an irregular surface.

The main casing 110 may further utilize a removable cylinder liner. This liner may feature microsurfacing to induce turbulence for the benefits noted above. The liner may also act as a wear surface to increase the reliability of the rotor and casing. The removable liner could be replaced at regular intervals as part of a recommended maintenance schedule. The rotor may also include a liner. Sacrifical or wear-in coatings may be used on the rotor 500 or rotor casing 400 to correct for manufacturing defects in ensuring the preferred gap is maintained along the sealing portion 510 of the rotor 500.

The exterior of the main casing 110 may also be modified to meet application specific parameters. For example, in subsea applications, the casing may require to be significantly thickened to withstand exterior pressure, or placed within a secondary pressure vessel. Other applications may benefit from the exterior of the casing having a rectangular or square profile to facilitate mounting exterior objects or stacking multiple compressors. Liquid may be circulated in the casing interior to achieve additional heat transfer or to equalize pressure in the case of subsea applications for example.

Figure 32A:
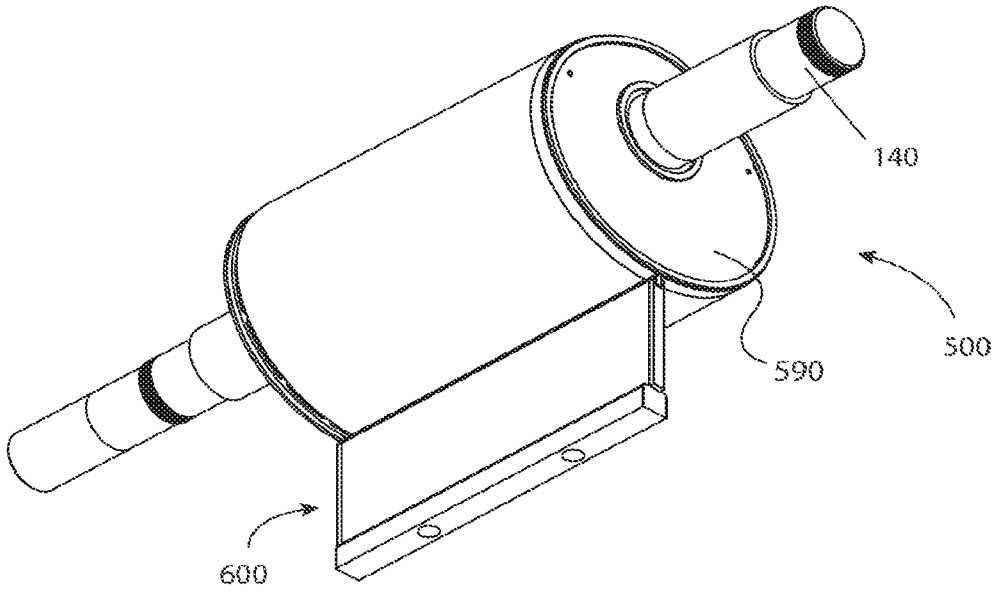
FIGS. 32A and B are perspective and right-side views of a drive shaft, rotor, and gate in accordance with an embodiment of the present invention.
Figure 32B:
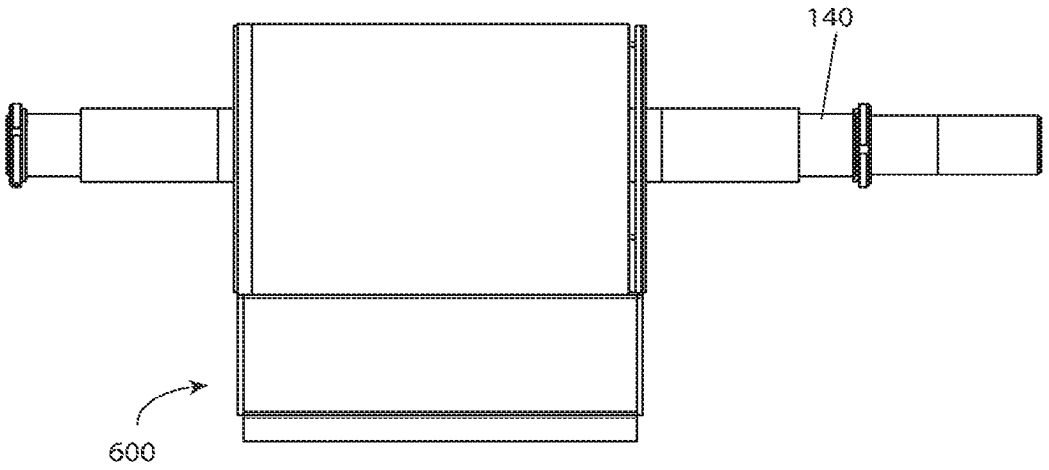
Figure 33:
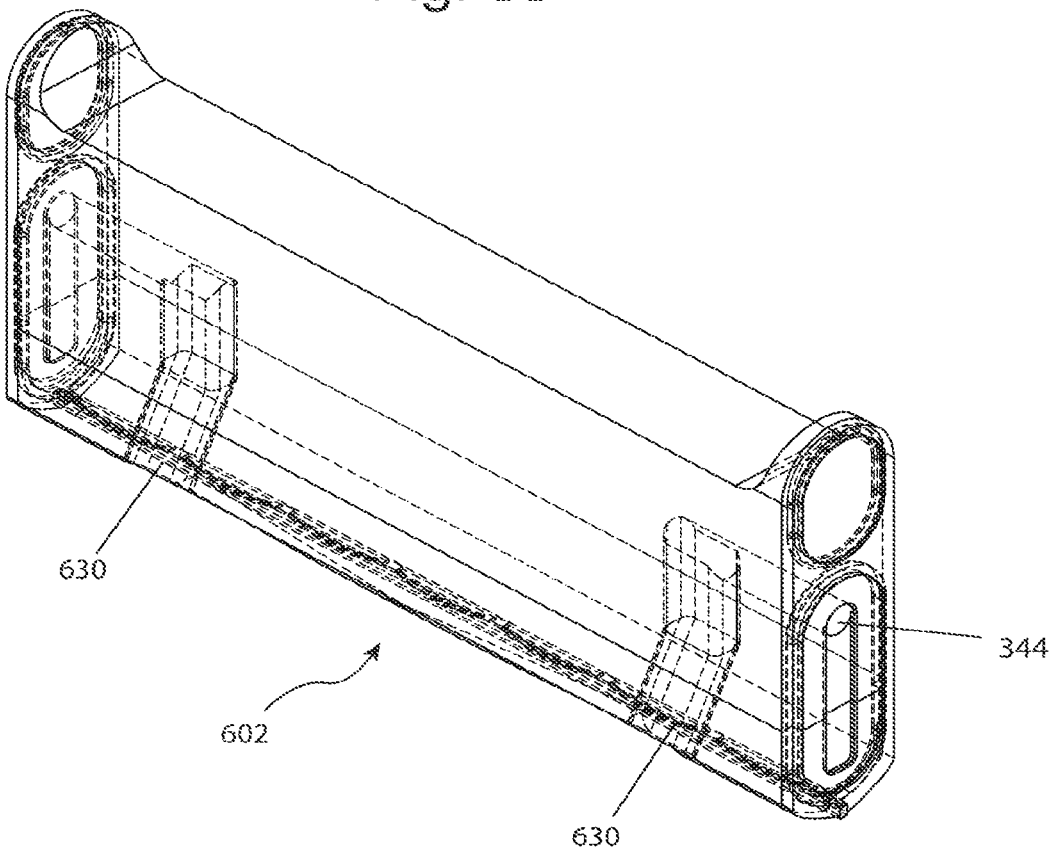
FIG. 33 is a perspective view of a gate with exhaust ports in accordance with an embodiment of the present invention.

As shown in FIGS. 32A and B, the combination of the rotor 500 (here depicted with rotor end caps 590), the gate 600, and drive shaft 140, provide for a more efficient manner of compressing fluids in a cylinder. The gate is aligned along the length of the rotor to separate and define the inlet portion and compression portion as the rotor turns.

The drive shaft 140 is mounted to endplates 120 in the preferred embodiment using one spherical roller bearing in each endplate 120. More than one bearing may be used in each endplate 120, in order to increase total load capacity. A grease pump (not shown) is used to provide lubrication to the bearings. Various types of other bearings may be utilized depending on application specific parameters, including roller bearings, ball bearings, needle bearings, conical bearings, cylindrical bearings, journal bearings, etc. Different lubrication systems using grease, oil, or other lubricants may also be used. Further, dry lubrication systems or materials may be used. Additionally, applications in which dynamic imbalance may occur may benefit from multi-bearing arrangements to support stray axial loads.

Operation of gates in accordance with embodiments of the present invention are shown in FIGS. 8, 17, 22, 24B, 26A-F, 27A-F, 28, 32A-B, and 33-36. As shown in FIGS. 26A-F and 27A-F, gate 600 creates a pressure boundary between an intake volume 412 and a compression volume 414. The intake volume 412 is in communication with the inlet 420. The compression volume 414 is in communication with the outlet 430. Resembling a reciprocating, rectangular piston, the gate 600 rises and falls in time with the turning of the rotor 500.

The gate 600 may include an optional tip seal 620 that makes contact with the rotor 500, providing an interface between the rotor 500 and the gate 600. Tip seal 620 consists of a strip of material at the tip of the gate 600 that rides against rotor 500. The tip seal 620 could be made of different materials, including polymers, graphite, and metal, and could take a variety of geometries, such as a curved, flat, or angled surface. The tip seal 620 may be backed by pressurized fluid or a spring force provided by springs or elastomers. This provides a return force to keep the tip seal 620 in sealing contact with the rotor 500.

Figure 35:
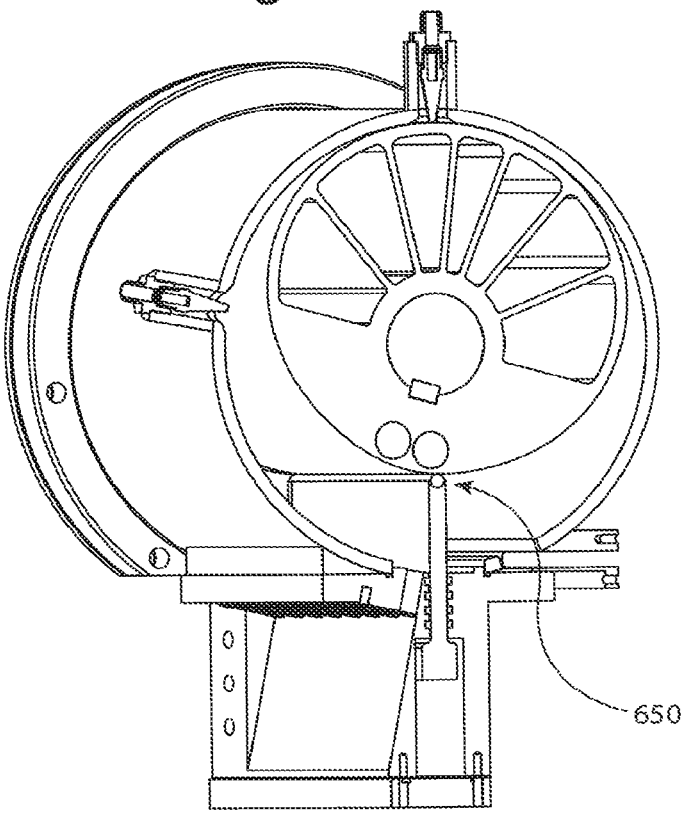
FIG. 35 is a cross-sectional, perspective view a gate with a rolling tip in accordance with an embodiment of the present invention.

Different types of contacting tips may be used with the gate 600. As shown in FIG. 35, a roller tip 650 may be used. The roller tip 650 rotates as it makes contact with the turning rotor 500. Also, tips of differing strengths may be used. For example, a tip seal 620 or roller tip 650 may be made of softer metal that would gradually wear down before the rotor 500 surfaces would wear.

Alternatively, a non-contacting seal may be used. Accordingly, the tip seal may be omitted. In these embodiments, the topmost portion of the gate 600 is placed proximate, but not necessarily in contact with, the rotor 500 as it turns. The amount of allowable gap may be adjusted depending on application parameters.

Figure 34A:
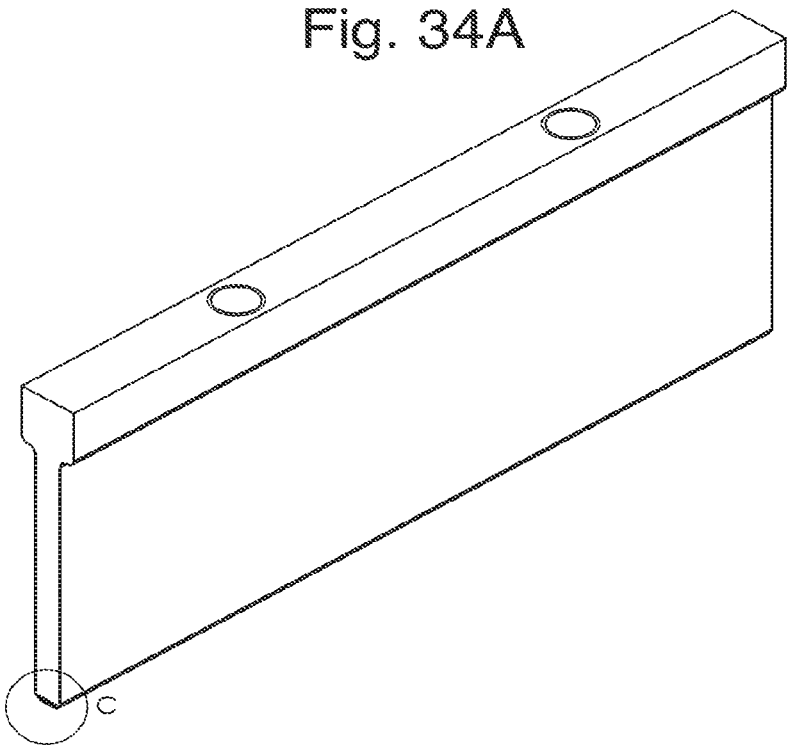
FIGS. 34A and B are a perspective view and magnified view of a gate with notches, respectively, in accordance with an embodiment of the present invention.
Figure 34B:
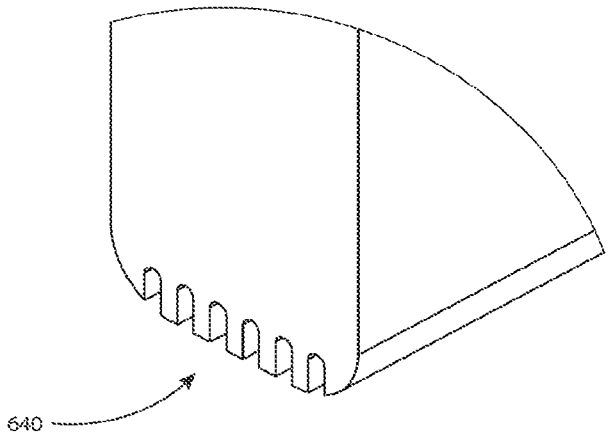

As shown in FIGS. 34A and 34B, in an embodiment in which the tip of the gate 600 does not contact the rotor 500, the tip may include notches 640 that serve to keep gas pocketed against the tip of the gate 600. The entrained fluid, in either gas or liquid form, assists in providing a non-contacting seal. As one of ordinary skill in the art would appreciate, the number and size of the notches is a matter of design choice dependent on the compressor specifications.

Figure 36:
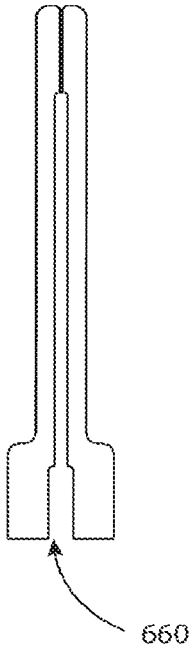
FIG. 36 is a cross-sectional front view of a gate with a liquid injection channel in accordance with an embodiment of the present invention.

Alternatively, liquid may be injected from the gate itself. As shown in FIG. 36, a cross-sectional view of a portion of a gate, one or more channels 660 from which a fluid may pass may be built into the gate. In one such embodiment, a liquid can pass through a plurality of channels 660 to form a liquid seal between the topmost portion of the gate 600 and the rotor 500 as it turns. In another embodiment, residual compressed fluid may be inserted through one or more channels 660. Further still, the gate 600 may be shaped to match the curvature of portions of the rotor 500 to minimize the gap between the gate 600 and the rotor 500.

Preferred embodiments enclose the gate in a gate casing. As shown in FIGS. 8 and 17, the gate 600 is encompassed by the gate casing 150, including notches, one of which is shown as item 158. The notches hold the gate seals, which ensure that the compressed fluid will not release from the compression volume 414 through the interface between gate 600 and gate casing 150 as gate 600 moves up and down. The gate seals may be made of various materials, including polymers, graphite or metal. A variety of different geometries may be used for these seals. Various embodiments could utilize different notch geometries, including ones in which the notches may pass through the gate casing, in part or in full.

In alternate embodiments, the seals could be placed on the gate 600 instead of within the gate casing 150. The seals would form a ring around the gate 600 and move with the gate relative to the casing 150, maintaining a seal against the interior of the gate casing 150. The location of the seals may be chosen such that the center of pressure on the gate 600 is located on the portion of the gate 600 inside of the gate casing 150, thus reducing or eliminating the effect of a cantilevered force on the portion of the gate 600 extending into the rotor casing 400. This may help eliminate a line contact between the gate 600 and gate casing 150 and instead provide a surface contact, allowing for reduced friction and wear. One or more wear plates may be used on the gate 600 to contact the gate casing 150. The location of the seals and wear plates may be optimized to ensure proper distribution of forces across the wear plates.

The seals may use energizing forces provided by springs or elastomers with the assembly of the gate casing 150 inducing compression on the seals. Pressurized fluid may also be used to energize the seals.

The gate 600 is shown with gate struts 210 connected to the end of the gate. In various embodiments, the gate 600 may be hollowed out such that the gate struts 210 can connect to the gate 600 closer to its tip. This may reduce the amount of thermal expansion encountered in the gate 600. A hollow gate also reduces the weight of the moving assembly and allows oil or other lubricants and coolants to be splashed into the interior of the gate to maintain a cooler temperature. The relative location of where the gate struts 210 connect to the gate 600 and where the gate seals are located may be optimized such that the deflection modes of the gate 600 and gate struts 210 are equal, allowing the gate 600 to remain parallel to the interior wall of the gate casing 150 when it deflects due to pressure, as opposed to rotating from the pressure force. Remaining parallel may help to distribute the load between the gate 600 and gate casing 150 to reduce friction and wear.

A rotor face seal may also be placed on the rotor 500 to provide for an interface between the rotor 500 and the endplates 120. An outer rotor face seal is placed along the exterior edge of the rotor 500, preventing fluid from escaping past the end of the rotor 500. A secondary inner rotor face seal is placed on the rotor face at a smaller radius to prevent any fluid that escapes past the outer rotor face seal from escaping the compressor entirely. This seal may use the same or other materials as the gate seal. Various geometries may be used to optimize the effectiveness of the seals. These seals may use energizing forces provided by springs, elastomers or pressurized fluid. Lubrication may be provided to these rotor face seals by injecting oil or other lubricant through ports in the endplates 120.

Along with the seals discussed herein, the surfaces those seals contact, known as counter-surfaces, may also be considered. In various embodiments, the surface finish of the counter-surface may be sufficiently smooth to minimize friction and wear between the surfaces. In other embodiments, the surface finish may be roughened or given a pattern such as cross-hatching to promote retention of lubricant or turbulence of leaking fluids. The counter-surface may be composed of a harder material than the seal to ensure the seal wears faster than the counter-surface, or the seal may be composed of a harder material than the counter-surface to ensure the counter-surface wears faster than the seal. The desired physical properties of the counter-surface (surface roughness, hardness, etc.) may be achieved through material selection, material finishing techniques such as quenching, tempering, or work hardening, or selection and application of coatings that achieve the desired characteristics. Final manufacturing processes, such as surface grinding, may be performed before or after coatings are applied. In various embodiments, the counter-surface material may be steel or stainless steel. The material may be hardened via quenching or tempering. A coating may be applied, which could be chrome, titanium nitride, silicon carbide, or other materials.

Minimizing the possibility of fluids leaking to the exterior of the main housing 100 is desirable. Various seals, such as gaskets and o-rings, are used to seal external connections between parts. For example, in a preferred embodiment, a double o-ring seal is used between the main casing 110 and endplates 120. Further seals are utilized around the drive shaft 140 to prevent leakage of any fluids making it past the rotor face seals. A lip seal is used to seal the drive shaft 140 where it passes through the endplates 120. In various embodiments, multiple seals may be used along the drive shaft 140 with small gaps between them to locate vent lines and hydraulic packings to reduce or eliminate gas leakage exterior to the compression chamber. Other forms of seals could also be used, such as mechanical or labyrinth seals.

It is desirable to achieve near isothermal compression. To provide cooling during the compression process, liquid injection is used. In preferred embodiments, the liquid is atomized to provide increased surface area for heat absorption. In other embodiments, different spray applications or other means of injecting liquids may be used.

Liquid injection is used to cool the fluid as it is compressed, increasing the efficiency of the compression process. Cooling allows most of the input energy to be used for compression rather than heat generation in the gas. The liquid has dramatically superior heat absorption characteristics compared to gas, allowing the liquid to absorb heat and minimize temperature increase of the working fluid, achieving near isothermal compression. As shown in FIGS. 8 and 17, liquid injector assemblies 130 are attached to the main casing 110. Liquid injector housings 132 include an adapter for the liquid source 134 (if it is not included with the nozzle) and a nozzle 136. Liquid is injected by way of a nozzle 136 directly into the rotor casing volume 410.

The amount and timing of liquid injection may be controlled by a variety of implements including a computer-based controller capable of measuring the liquid drainage rate, liquid levels in the chamber, and/or any rotational resistance due to liquid accumulation through a variety of sensors. Valves or solenoids may be used in conjunction with the nozzles to selectively control injection timing. Variable orifice control may also be used to regulate the amount of liquid injection and other characteristics.

Analytical and experimental results are used to optimize the number, location, and spray direction of the injectors 136. These injectors 136 may be located in the periphery of the cylinder. Liquid injection may also occur through the rotor or gate. The current embodiment of the design has two nozzles located at 12 o'clock and 10 o'clock. Different application parameters will also influence preferred nozzle arrays.

Because the heat capacity of liquids is typically much higher than gases, the heat is primarily absorbed by the liquid, keeping gas temperatures lower than they would be in the absence of such liquid injection.

When a fluid is compressed, the pressure times the volume raised to a polytropic exponent remains constant throughout the cycle, as seen in the following equation:

$$P*V^n=\text{Constant}$$

In polytropic compression, two special cases represent the opposing sides of the compression spectrum. On the high end, adiabatic compression is defined by a polytropic constant of n=1.4 for air, or n=1.28 for methane. Adiabatic compression is characterized by the complete absence of cooling of the working fluid (isentropic compression is a subset of adiabatic compression in which the process is reversible). This means that as the volume of the fluid is reduced, the pressure and temperature each rise accordingly. It is an inefficient process due to the exorbitant amount of energy wasted in the generation of heat in the fluid, which often needs to be cooled down again later. Despite being an inefficient process, most conventional compression technology, including reciprocating piston and centrifugal type compressors are essentially adiabatic. The other special case is isothermal compression, where n=1. It is an ideal compression cycle in which all heat generated in the fluid is transmitted to the environment, maintaining a constant temperature in the working fluid. Although it represents an unachievable perfect case, isothermal compression is useful in that it provides a lower limit to the amount of energy required to compress a fluid.

FIG. 37 shows a sample pressure-volume (P-V) curve comparing several different compression processes. The isothermal curve shows the theoretically ideal process. The adiabatic curve represents an adiabatic compression cycle, which is what most conventional compressor technologies follow. Since the area under the P-V curve represents the amount of work required for compression, approaching the isothermal curve means that less work is needed for compression. A model of one or more compressors according to various embodiments of the present invention is also shown, nearly achieving as good of results as the isothermal process. According to various embodiments, the above-discussed coolant injection facilitates the near isothermal compression through absorption of heat by the coolant. Not only does this near-isothermal compression process require less energy, at the end of the cycle gas temperatures are much lower than those encountered with traditional compressors. According to various embodiments, such a reduction in compressed working fluid temperature eliminates the use of or reduces the size of expensive and efficiency-robbing after-coolers.

Embodiments of the present invention achieve these near-isothermal results through the above-discussed injection of liquid coolant. Compression efficiency is improved according to one or more embodiments because the working fluid is cooled by injecting liquid directly into the chamber during the compression cycle. According to various embodiments, the liquid is injected directly into the area of the compression chamber where the gas is undergoing compression.

Rapid heat transfer between the working fluid and the coolant directly at the point of compression may facilitate high pressure ratios. That leads to several aspects of various embodiments of the present invention that may be modified to improve the heat transfer and raise the pressure ratio.

One consideration is the heat capacity of the liquid coolant. The basic heat transfer equation is as follows:

$$Q=mc_p\Delta T$$

where Q is the heat, m is mass, ΔT is change in temperature, and $c_p$ is the specific heat. The higher the specific heat of the coolant, the more heat transfer that will occur.

Choosing a coolant is sometimes more complicated than simply choosing a liquid with the highest heat capacity possible. Other factors, such as cost, availability, toxicity, compatibility with working fluid, and others can also be considered. In addition, other characteristics of the fluid, such as viscosity, density, and surface tension affect things like droplet formation which, as will be discussed below, also affect cooling performance.

According to various embodiments, water is used as the cooling liquid for air compression. For methane compression, various liquid hydrocarbons may be effective coolants, as well as triethylene glycol.

Another consideration is the relative velocity of coolant to the working fluid. Movement of the coolant relative to the working fluid at the location of compression of the working fluid (which is the point of heat generation) enhances heat transfer from the working fluid to the coolant. For example, injecting coolant at the inlet of a compressor such that the coolant is moving with the working fluid by the time compression occurs and heat is generated will cool less effectively than if the coolant is injected in a direction perpendicular to or counter to the flow of the working fluid adjacent the location of liquid coolant injection. FIGS. 38A-38D show a schematic of the sequential compression cycle in a compressor according to an embodiment of the invention. The dotted arrows in FIG. 38C show the injection locations, directions, and timing used according to various embodiments of the present invention to enhance the cooling performance of the system.

As shown in FIG. 38A, the compression stroke begins with a maximum working fluid volume (shown in gray) within the compression chamber. In the illustrated embodiment, the beginning of the compression stroke occurs when the rotor is at the 6 o'clock position (in an embodiment in which the gate is disposed at 6 o'clock with the inlet on the left of the gate and the outlet on the right of the gate as shown in FIGS. 38A-38D). In FIG. 38B, compression has started, the rotor is at the 9 o'clock position, and cooling liquid is injected into the compression chamber. In FIG. 38C, about 50% of the compression stroke has occurred, and the rotor is disposed at the 12 o'clock position. FIG. 38D illustrates a position (3 o'clock) in which the compression stroke is nearly completed (e.g., about 95% complete). Compression is ultimately completed when the rotor returns to the position shown in FIG. 38A.

As shown in FIGS. 38B and 38C, dotted arrows illustrate the timing, location, and direction of the coolant injection.

According to various embodiments, coolant injection occurs during only part of the compression cycle. For example, in each compression cycle/stroke, the coolant injection may begin at or after the first 10, 20, 30, 40, 50, 60 and/or 70% of the compression stroke/cycle (the stroke/cycle being measured in terms of volumetric compression). According to various embodiments, the coolant injection may end at each nozzle shortly before the rotor sweeps past the nozzle (e.g., resulting in sequential ending of the injection at each nozzle (clockwise as illustrated in FIG. 38)). According to various alternative embodiments, coolant injection occurs continuously throughout the compression cycle, regardless of the rotor position.

As shown in FIGS. 38B and 38C, the nozzles inject the liquid coolant into the chamber perpendicular to the sweeping direction of the rotor (i.e., toward the rotor's axis of rotation, in the inward radial direction relative to the rotor's axis of rotation). However, according to alternative embodiments, the direction of injection may be oriented so as to aim more upstream (e.g., at an acute angle relative to the radial direction such that the coolant is injected in a partially counter-flow direction relative to the sweeping direction of the rotor). According to various embodiments, the acute angle may be anywhere between 0 and 90 degrees toward the upstream direction relative to the radial line extending from the rotor's axis of rotation to the injector nozzle. Such an acute angle may further increase the velocity of the coolant relative to the surrounding working fluid, thereby further enhancing the heat transfer.

A further consideration is the location of the coolant injection, which is defined by the location at which the nozzles inject coolant into the compression chamber. As shown in FIGS. 38B and 38C, coolant injection nozzles are disposed at about 1, 2, 3, and 4 o'clock. However, additional and/or alternative locations may be chosen without deviating from the scope of the present invention. According to various embodiments, the location of injection is positioned within the compression volume (shown in gray in FIGS. 38A-38D) that exists during the compressor's highest rate of compression (in terms of Δvolume/time or Δvolume/degree-of-rotor-rotation, which may or may not coincide). In the embodiment illustrated in FIGS. 38A-38D, the highest rate of compression occurs around where the rotor is rotating from the 12 o'clock position shown in FIG. 38C to the 3 o'clock position shown in FIG. 38D. This location is dependent on the compression mechanism being employed and in various embodiments of the invention may vary. An injection location may also be selected at an earlier location in the compression chamber (e.g. 9 o'clock in FIGS. 38A-38D to minimize the pressure against which the liquid must be injected, thus reducing the power required for coolant injection. Additionally and/or alternatively, liquid (e.g., coolant) may be injected into the inlet port before the working fluid reaches the compression chamber.

As one skilled in the art could appreciate, the number and location of the nozzles may be selected based on a variety of factors. The number of nozzles may be as few as 1 or as many as 256 or more. According to various embodiments, the compressor includes (a) at least 1, 2, 3, 4, 5, 6, 7, 8, 9, 10, 15, 20, 30, 40, 50, 75, 100, 125, 150, 175, 200, 225, and/or 250 nozzles, (b) less than 400, 300, 275, 250, 225, 200, 175, 150, 125, 100, 75, 50, 40, 30, 20, 15, and/or 10 nozzles, (c) between 1 and 400 nozzles, and/or (d) any range of nozzles bounded by such numbers of any ranges therebetween. According to various embodiments, liquid coolant injection may be avoided altogether such that no nozzles are used. Along with varying the location along the angle of the rotor casing, a different number of nozzles may be installed at various locations along the length of the rotor casing. In certain embodiments, the same number of nozzles will be placed along the length of the casing at various angles. In other embodiments, nozzles may be scattered/staggered at different locations along the casing's length such that a nozzle at one angle may not have another nozzle at exactly the same location along the length at other angles. In various embodiments, a manifold may be used in which one or more nozzle is installed that connects directly to the rotor casing, simplifying the installation of multiple nozzles and the connection of liquid lines to those nozzles.

Coolant droplet size is a further consideration. Because the rate of heat transfer is linearly proportional to the surface area of liquid across which heat transfer can occur, the creation of smaller droplets via the above-discussed atomizing nozzles improves cooling by increasing the liquid surface area and allowing heat transfer to occur more quickly. Reducing the diameter of droplets of coolant in half (for a given mass) increases the surface area by a factor of two and thus improves the rate of heat transfer by a factor of 2. In addition, for small droplets the rate of convection typically far exceeds the rate of conduction, effectively creating a constant temperature across the droplet and removing any temperature gradients. This may result in the full mass of liquid being used to cool the gas, as opposed to larger droplets where some mass at the center of the droplet may not contribute to the cooling effect. Based on that evidence, it appears advantageous to inject as small of droplets as possible. However, droplets that are too small, when injected into the high density, high turbulence region as shown in FIGS. 38B and 38C, run the risk of being swept up by the working fluid and not continuing to move through the working fluid and maintain high relative velocity. Small droplets may also evaporate and lead to deposition of solids on the compressor's interior surfaces. Other extraneous factors also affect droplet size decisions, such as power losses of the coolant being forced through the nozzle and amount of liquid that the compressor can handle internally.

According to various embodiments, average droplet sizes of between 50 and 500 microns, between 50 and 300 microns, between 100 and 150 microns, and/or any ranges within those ranges, may be fairly effective.

The mass of the coolant liquid is a further consideration. As evidenced by the heat equation shown above, more mass (which is proportional to volume) of coolant will result in more heat transfer. However, the mass of coolant injected may be balanced against the amount of liquid that the compressor can accommodate, as well as extraneous power losses required to handle the higher mass of coolant. According to various embodiments, between 1 and 100 gallons per minute (gpm), between 3 and 40 gpm, between 5 and 25 gpm, between 7 and 10 gpm, and/or any ranges therebetween may provide an effective mass flow rate (averaged throughout the compression stroke despite the non-continuous injection according to various embodiments). According to various embodiments, the volumetric flow rate of liquid coolant into the compression chamber may be at least 1, 2, 3, 4, 5, 6, 7, 8, 9, and/or 10 gpm. According to various embodiments, flow rate of liquid coolant into the compression chamber may be less than 100, 80, 60, 50, 40, 30, 25, 20, 15, and/or 10 gpm.

The nozzle array may be designed for a high flow rate of greater than 1, 2, 3, 4, 5, 6, 7, 8, 9, 10, and/or 15 gallons per minute and be capable of extremely small droplet sizes of less than 500 and/or 150 microns or less at a low differential pressure of less than 400, 300, 200, and/or 100 psi. Two exemplary nozzles are Spraying Systems Co. Part Number: 1/4HHSJ-SS12007 and Bex Spray Nozzles Part Number: 1/4YS12007. Other non-limiting nozzles that may be suitable for use in various embodiments include Spraying Systems Co. Part Number 1/4LN-SS14 and 1/4LN-SS8. The preferred flow rate and droplet size ranges will vary with application parameters. Alternative nozzle styles may also be used. For example, one embodiment may use micro-perforations in the cylinder through which to inject liquid, counting on the small size of the holes to create sufficiently small droplets. Other embodiments may include various off the shelf or custom designed nozzles which, when combined into an array, meet the injection requirements necessary for a given application.

According to various embodiments, one, several, and/or all of the above-discussed considerations, and/or additional/alternative external considerations may be balanced to optimize the compressor's performance. Although particular examples are provided, different compressor designs and applications may result in different values being selected.

According to various embodiments, the coolant injection timing, location, and/or direction, and/or other factors, and/or the higher efficiency of the compressor facilitates higher pressure ratios. As used herein, the pressure ratio is defined by a ratio of (1) the absolute inlet pressure of the source working fluid coming into the compression chamber (upstream pressure) to (2) the absolute outlet pressure of the compressed working fluid being expelled from the compression chamber (downstream pressure downstream from the outlet valve). As a result, the pressure ratio of the compressor is a function of the downstream vessel (pipeline, tank, etc.) into which the working fluid is being expelled. Compressors according to various embodiments of the present invention would have a 1:1 pressure ratio if the working fluid is being taken from and expelled into the ambient environment (e.g., 14.7 psia/14.7 psia). Similarly, the pressure ratio would be about 26:1 (385 psia/14.7 psia) according to various embodiments of the invention if the working fluid is taken from ambient (14.7 psia upstream pressure) and expelled into a vessel at 385 psia (downstream pressure).

According to various embodiments, the compressor has a pressure ratio of (1) at least 3:1, 4:1, 5:1, 6:1, 8:1, 10:1, 15:1, 20:1, 25:1, 30:1, 35:1, and/or 40:1 or higher, (2) less than or equal to 200:1, 150:1, 125:1, 100:1, 90:1, 80:1, 70:1, 60:1, 50:1, 45:1, 40:1, 35:1, and/or 30:1, and (3) any and all combinations of such upper and lower ratios (e.g., between 10:1 and 200:1, between 15:1 and 100:1, between 15:1 and 80:1, between 15:1 and 50:1, etc.).

According to various embodiments, lower pressure ratios (e.g., between 3:1 and 15:1) may be used for working fluids with higher liquid content (e.g., with a liquid volume fraction at the compressor's inlet port of at least 0.5, 1, 2, 3, 4, 5, 6, 7, 8, 9, 10, 15, 20, 25, 30, 35, 40, 50, 60, 70, 75, 80, 85, 90, 91, 92, 93, 94, 95, 96, 97, 98, and/or 99%). Conversely, according to various embodiments, higher pressure ratios (e.g., above 15:1) may be used for working fluids with lower liquid content relative to gas content. However, wetter gases may nonetheless be compressed at higher pressure ratios and drier gases may be compressed at lower pressure ratios without deviating from the scope of various embodiments of the present invention.

Various embodiments of the invention are suitable for alternative operation using a variety of different operational parameters. For example, a single compressor according to one or more embodiments may be suitable to efficiently compress working fluids having drastically different liquid volume fractions and at different pressure ratios. For example, a compressor according to one or more embodiments is suitable for alternatively (1) compressing a working fluid with a liquid volume fraction of between 10 and 50 percent at a pressure ratio of between 3:1 and 15:1, and (2) compressing a working fluid with a liquid volume fraction of less than 10 percent at a pressure ratio of at least 15:1, 20:1, 30:1, and/or 40:1.

According to various embodiments, the compressor efficiently and cost-effectively compresses both wet and dry gas using a high pressure ratio.

According to various embodiments, the compressor is capable of and runs at commercially viable speeds (e.g., between 450 and 1800 rpm). According to various embodiments, the compressor runs at a speed of (a) at least 350, 400, 450, 500, 550, 600, and/or 650 rpm, (b) less than or equal to 3000, 2500, 2000, 1800, 1700, 1600, 1500, 1400, 1300, 1200, 1100, 1050, 1000, 950, 900, 850, and/or 800 rpm, and/or (c) between 350 and 300 rpm, 450-1800 rpm, and/or any ranges within these non-limiting upper and lower limits. According to various embodiments, the compressor is continuously operated at one or more of these speeds for at least 0.5, 1, 5, 10, 15, 20, 30, 60, 90, 100, 150, 200, 250 300, 350, 400, 450, and/or 500 minutes and/or at least 10, 20, 24, 48, 72, 100, 200, 300, 400, and/or 500 hours.

According to various embodiments, the outlet pressure of the compressed fluid is (1) at least 200, 225, 250, 275, 300, 325, 350, 375, 400, 425, 450, 475, 500, 600, 700, 800, 900, 1000, 1250, 1500, 2000, 3000, 4000, and/or 5000 psig, (2) less than 6000, 5500, 5000, 4000, 3000, 2500, 2250, 2000, 1750, 1500, 1250, 1100, 1000, 900, 800, 700, 600 and/or 500 psig, (3) between 200 and 6000 psig, between 200 and 5000 psig, and/or (4) within any range between the upper and lower pressures described above.

According to various embodiments, the inlet pressure is ambient pressure in the environment surrounding the compressor (e.g., 1 atm, 14.7 psia). Alternatively, the inlet pressure could be close to a vacuum (near 0 psia), or anywhere therebetween. According to alternative embodiments, the inlet pressure may be (1) at least −14.5, −10, −5, 0, 5, 10, 25, 50, 100, 150, 200, 250, 300, 350, 400, 450, 500, 550, 600, 700, 800, 900, 1000, 1100, 1200, 1300, 1400, and/or 1500 psig, (2) less than or equal to 3000, 2000, 1900, 1800, 1700, 1600, 1500, 1400, 1300, 1200, 1100, 1000, 900, 800, 700, 600, 500, 400, and/or 350, and/or (3) between −14.5 and 3000 psig, between 0 and 1500 psig, and/or within any range bounded by any combination of the upper and lower numbers and/or any nested range within such ranges.

According to various embodiments, the outlet temperature of the working fluid when the working fluid is expelled from the compression chamber exceeds the inlet temperature of the working fluid when the working fluid enters the compression chamber by (a) less than 700, 650, 600, 550, 500, 450, 400, 375 350, 325, 300, 275, 250, 225, 200, 175, 150, 140, 130, 120, 110, 100, 90, 80, 70, 60, 50, 40, 30, and/or 20 degrees C., (b) at least −10, 0, 10, and/or 20 degrees C., and/or (c) any combination of ranges between any two of these upper and lower numbers, including any range within such ranges.

According to various embodiments, the outlet temperature of the working fluid is (a) less than 700, 650, 600, 550, 500, 450, 400, 375, 350, 325, 300, 275, 250, 225, 200, 175, 150, 140, 130, 120, 110, 100, 90, 80, 70, 60, 50, 40, 30, and/or 20 degrees C., (b) at least −10, 0, 10, 20, 30, 40, and/or 50 degrees C., and/or (c) any combination of ranges between any two of these upper and lower numbers, including any range within such ranges.

The outlet temperature and/or temperature increase may be a function of the working fluid. For example, the outlet temperature and temperature increase may be lower for some working fluids (e.g., methane) than for other working fluids (e.g., air).

According to various embodiments, the temperature increase is correlated to the pressure ratio. According to various embodiments, the temperature increase is less than 200 degrees C. for a pressure ratio of 20:1 or less (or between 15:1 and 20:1), and the temperature increase is less than 300 degrees C. for a pressure ratio of between 20:1 and 30:1.

According to various embodiments, the pressure ratio is between 3:1 and 15:1 for a working fluid with an inlet liquid volume fraction of over 5%, and the pressure ratio is between 15:1 and 40:1 for a working fluid with an inlet liquid volume fraction of between 1 and 20%. According to various embodiments, the pressure ratio is above 15:1 while the outlet pressure is above 250 psig, while the temperature increase is less than 200 degrees C. According to various embodiments, the pressure ratio is above 25:1 while the outlet pressure is above 250 psig and the temperature increase is less than 300 degrees C. According to various embodiments, the pressure ratio is above 15:1 while the outlet pressure is above 250 psig and the compressor speed is over 450 rpm.

According to various embodiments, any combination of the different ranges of different parameters discussed herein (e.g., pressure ratio, inlet temperature, outlet temperature, temperature change, inlet pressure, outlet pressure, pressure change, compressor speed, coolant injection rate, etc.) may be combined according to various embodiments of the invention. According to one or more embodiments, the pressure ratio is anywhere between 3:1 and 200:1 while the operating compressor speed is anywhere between 350 and 3000 rpm while the outlet pressure is between 200 and 6000 psig while the inlet pressure is between 0 and 3000 psig while the outlet temperature is between −10 and 650 degrees C. while the outlet temperature exceeds the inlet temperature by between 0 and 650 degrees C. while the liquid volume fraction of the working fluid at the compressor inlet is between 1% and 50%.

According to one or more embodiments, air is compressed from ambient pressure (14.7 psia) to 385 psia, a pressure ratio of 26:1, at speeds of 700 rpm with outlet temperatures remaining below 100 degrees C. Similar compression in an adiabatic environment would reach temperatures of nearly 480 degrees C.

The operating speed of the illustrated compressor is stated in terms of rpm because the illustrated compressor is a rotary compressor. However, other types of compressors may be used in alternative embodiments of the invention. As those familiar in the art appreciate, the RPM term also applies to other types of compressors, including piston compressors whose strokes are linked to RPM via their crankshaft.

Numerous cooling liquids may be used. For example, water, triethylene glycol, and various types of oils and other hydrocarbons may be used. Ethylene glycol, propylene glycol, methanol or other alcohols in case phase change characteristics are desired may be used. Refrigerants such as ammonia and others may also be used. Further, various additives may be combined with the cooling liquid to achieve desired characteristics. Along with the heat transfer and heat absorption properties of the liquid helping to cool the compression process, vaporization of the liquid may also be utilized in some embodiments of the design to take advantage of the large cooling effect due to phase change.

The effect of liquid coalescence is also addressed in the preferred embodiments. Liquid accumulation can provide resistance against the compressing mechanism, eventually resulting in hydrolock in which all motion of the compressor is stopped, causing potentially irreparable harm. As is shown in the embodiments of FIGS. 8 and 17, the inlet 420 and outlet 430 are located at the bottom of the rotor casing 400 on opposite sides of the gate 600, thus providing an efficient location for both intake of fluid to be compressed and exhausting of compressed fluid and the injected liquid. A valve is not necessary at the inlet 420. The inclusion of a dwell seal allows the inlet 420 to be an open port, simplifying the system and reducing inefficiencies associated with inlet valves. However, if desirable, an inlet valve could also be incorporated. Additional features may be added at the inlet to induce turbulence to provide enhanced thermal transfer and other benefits. Hardened materials may be used at the inlet and other locations of the compressor to protect against cavitation when liquid/gas mixtures enter into choke and other cavitation-inducing conditions.

Alternative embodiments may include an inlet located at positions other than shown in the figures. Additionally, multiple inlets may be located along the periphery of the cylinder. These could be utilized in isolation or combination to accommodate inlet streams of varying pressures and flow rates. The inlet ports can also be enlarged or moved, either automatically or manually, to vary the displacement of the compressor.

In these embodiments, multi-phase compression is utilized, thus the outlet system allows for the passage of both gas and liquid. Placement of outlet 430 near the bottom of the rotor casing 400 provides for a drain for the liquid. This minimizes the risk of hydrolock found in other liquid injection compressors. A small clearance volume allows any liquids that remain within the chamber to be accommodated. Gravity assists in collecting and eliminating the excess liquid, preventing liquid accumulation over subsequent cycles. Additionally, the sweeping motion of the rotor helps to ensure that most liquid is removed from the compressor during each compression cycle by guiding the liquid toward the outlet(s) and out of the compression chamber.

Compressed gas and liquid can be separated downstream from the compressor. As discussed below, liquid coolant can then be cooled and recirculated through the compressor.

Various of these features enable compressors according to various embodiments to effectively compress multi-phase fluids (e.g., a fluid that includes gas and liquid components (sometimes referred to as "wet gas")) without pre-compression separation of the gas and liquid phase components of the working fluid. As used herein, multi-phase fluids have liquid volume fractions at the compressor inlet port of (a) at least 0.5, 1, 2, 3, 4, 5, 6, 7, 8, 9, 10, 15, 20, 25, 30, 35, 40, 50, 60, 70, 75, 80, 85, 90, 91, 92, 93, 94, 95, 96, 97, 98, 99, and/or 99.5%, (b) less than or equal to 99.5, 99, 98, 97, 96, 95, 94, 93, 92, 91, 90, 85, 80, 75, 70, 60, 50, 40, 35, 30, 25, 20, 15, 10, 9, 8, 7, 6, 5, 4, 3, 2, 1, and/or 0.5%, (c) between 0.5 and 99.5%, and/or (d) within any range bounded by these upper and lower values.

Outlet valves allow gas and liquid (i.e., from the wet gas and/or liquid coolant) to flow out of the compressor once the desired pressure within the compression chamber is reached. The outlet valves may increase or maximize the effective orifice area. Due to the presence of liquid in the working fluid, valves that minimize or eliminate changes in direction for the outflowing working fluid are desirable, but not required. This prevents the hammering effect of liquids as they change direction. Additionally, it is desirable to minimize clearance volume. Unused valve openings may be plugged in some applications to further minimize clearance volume. According to various embodiments, these features improve the wet gas capabilities of the compressor as well as the compressor's ability to utilize in-chamber liquid coolant.

Reed valves may be desirable as outlet valves. As one of ordinary skill in the art would appreciate, other types of valves known or as yet unknown may be utilized. Hoerbiger type R, CO, and Reed valves may be acceptable. Additionally, CT, HDS, CE, CM or Poppet valves may be considered. Other embodiments may use valves in other locations in the casing that allow gas to exit once the gas has reached a given pressure. In such embodiments, various styles of valves may be used. Passive or directly-actuated valves may be used and valve controllers may also be implemented.

In the presently preferred embodiments, the outlet valves are located near the bottom of the casing and serve to allow exhausting of liquid and compressed gas from the high pressure portion. In other embodiments, it may be useful to provide additional outlet valves located along periphery of main casing in locations other than near the bottom. Some embodiments may also benefit from outlets placed on the endplates. In still other embodiments, it may be desirable to separate the outlet valves into two types of valves—one predominately for high pressured gas, the other for liquid drainage. In these embodiments, the two or more types of valves may be located near each other, or in different locations.

The coolant liquid can be removed from the gas stream, cooled, and recirculated back into the compressor in a closed loop system. By placing the injector nozzles at locations in the compression chamber that do not see the full pressure of the system, the recirculation system may omit an additional pump (and subsequent efficiency loss) to deliver the atomized droplets. However, according to alternative embodiments, a pump is utilized to recirculate the liquid back into the compression chamber via the injector nozzles. Moreover, the injector nozzles may be disposed at locations in the compression chamber that see the full pressure of the system without deviating from the scope of various embodiments of the present invention.

According to various embodiments, some compressed working fluid/gas (e.g., natural gas) that has been compressed by the compressor is recirculated back into the compression chamber via the injector nozzles along with coolant to better atomize the coolant (e.g., similar or identical to how snow-making equipment combines a liquid water stream with a compressed gas stream to achieve increase atomization of the water).

One or more embodiments simplify heat recovery because most or all of the heat load is in the cooling liquid. According to various embodiments, heat is not removed from the compressed gas downstream of the compressor. The cooling liquid may cooled via an active cooling process (e.g., refrigeration and heat exchangers) downstream from the compressor. However, according to various embodiments, heat may additionally be recovered from the compressed gas (e.g., via heat exchangers) without deviating from the scope of various embodiments of the present invention.

As shown in FIGS. 8 and 17, the sealing portion 510 of the rotor effectively precludes fluid communication between the outlet and inlet ports by way of the creation of a dwell seal. The interface between the rotor 500 and gate 600 further precludes fluid communication between the outlet and inlet ports through use of a non-contacting seal or tip seal 620. In this way, the compressor is able to prevent any return and venting of fluid even when running at low speeds. Existing rotary compressors, when running at low speeds, have a leakage path from the outlet to the inlet and thus depend on the speed of rotation to minimize venting/leakage losses through this flow path.

The high pressure working fluid exerts a large horizontal force on the gate 600. Despite the rigidity of the gate struts 210, this force will cause the gate 600 to bend and press against the inlet side of the gate casing 152. Specialized coatings that are very hard and have low coefficients of friction can coat both surfaces to minimize friction and wear from the sliding of the gate 600 against the gate casing 152. A fluid bearing can also be utilized. Alternatively, pegs (not shown) can extend from the side of the gate 600 into gate casing 150 to help support the gate 600 against this horizontal force. Material may also be removed from the non-pressure side of gate 600 in a non-symmetrical manner to allow more space for the gate 600 to bend before interfering with the gate casing 150.

The large horizontal forces encountered by the gate may also require additional considerations to reduce sliding friction of the gate's reciprocating motion. Various types of lubricants, such as greases or oils may be used. These lubricants may further be pressurized to help resist the force pressing the gate against the gate casing. Components may also provide a passive source of lubrication for sliding parts via lubricant-impregnated or self-lubricating materials. In the absence of, or in conjunction with, lubrication, replaceable wear elements may be used on sliding parts to ensure reliable operation contingent on adherence to maintenance schedules. These wear elements may also be used to precisely position the gate within the gate casing. As one of ordinary skill in the art would appreciate, replaceable wear elements may also be utilized on various other wear surfaces within the compressor.

The compressor structure may be comprised of materials such as aluminum, carbon steel, stainless steel, titanium, tungsten, or brass. Materials may be chosen based on corrosion resistance, strength, density, and cost. Seals may be comprised of polymers, such as PTFE, HDPE, PEEK™, acetal copolymer, etc., graphite, cast iron, carbon steel, stainless steel, or ceramics. Other materials known or unknown may be utilized. Coatings may also be used to enhance material properties.

As one of ordinary skill in the art can appreciate, various techniques may be utilized to manufacture and assemble embodiments of the invention that may affect specific features of the design. For example, the main casing 110 may be manufactured using a casting process. In this scenario, the nozzle housings 132, gate casing 150, or other components may be formed in singularity with the main casing 110. Similarly, the rotor 500 and drive shaft 140 may be built as a single piece, either due to strength requirements or chosen manufacturing technique.

Further benefits may be achieved by utilizing elements exterior to the compressor envelope. A flywheel may be added to the drive shaft 140 to smooth the torque curve encountered during the rotation. A flywheel or other exterior shaft attachment may also be used to help achieve balanced rotation. Applications requiring multiple compressors may combine multiple compressors on a single drive shaft with rotors mounted out of phase to also achieve a smoothened torque curve. A bell housing or other shaft coupling may be used to attach the drive shaft to a driving force such as engine or electric motor to minimize effects of misalignment and increase torque transfer efficiency. Accessory components such as pumps or generators may be driven by the drive shaft using belts, direct couplings, gears, or other transmission mechanisms. Timing gears or belts may further be utilized to synchronize accessory components where appropriate.

After exiting the valves the mix of liquid and gases may be separated through any of the following methods or a combination thereof: 1. Interception through the use of a mesh, vanes, intertwined fibers; 2. Inertial impaction against a surface; 3. Coalescence against other larger injected droplets; 4. Passing through a liquid curtain; 5. Bubbling through a liquid reservoir; 6. Brownian motion to aid in coalescence; 7. Change in direction; 8. Centrifugal motion for coalescence into walls and other structures; 9. Inertia change by rapid deceleration; and 10. Dehydration through the use of adsorbents or absorbents.

At the outlet of the compressor, a pulsation chamber may consist of cylindrical bottles or other cavities and elements, may be combined with any of the aforementioned separation methods to achieve pulsation dampening and attenuation as well as primary or final liquid coalescence. Other methods of separating the liquid and gases may be used as well.

FIGS. 39-44 illustrate a compressor 1000 according to an alternative embodiment. The compressor 1000 is generally similar to the above-discussed compressors. Accordingly, a redundant description of similar or identical components is omitted. The compressor 1000 includes a main casing 1010 that defines a compression chamber 1020, a drive shaft 1030, a rotor 1040, cams 1050, cam followers 1060, a gate support 1070 (e.g., cam follower supports, cam struts, gate support arm, gate strut, etc.) connected to the cam followers 1060, a gate support guide 1075 mounted to the casing 1010 (or integrally formed with the casing 1010) and connected to the gate support 1070 to permit reciprocal linear movement of the gate support 1070, springs 1080 that bias the gate support 1070 toward the cams 1050, a gate housing 1100 that is partially formed by and/or mounted to the main casing 1010 and/or the gate support guide 1075, a gate 1110 slidingly supported by the gate housing 1100, an inlet manifold 1140 fluidly connected to an inlet 1150 into the compression chamber 1020, a discharge/outlet manifold 1160 fluidly connected to a discharge outlet 1170 that leads from the compression chamber 1020, a discharge outlet valve 1180 disposed in the discharge outlet 1170, coolant injectors 1190, a hydrostatic bearing arrangement 1300 (see FIGS. 48-51) between the casing 1010 and gate 1110, and a mechanical/hydraulic seal 1500 that seals the compression chamber 1020 from the ambient environment around the drive shaft 1030.

In the illustrated embodiment, the coolant injectors 1190 direct coolant directly into the compression chamber 1020. However, according to one or more alternative embodiments, coolant injector(s) 1190 may additionally and/or alternatively inject coolant into the working fluid in the inlet manifold 1140 before the working fluid or coolant reach the compression chamber. Such an alternative may reduce manufacturing costs and/or reduce the amount of power required to inject the coolant.

Figure 41:
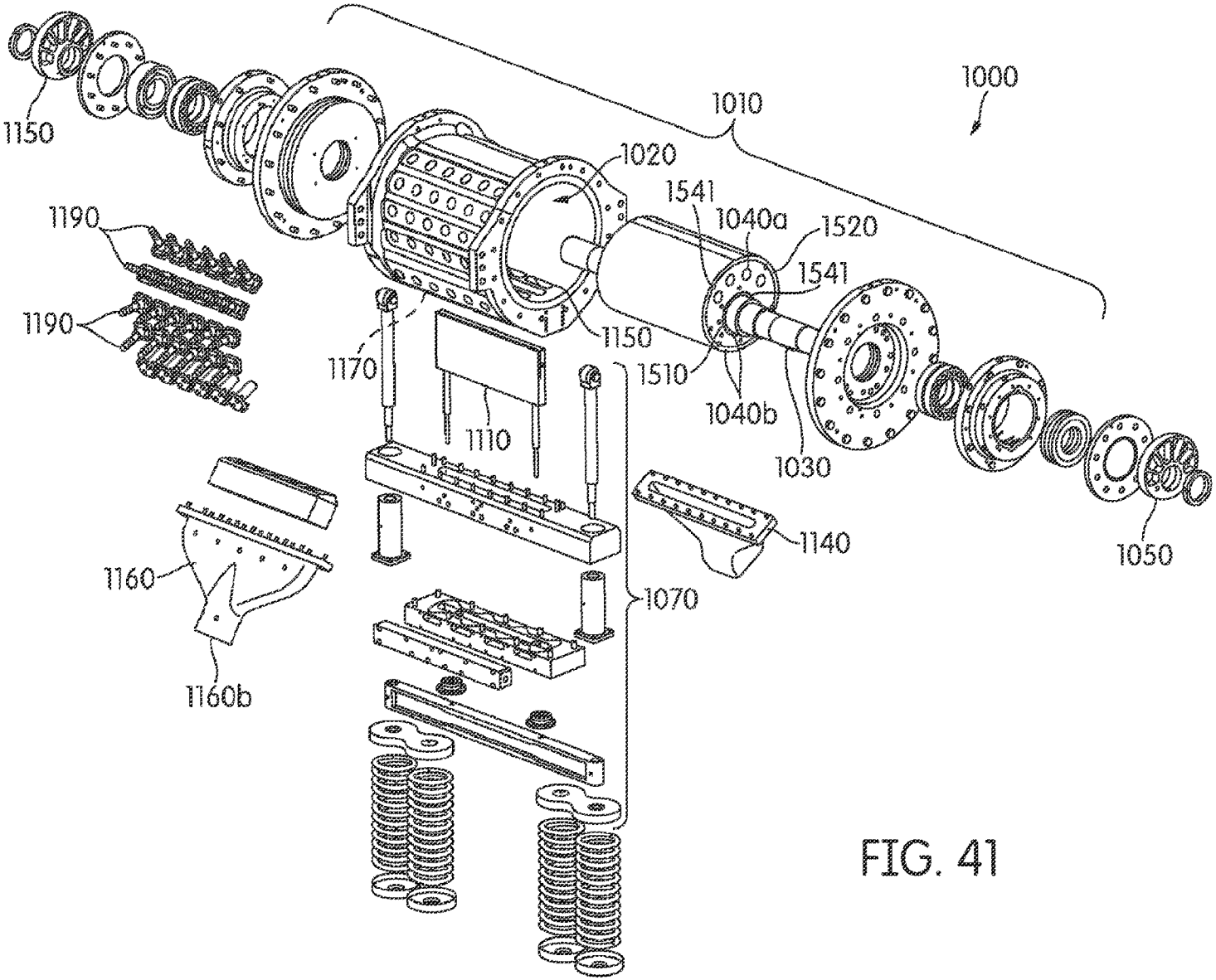
FIG. 41 is an exploded view of the compressor in FIG. 39.
Figure 44:
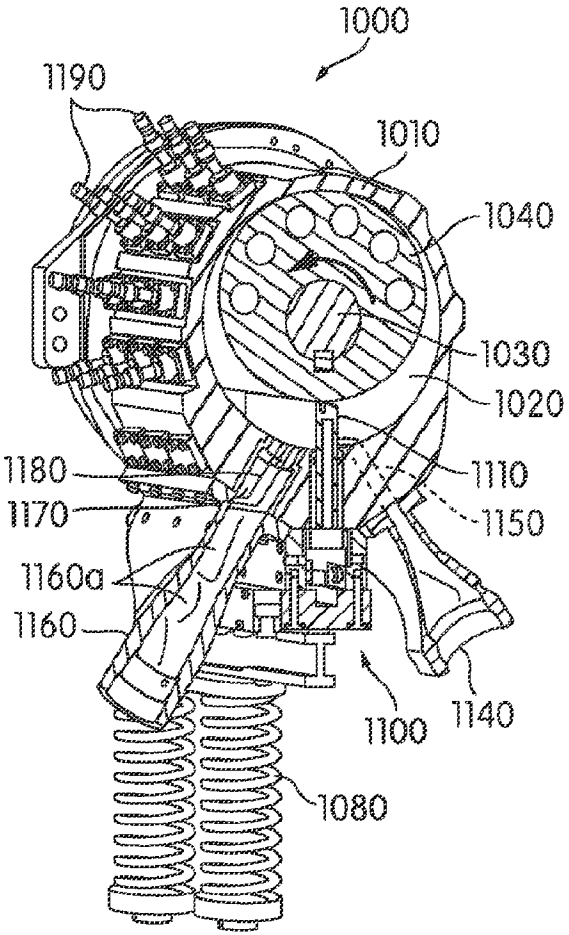
FIG. 44 is a perspective view of the view in FIG. 43 of the compressor in FIG. 39.
Figure 43:
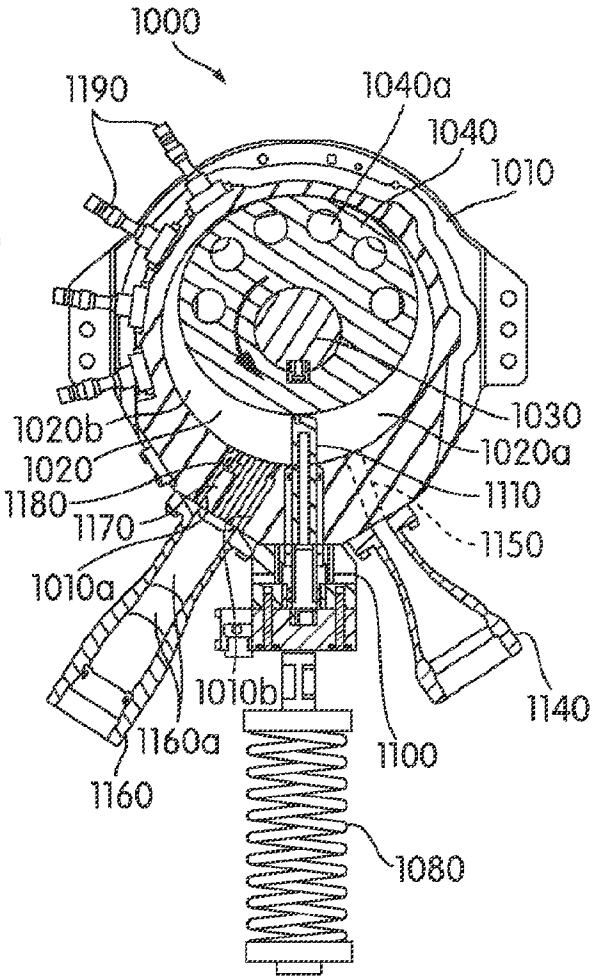
FIG. 43 is a cross-sectional view of the compressor in FIG. 39, taken in a plane that is perpendicular to a drive shaft of the compressor
Figure 42:
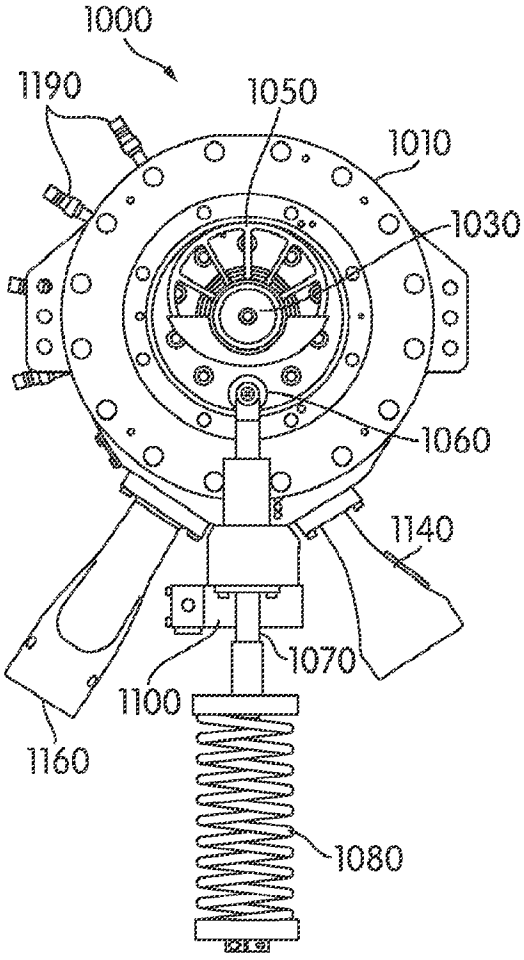
FIG. 42 is an end view of the compressor in FIG. 39.

As shown in FIGS. 41, 43, and 44, the discharge outlet valve 1180 directs compressed fluid through the discharge outlet 1170 while discouraging backflow of compressed fluid back into the compression chamber 1020. As shown in FIG. 41, the valve 1180 is separately formed from the main casing 1010 and is fitted into the discharge outlet 1170. However, according to various alternative embodiments, the valve 1180 or parts thereof may be integrally formed with the casing 1010.

Figure 46:
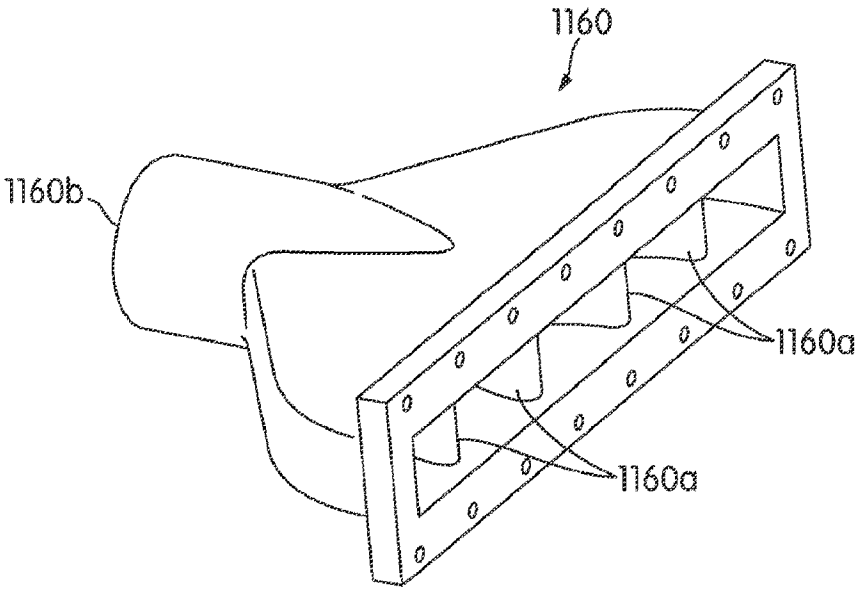
FIG. 46 is perspective view of the discharge manifold in FIG. 45.
Figure 45:
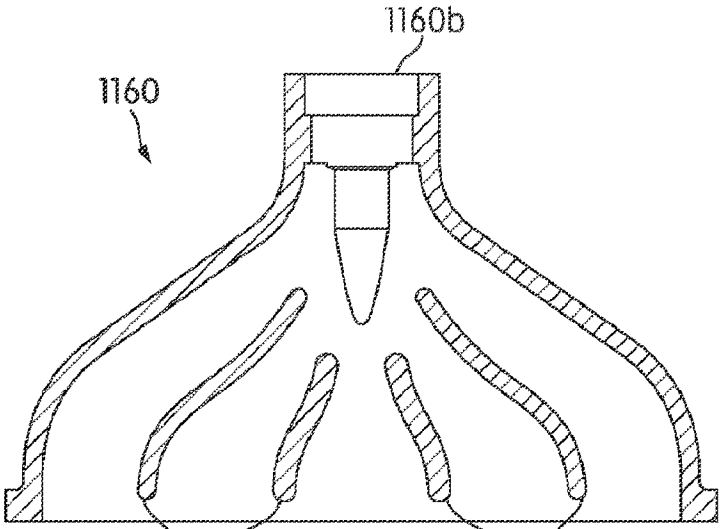
FIG. 45 is cross-sectional view of a discharge manifold of the compressor in FIG. 39.

As shown in FIGS. 45-46, the discharge manifold 1160 includes a plurality of vanes 1160*a*. A cross-section of a passageway within the manifold 1160 from the discharge outlet 1170 (i.e., entrance into the manifold 1160) to a circular discharge manifold outlet 1160*b* (i.e., a downstream exit of the manifold 1160) transitions from an axially-elongated cross-section at the discharge outlet 1170 (e.g., elongated along the length of the gate 1110 in a direction parallel to the rotational axis of the drive shaft 1030) to the circular discharge manifold outlet 1160*b*. According to various embodiments, the cross-sectional area remains relatively constant throughout this discharge flow path. The vanes 1160*a* are oriented generally perpendicular to the desired flow path of the compressed fluid from the compression chamber 1020 to a discharge manifold outlet 1160*b* of the discharge manifold 1160. The vanes 1160*a* are oriented to promote a generally laminar flow of the compressed fluid as the cross-sectional shape of the flow path changes. According to various embodiments, the vanes 1160*a* reduce turbulence, increase the efficiency of the compressor 1000, and/or reduce wear as the compressed fluid (e.g., multiphase liquid/gas fluid) flows though the outlet 1170 and manifold 1160.

Figure 47:
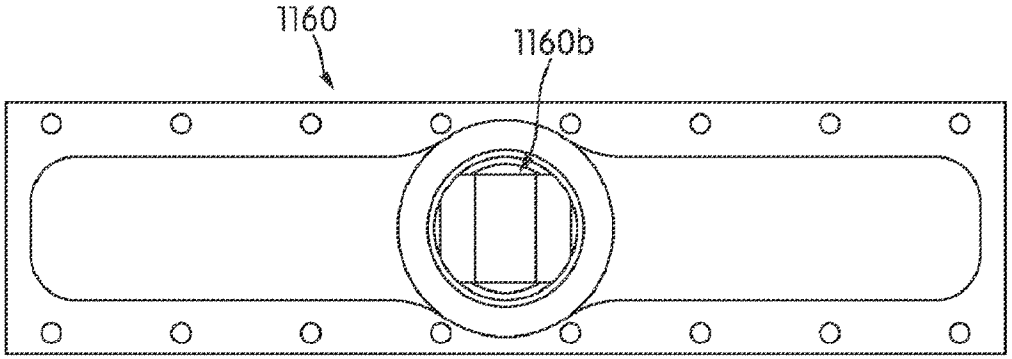
FIG. 47 is an end view of the discharge manifold in FIG. 45.

The vanes 1160*a* and valve 1180 extend completely across the flow path of compressed fluid (e.g., into the page as shown in FIG. 45, up and down as shown in FIG. 47, from an upper left toward a lower right as shown in FIG. 43). The vanes 1160*a* and valve 1180 therefore structurally support circumferentially-spaced portions 1010*a*, 1010*b* (see FIG. 43) of the casing 1010 on either side of the axially-elongated discharge outlet 1170. The vanes 1160*a* and valve 1180 may therefore help the casing 1010 to resist deformation (e.g., that might be encouraged by reaction forces generated between the gate 1110 and casing 1010 during use of the compressor 1000).

Figure 48:
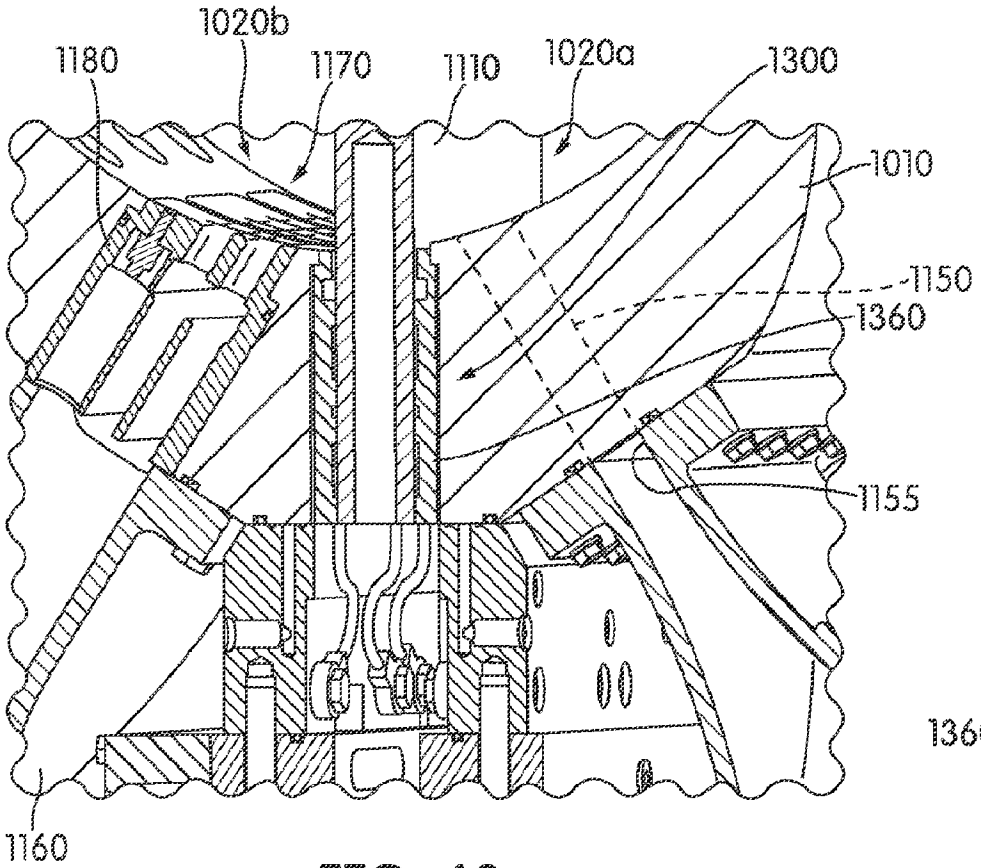
FIG. 48 is partial, cross-sectional, perspective view of the compressor in FIG. 39, showing the hydrostatic bearing arrangement.

As shown in FIG. 48, a plurality of vanes/ribs 1155 are disposed within and extend across the inlet 1150 along the circumferential direction of the compression chamber 1020 (from lower left to upper right as shown in FIG. 48). These ribs 1155 strengthen the casing 1010 in the area of the inlet 1150, and help to prevent deflection of the casing 1010 around the gate 1110. According to various embodiments, the inlet 1150 is axially divided into a plurality of discrete inlets 1150 (e.g., holes spaced along the axial direction of the compressor 1000), such that the vanes/ribs 1155 are defined by portions of the casing 1010 between such inlet holes.

As illustrated in FIGS. 48-51, the compressor 1000 includes a hydrostatic bearing arrangement 1300 that allows the gate 1110 to reciprocate up and down relative to the gate housing 1100 while maintaining close contact with the rotor 1040. The hydrostatic bearing arrangement 1300 reduces friction between the gate 1110 and the gate housing 1100.

Figure 50:
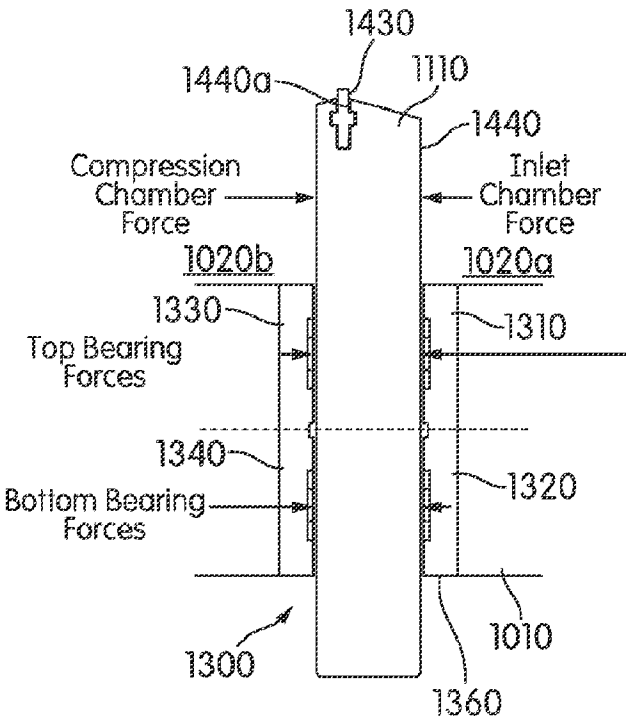
FIG. 50 is diagrammatic view of the hydrostatic bearing arrangement of the compressor in FIG. 39.

As shown in FIGS. 43, 48 and 50, the gate 1110 separates an inlet side 1020*a* of the compression chamber 1020 from an outlet side 1020*b* of the compression chamber 1020. Pressure in the inlet side 1020*a* stays relatively close to the pressure of fluid entering the compression chamber 1020 via the inlet 1150. Pressure in the outlet side 1020*b* of the compression chamber 1020 increases during each compression stroke/revolution and reaches the output pressure of compressed fluid being output through the discharge outlet 1170. As shown in FIG. 50, this causes a higher pressure on the outlet side 1020*b* of the gate 1110 than on the inlet side 1020*a*, which pushes the gate toward the inlet side 1020*a*. As shown in FIG. 50, this differential pressure creates a cantilever force on the gate 1110 and because the compression chamber 1020 pressure increases until discharge every cycle the cantilever force is constantly cycling. The hydrostatic bearing arrangement 1300 accommodates this cycling cantilever force and equalizes the cantilever/bending moment on the gate 1110.

As shown in FIGS. 48-51, the hydrostatic bearing arrangement 1300 comprises: upper hydrostatic bearings 1310 on the inlet side 1020*a* of the gate 1110, lower hydrostatic bearings 1320 on the inlet side 1020*a* of the gate 1110, upper hydrostatic bearings 1330 on the compression/outlet side 1020*b* of the gate 1110, and lower hydrostatic bearings 1340 on the compression/outlet side 1020*b* of the gate 1110.

Figure 49:
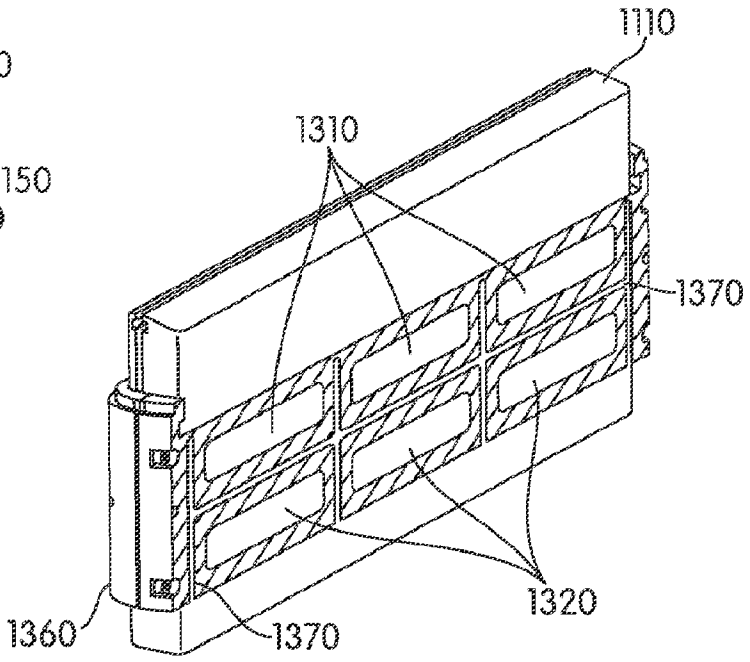
FIG. 49 is perspective view of the hydrostatic bearings and gate of the compressor in FIG. 39.

As shown in FIG. 49, three of each bearing 1310, 1320, 1330, 1340 are spaced apart along the axial/longitudinal direction of the compressor 1000 (i.e., into the page as shown in FIG. 50), such that there are three columns of bearings 1310, 1320, 1330, 1340 (or six columns if both sides 1020*a*, 1020*b* are considered separate). According to various non-limiting embodiments, the use of multiple columns of bearings 1310, 1320, 1330, 1340 may reduce the length the hydraulic fluid has to laterally travel. This may keep hydraulic fluid more evenly distributed over all surfaces of the bearing pad. Increasing the number of bearings may also isolate problems (e.g., debris, deflection of bearing surfaces, wear of bearing pad surfaces, a clog in the oil system, etc.) to a single bearing 1310, 1320, 1330, 1340 leaving other bearings 1310, 1320, 1330, 1340 still working properly. However, greater or fewer columns of bearings 1310, 1320, 1330, 1340 could be used without deviating from various embodiments (e.g., by combining the different bearings 1310 into a single longitudinally longer bearing). According to one or more embodiments, four columns of bearings are provided on each side of the gate.

According to various embodiments, the use of multiple columns of bearings 1310, 1320, 1330, 1340 may facilitate fine tuning of the resistors 1410 of one column (or bearings within one column) relative to other column(s) to accommodate for varying conditions along the length of the gate 1110. For example, if the hydrostatic pressure causes the sleeve 1360 to bow out in the middle, the middle column of bearings 1310, 1320, 1330, 1340 can be tuned down to decrease flow to those larger gaps and increase flow to the end columns where the gaps are tighter and contact between the gate and sleeve would first be made.

As shown in FIGS. 48-50, the hydrostatic bearing arrangement 1300 is formed in a hydrostatic bearing insert/sleeve 1360 that mates with the casing 1010. Shims or other suitable mechanisms may be used to ensure a secure, low-tolerance fit and positioning of the sleeve 1360. The sleeve 1360 is removable from the casing 1010 to facilitate replacement of and/or maintenance on the sleeve 1360. However, according to alternative embodiments, the insert 1360 may be integrally formed with the casing 1010.

Figure 51:
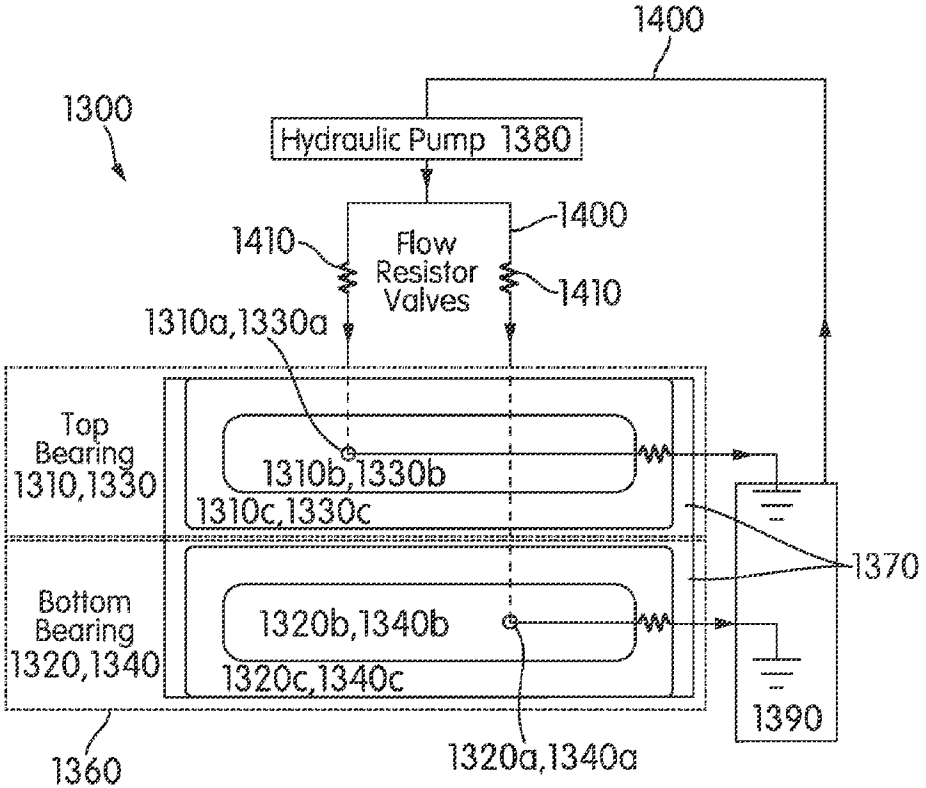
FIG. 51 is a resistance flow diagram of the hydrostatic bearings of the compressor in FIG. 39.

As shown in FIG. 51, each bearing 1310, 1320, 1330, 1340 comprises an inlet port 1310*a*, 1320*a*, 1330*a*, 1340*a* that opens into a pocket groove 1310*b*, 1320*b*, 1330*b*, 1340*b* on a side of the insert 1360 that mates with the gate 1110. Each groove 1310*b*, 1320*b*, 1330*b*, 1340*b* is surrounded by a land/bearing pad 1310*c*, 1320*c*, 1330*c*, 1340*c* that closely mates with the gate 1110. The pad 1310*c*, 1320*c*, 1330*c*, 1340*c* is surrounded by a drain 1370, which may be common to all of the bearings 1310, 1320, 1330, 1340.

As shown in FIG. 51, a hydraulic pump 1380 pumps hydraulic fluid (e.g., oil) from a reservoir 1390 through hydraulic passageways 1400 to respective resistor flow valves 1410 for each of the bearings 1310, 1320, 1330, 1340. The passageways 1400 then lead sequentially to respective inlet ports 1310*a*, 1320*a*, 1330*a*, 1340*a*, grooves 1310*b*, 1320*b*, 1330*b*, 1340*b*, lands/bearing pads 1310*c*, 1320*c*, 1330*c*, 1340*c*, the drain 1370, and back into the reservoir 1390.

As already known, hydrostatic bearings work by using two flow resistors. In this embodiment, the first flow resistor is a flow resistor valve 1410 inline prior to the bearing 1310, 1320, 1330, 1340, which is held constant during operation. The bearing pad 1310*c*, 1320*c*, 1330*c*, 1340*c* itself is the second flow resistor. The resistance of the bearing pad 1310*c*, 1320*c*, 1330*c*, 1340*c* changes and is dependent on the gap between the gate 1110 and the bearing pad itself 1310*c*, 1320*c*, 1330*c*, 1340*c*. If this gap decreases the pressure in the bearing pad 1310*c*, 1320*c*, 1330*c*, 1340*c* and the pocket grooves 1310*b*, 1320*b*, 1330*b*, 1340*b* will go up and similarly if the gap increases the pressure in the pad 1310*c*, 1320*c*, 1330*c*, 1340*c* and the pocket grooves 1310*b*, 1320*b*, 1330*b*, 1340*b* will go down. The gap will change due to loads created by the cantilever pressure force on the gate 1110.

According to various embodiments, the flow resistor valve 1410 can be replaced by a set flow resistor or an annulus in the respective passageway 1400 that behaves similarly to the bearing pad resistor. An annulus can be designed into the bearing pad 1310*c*, 1320*c*, 1330*c*, 1340*c* that allows flow to pass through it with a resistance that is dependent on the gap. Typically the annulus is placed on the opposite surface of the bearing pad to which it is hydraulically connected. To be clear, lubricant would flow through the annulus on one side of the bearing and then flow to its respective bearing pad on the opposite side. Thus, according to various embodiments, the bearings 1310, 1320, 1330, 1340 comprise self-compensating bearings with flow resistors built into the opposing bearings. For example, the flow resistor valve 1400 for the bearing 1310 may be built into the opposite bearing 1330 so that flow to the bearing 1310 is reduced when the bearing 1330 gap is reduced. This may prevent excess hydraulic fluid flow through bearings 1310, 1320, 1330, 1340 with large gaps (because the gap on the opposing bearing is small) or permit larger flow rates to bearings 1310,1320, 1330, 1340 that have higher loads. Bearings 1320, 1340 oppose each other and can work in the same manner. This type of self-compensating hydrostatic bearing is described in U.S. Pat. No. 7,287,906, the entire contents of which are incorporated herein by reference.

As shown in FIG. 50, according to various embodiments, the use of upper bearings 1310, 1330 that are discrete from lower bearings 1320, 1340 enables the bearing arrangement 1300 to adapt to the cantilever/bending moments being exerted on the gate 1110 by the pressurized fluid in the compression chamber 1020, 1020*b* and the rotor 1040. The magnitude of the forces being exerted on the gate 1110 by the inlet and outlet sides 1020*a*, 1020*b* of the compression chamber 1020 and the bearings 1310, 1320, 1330, 1340 is represented by the size of the arrows. As shown in FIG. 50, when the outlet side 1020*b* force is high relative to the inlet side 1020*a*, the moment is balanced by a high force from the upper far-side bearing 1310 and lower near-side bearing 1340, where the gaps are the smallest. Conversely, the bearing gaps are larger between the gate 1110 and bearings 1320, 1330, such that the force applied by these bearings 1320, 1330 is lower. According to various alternative embodiments, additional upper, lower, and/or intermediate hydrostatic bearings may be added to more specifically account for the bending moment being exerted on the gate 1110. However, according to alternative embodiments, the upper and lower hydrostatic bearings (e.g., bearings 1330, 1340; bearings 1310, 1320) may be combined without deviating from the scope of various embodiments.

As used herein, the directional terms "upper" and "lower" with respect to bearings 1310, 1330, 1320, 1340 are defined along the direction of reciprocating movement of the gate 1110, and not necessarily along a gravitational up/down direction (though gravitational up/down aligns with the gate 1110's up/down reciprocating direction according to various embodiments).

According to various embodiments, the hydrostatic bearing arrangement 1300 creates a fluid film gap between the gate 1110 and casing 1010 on the inlet side 1020*a* of the compression chamber 1020, which may prolong the useful life of the gate 1110 and/or casing 1010 by reducing or eliminating wearing contact between the gate 1110 and casing 1010, and/or reduce the forces required to move the gate 1110 along its reciprocating path.

According to various alternative embodiments, the hydrostatic bearing is used on a rotary vane compressor in which the vanes rotate with and reciprocate relative to the rotor instead of the casing. In such embodiments, a hydrostatic bearing such as the bearing 1300 is disposed between the rotor and gate, rather than between the casing and gate.

As shown in FIG. 50, the gate 1110 includes a seal 1430 that mounts to a groove 1440*a* in the main body 1440 of the gate 1110. As shown in FIG. 50, the seal 1430 and groove 1440*a* have complimentary "+" shaped profiles that help to retain the seal 1430 in the groove 1440*a* during operation of the compressor 1000. According to various alternatives, the groove 1440*a* and seal 1430 may have any other suitable complimentary profile that discourages separation of the seal 1430 from the gate body 1440 (e.g., a profile with a narrow top opening and a larger (e.g., bulbous) middle cross-section, a triangular profile with a point toward the top, etc.).

As shown in FIG. 50, according to various embodiments, the gate body 1440 and/or the sleeve 1360 may be formed from hard materials that resist wear (e.g., materials such as 440C steel, 17-4 steel, D2 tool steel, or Inconel, among others, with HRC over 35, 40, 45, 50, 55, 60, 65, etc.) or are coated with wear-resistant coatings or otherwise treated to increase hardness (e.g., nitrided steel, steel with a hard ceramic coating, steel with surface heat treatments that increase surface hardness, etc.) so as to resist wear when and if the sleeve 1360 and gate body 1440 rub against each other. Additionally and/or alternatively, one of the sleeve 1360 and gate body 1440 may have a hard surface (e.g., steel) while the other of the sleeve 1360 and gate body 1440 is relatively softer (e.g., formed of bronze of brass) so as to be sacrificially worn during operation, and eventually replaced. According to one or more embodiments, the sleeve 1360 comprises a hard-surfaced material such as steel, while the gate body 1440 comprises a soft material such as bronze. According to one or more alternative embodiments, the sleeve 1360 comprises a soft material such as bronze, while the gate body 1440 comprises a hard material such as steel.

According to various embodiments, the surface of the gate 1110 and/or sleeve 1360 (or a coating thereon) is matted or otherwise constructed so as to create turbulence within the oil flow, thereby increasing the shear force of the oil as it forces its way through the gaps and increases the hydrostatic bearing pressure.

According to alternative embodiments, the hydrostatic bearing arrangement 1300 is replaced with a hydrodynamic bearing arrangement, which provides hydraulic liquid (e.g., oil) to an interface between the gate body 1440 and sleeve 1360. The hydrodynamic bearing relies on relative movement between the gate body 1440 and sleeve 1360 to cause the hydraulic fluid to pressurize and/or lubricate the intersection.

Figure 40:
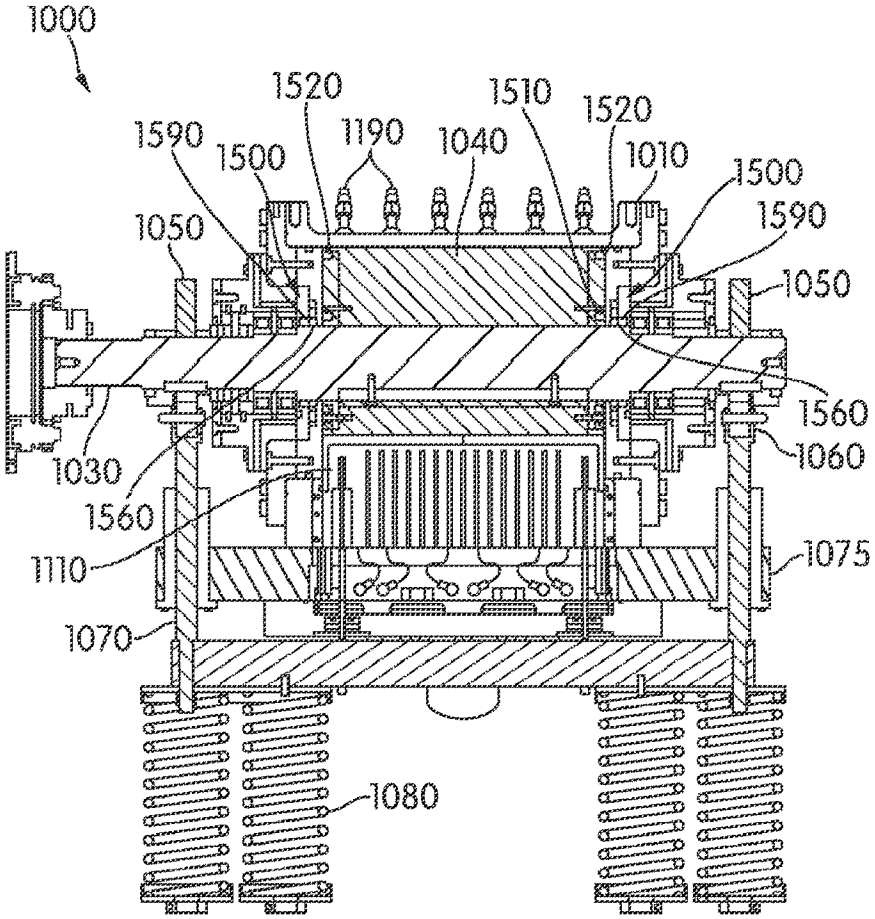
FIG. 40 is a cross-sectional view of the compressor in FIG. 39, taken along an axis of the compressor's drive shaft.
Figure 39:
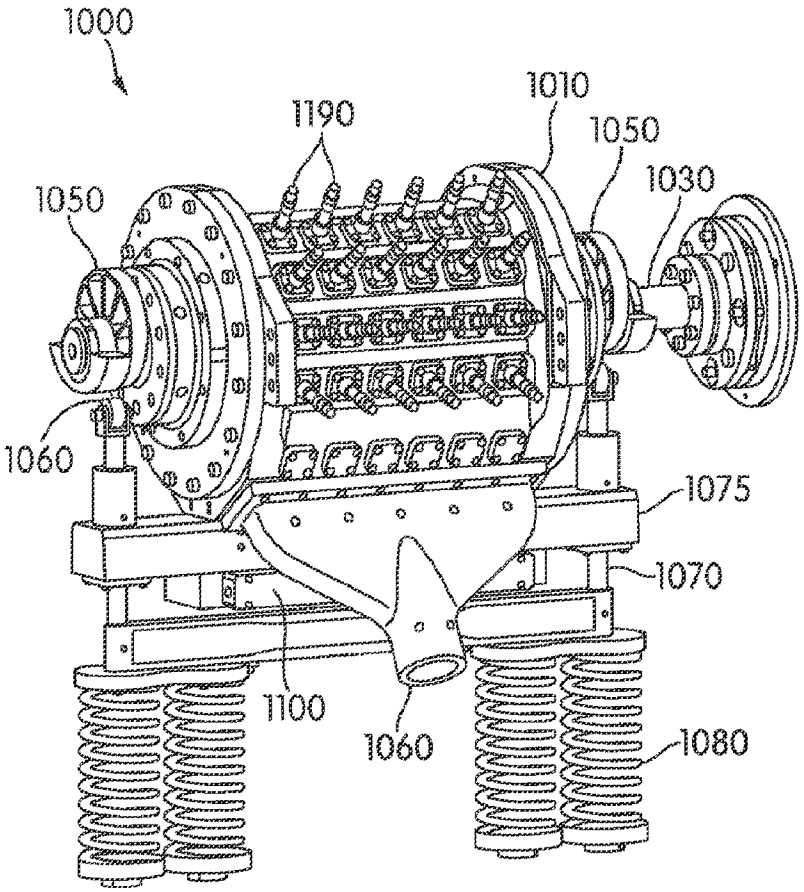
FIG. 39 is a perspective view of a compressor according to an alternative embodiment.

As shown in FIG. 40, a mechanical seal 1500 on each axial end of the compressor 1000 hermitically seals the compression chamber 1020 of the compressor 1000 relative to the environment outside of the compression chamber 1020 around the driveshaft 1030.

Figure 52:
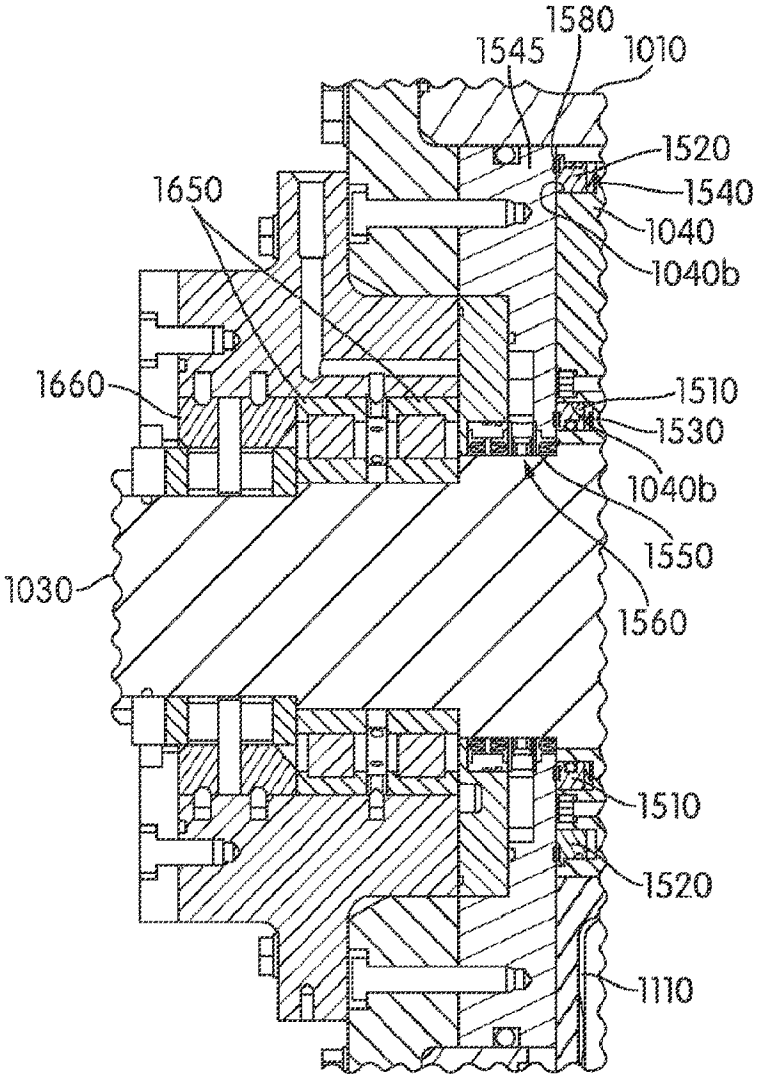
FIG. 52 is a partial cross-sectional view of FIG. 40.
Figure 54:
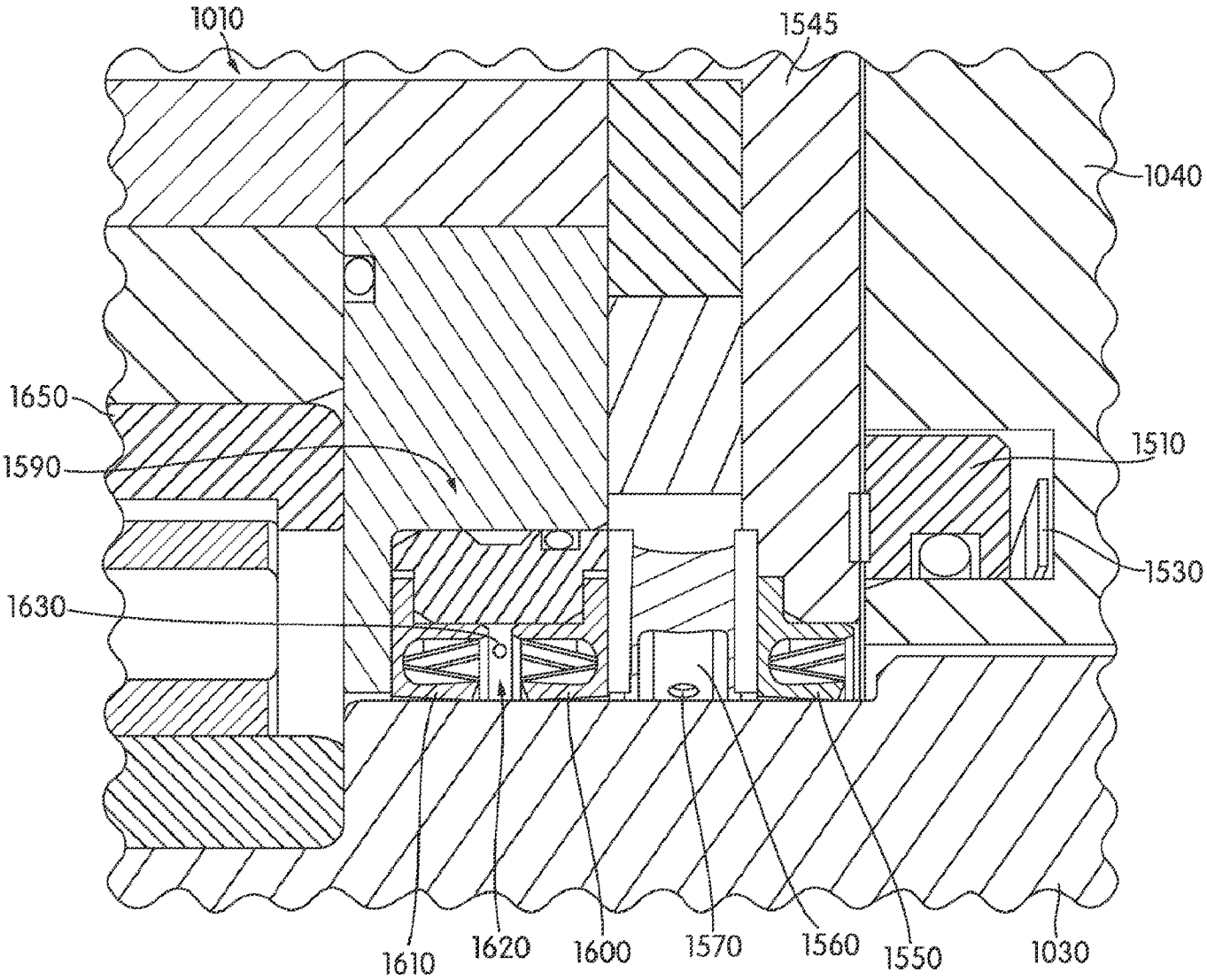
FIG. 54 is an enlarged, partial, cross-sectional view of FIG. 52.

Each of the two mechanical seals 1500 includes face seals 1510, 1520, a radial shaft seal 1550, a vent 1560, and hydraulic packing 1590. As shown in FIGS. 40, 52, and 54, the inner and outer face seals 1510, 1520 seal an axial end of the rotor 1040 relative to the axial face of the casing 1010 that defines the compression chamber 1020. As shown in FIG. 52, the seals 1510, 1520 are mounted within circumferential (but non-circular in the case of seal 1520) face grooves 1040*b* in the rotor 1040 to permit axial movement (i.e., left/right movement as shown in FIG. 40), and springs 1530, 1540 (e.g., Belleville washers, an O-ring with elastic properties, a series of compression springs arranged around the perimeter of the seals 1501, 1520) bias the seals 1510, 1520 axially against the axial face of the casing 1010 that defines the compression chamber 1020. The inner face seal 1510 is circular and concentric with a rotational axis of the drive shaft 1030. As shown in FIG. 41, the outer face seal 1520 follows the non-circular perimeter of the rotor 1040, and rotates with the rotor 1040 about the axis of the drive shaft 1030. According to various embodiments, outer sealing portions of the face seals 1510, 1520 comprise low-friction material (e.g., graphite) that is bonded to a stronger backing (e.g., steel).

Figure 68:
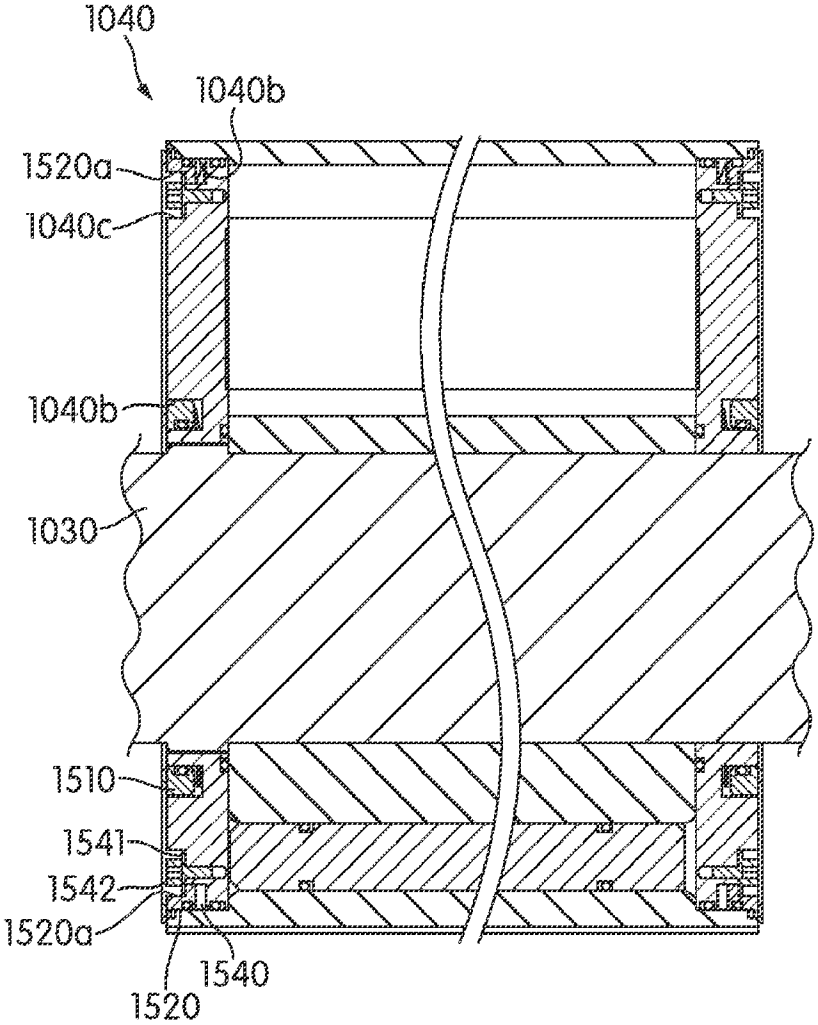
FIG. 68 is a cross-sectional view of the rotor and drive shaft in FIG. 67, with the cross-section taken along the line 68-68 in FIG. 67.
Figure 67:
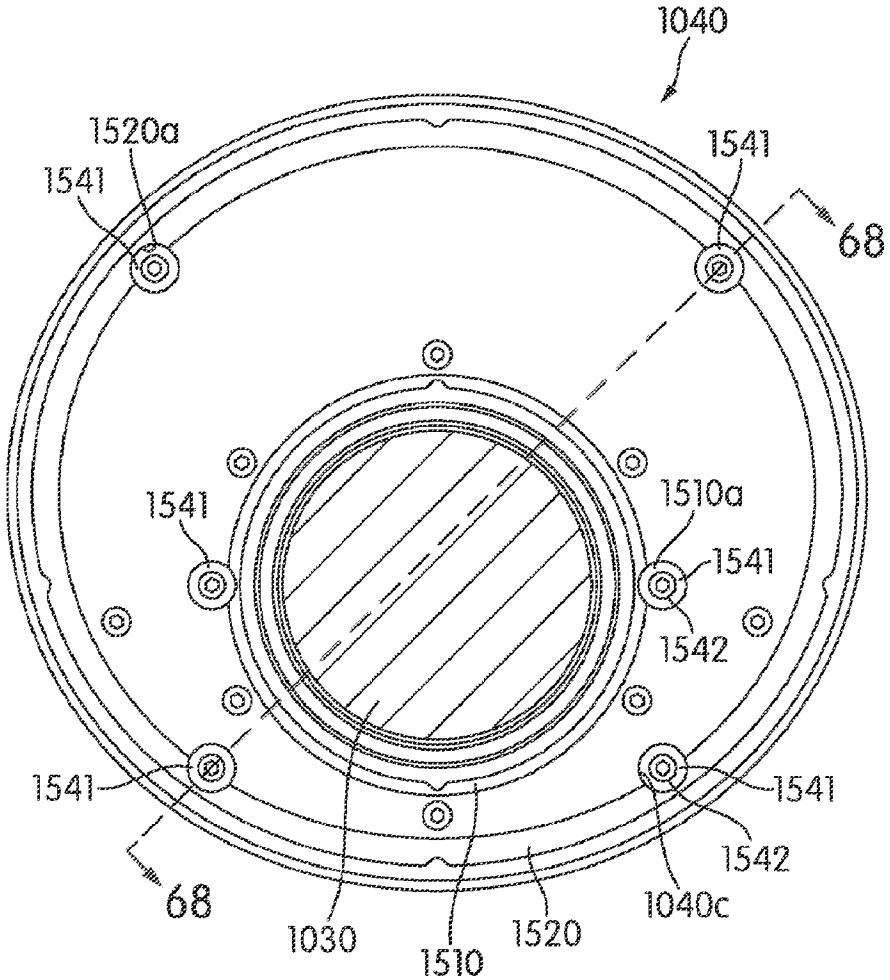
FIG. 67 is a cross-sectional end view of the rotor of the compressor in FIG. 39, with the cross-section taken perpendicular to the drive shaft.

According to various embodiments, the seals 1510, 1520 are retained in their grooves 1040*b* even when the wear surface of the seals 1510, 1520 (e.g., the graphite portion of the seals 1510, 1520) is worn through. For example, as shown in FIGS. 67 and 68, the seals 1510, 1520 may be retained by locking washers 1541 (e.g., multiple washers per seal 1510, 1520) that are connected (e.g., via bolts 1542 or other fasteners) to recesses 1040*c* in the end faces of the rotor 1040 and extend into shouldered grooves 1510*a*, 1520*a* in the seals 1510, 1520 to prevent the seals 1510, 1520 from separating from mating seal grooves 1040*b*, while permitting the seals 1510, 1520 to move axially within the grooves 1040*b* to keep the seals 1510, 1520 proximate to the mating face of the compression chamber (e.g., the face of wear plate 1545 (see FIG. 52).

As shown in FIG. 52, an end cap wear plate 1545 on each axial end of the compression chamber 1020 removably mounts to a remainder of the casing 1010 (e.g., via bolts) and abuts the seals 1510, 1520. The plate 1545 may be replaced when wearing contact between the seals 1510, 1520 and plate 1545 has worn the plate 1545 sufficiently to warrant replacement.

As shown in FIG. 54, the radial shaft seal 1550 extends radially between the drive shaft 1030 and an end cap of the casing 1010. As shown in FIGS. 54 and 40, the vent 1560 is disposed axially outwardly from the radial shaft seals 1550. As shown in FIG. 54, a fluid passageway 1570 fluidly connects the vent 1560 to the inlet 1150 of the compressor 1000. As shown in FIG. 54, the hydraulic packing 1590 comprises facing radial seals 1600, 1610 with a hydraulic fluid passage 1620 therebetween. The hydraulic pump 1380

(or any other suitable source of hydraulic fluid) provides pressurized hydraulic fluid to the hydraulic packing 1590 via a port/passageway 1630 that leads into the space between the seals 1600, 1610. As shown in FIG. 54, rotational bearings 1650 support the drive shaft 1030 relative to the casing 1010 to permit the drive shaft 1030 to rotate relative to the casing 1010.

The operation of the mechanical seal 1500 is described with reference to FIGS. 52 and 54. For the working fluid (e.g., natural gas being compressed) to leak out of the compression chamber 1020, the fluid may leak sequentially through the seals 1520, 1510, 1550. If the working fluid leaks past all three seals 1520, 1510, 1550, the fluid reaches the vent 1560 which returns the fluid back to the compressor inlet 1150 via the passageway/port 1570, which is maintained at the pressure of the inlet 1150 via its fluid communication with the inlet 1150. The hydraulic packing 1590 on the outer axial side of the vent 1560 is pressurized via hydraulic fluid to a pressure higher than the inlet 1150 pressure, which discourages or prevents the working fluid from further leaking past the hydraulic packing 1590. Leaked working fluid leaks through the passageway/port 1570 back to the intake 1150, rather than past the hydraulic packing 1590 because the inlet 1150 is at a significantly lower pressure than the hydraulic packing 1590. Thus, leakage of the working fluid past the hydraulic packing 1590 is reduced or preferably eliminated. Pressure in the bearing cavity for the bearings 1650 is maintained at ambient atmospheric pressure.

According to various embodiments, the mechanical seal 1500 provides an axially-compact seal that results in lower moment loads on the compressor's bearings.

Figure 53:
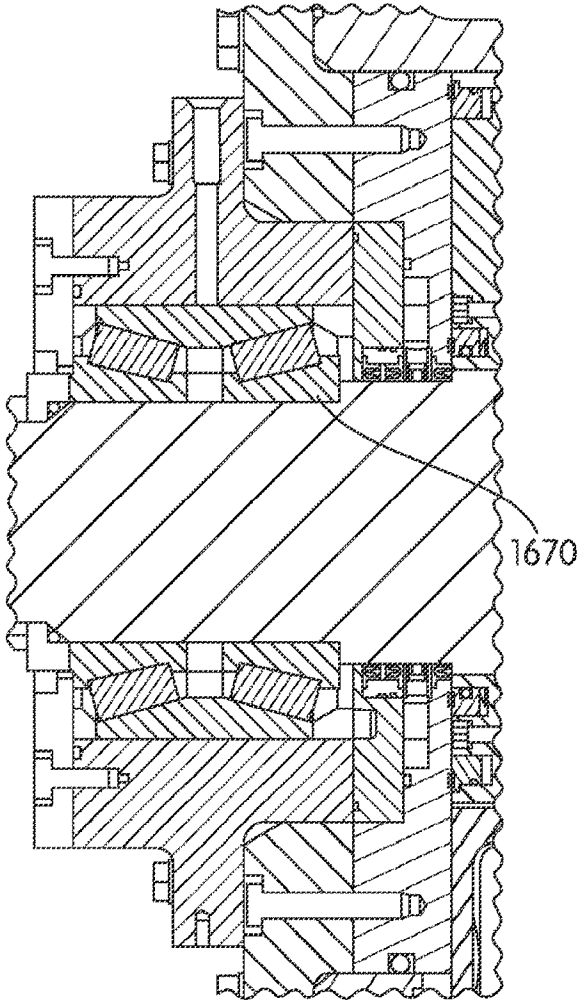
FIG. 53 is a partial cross-sectional view of a compressor according to an alternative embodiment.

As shown in FIG. 52, in the compressor 1000, the drive shaft 1030 is mounted to each axial end of the casing 1010 via a combination of separate rotational bearings 1650 and thrust bearings 1660. However, as shown in FIG. 53, the separate rotational and thrust bearings 1650, 1660 may be replaced by a consolidated bearing 1670 that serves both thrust bearing and rotational bearing functions without deviating from the scope of various embodiments. To facilitate removal of the bearing 1670 from the drive shaft, a lubrication passageway may extend through the drive shaft and open into the interface between the drive shaft and the bearing 1670. According to various alternative embodiments, the bearings 1650, 1660 may be replaced with any other type of rotational coupling between the drive shaft 1030 and casing 1010 without deviating from the scope of various embodiments (e.g., other types of bearings, bushings, etc.).

Although the seal 1500 is described as including various structures in the illustrated embodiment, the seal 1500 may include greater or fewer structures without deviating from the scope of the present invention. For example, one or more of the seals 1510, 1520, 1550 may be omitted without deviating from the scope of the present invention.

Figure 69:
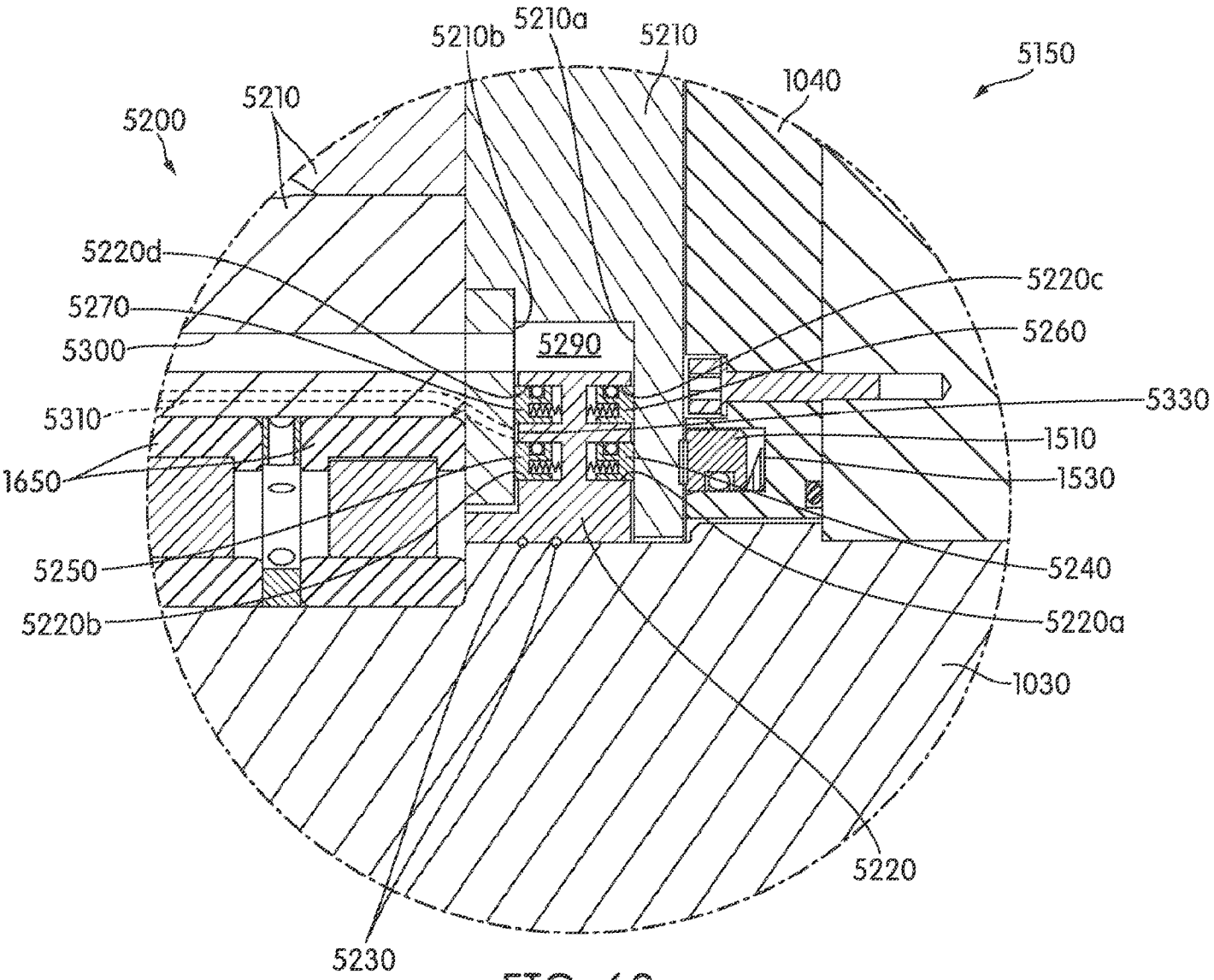
FIG. 69 is a partial cross-sectional view of a compressor according to an alternative embodiment, with the cross-section taken along an axis of the compressor's drive shaft.

FIG. 69 illustrates a compressor 5150 that is generally similar to the compressor 1000, except that the compressor 5150 uses an alternative embodiment of a mechanical seal 5200 in place of the mechanical seal 1500. The mechanical seal 5200 is generally similar to the seal 1500, so a redundant explanation of similar or identical components is omitted. In contrast with the axially spaced arrangement of various components of the mechanical seal 1500 (e.g., the radial seal 1550, vent 1560, radial seals 1600, 1610, and pressurized hydraulic fluid passageway 1620), various components of the mechanical seal 5200 are radially spaced from each other, which may provide a more axially-compact seal. As shown in FIG. 69, the compressor 5150 includes a casing 5210 that is generally identical to the casing 1010, except that the casing 5210 is shaped slightly differently so as to accommodate the differently shaped mechanical seal 5200.

As shown in FIG. 69, the seal 5200 includes an annular collar 5220 that is rigidly and sealingly connected to or integrally formed with the drive shaft 1030 so as to rotate with the drive shaft 1030 relative to the casing 5210. According to various embodiments, the collar 5220 may connect to the drive shaft 1030 in a variety of alternative ways (e.g., heat-shrunk onto the shaft 1030, glued or otherwise fastened onto the shaft 1030, welded onto the shaft 1030, press-fit onto the shaft 1030, etc.). According to various embodiments, o-rings 5230 are disposed between the collar 5220 and shaft 1030 to prevent leaks therebetween. Inner annular seal grooves 5220*a,b* and outer annular seal grooves 5220*c,d* are disposed on the axial faces of the collar 5220 that face toward and away from the rotor 1040. Face seals 5240, 5250, 5260, 5270 are disposed in the grooves 5220*a,b,c,d* and spring biased away from the collar 5220 toward a mating axial face surface 5210*a*, 5210*b* of the casing 5210. A vent 5290 is disposed between the collar 5220 and casing 5210 radially outwardly from the collar 5220. The vent 5290 fluidly connects to an inlet into the compressor 5150 via a passageway 5300 in the casing 5210. A hydraulic fluid passageway 5310 connects a source of pressurized hydraulic fluid (or other fluid) (e.g., the pump 1380) to a space 5330 disposed between the seals 5250, 5270, face 5210*b*, and collar 5220 so as to keep this space 5330 pressurized with hydraulic fluid.

The operation of the mechanical seal 5200 is described with reference to FIG. 69. If working fluid leaks from the compression chamber 1020 sequentially past the face seal 1520, face seal 1510, face seal 5240, and face seal 5260, the leaked working fluid will leak into the vent 5290, which will direct the leaked working fluid back to the inlet of the compressor 5150 via the passageway 5300. As with the seal 1500, the hydraulic packing formed by the seals 5250, 5270, and the pressurized fluid disposed in the space 5330 discourages or prevents leaked working fluid in the vent 5290 from further leaking past the seals 5250, 5270. Because the pressure in the inlet into the compressor 5150 is lower than the pressure in the space 5330, leaked fluid will flow back to the inlet rather than leaking past the hydraulic packing.

According to various embodiments, the seal 5200 may be modified by adding or removing various seals. For example, the compressor 5150 includes one more seal between the compression chamber and the vent than is included in the compressor 1000. In particular, in the compressor 5150, four seals are disposed between the compression chamber 1020 and the vent 5290 (i.e., the seals 1520, 1510, 5240, 5260), while the illustrated compressor 1000 has three such seals (i.e., seals 1520, 1510, 1550). However, according to alternative embodiments greater or fewer such seals may be disposed between the compression chamber and vent without deviating from the scope of various embodiments. For example, one or more of the seals 1520, 1510, 5240, 5260 may be omitted. Alternatively, additional seals like the seals 5240, 5260 may extend between the collar 5220 and the face 5210*a* of the casing 5210 to further reduce leakage from the compression chamber 1020, and the collar 5220 and faces 5210*a,b* may be radially expanded to provide space for such additional seals, preferably without axially elongating the overall mechanical seal. Additionally and/or alternatively, the seal 5200 may be modified by adding a radial seal (e.g., like the seal 1550) between the casing 5210 and shaft 1030 along the leakage path between the seals 1510, 5240. Additionally and/or alternatively, the vent 5290 may be disposed along the leakage path between different ones of the seals 1520, 1510, 5240, 5260. For example, the vent may alternatively be disposed in the leakage path between the inner face seal 5240 and the outer face seal 5260.

As shown in FIGS. 41 and 43, according to various embodiments, one or more holes 1040*a* extend axially through the entire rotor 1040 so as to fluidly connect opposite axial ends of the rotor 1040 radially inwardly from the seals 1520. These holes 1040*a* may prevent the rotor 1040 from being axially pushed against one axial end of the compression chamber 1020 if compressed working fluid asymmetrically leaked past one of the seals 1520 on one axial end of the rotor 1040 to a greater extent than at the opposite axial end of the rotor 1040. Additionally and/or alternatively, the fluid communication between the axial ends of the rotor 1040 may be provided by extending a fluid passageway through the end plates 1545 of the casing 1010 (see FIG. 52), instead of through the rotor 1040.

As shown in FIG. 52, according to various embodiments, a proximity sensor 1580 (e.g., contact or non-contact sensor, capacitive sensor, magnetic sensor, etc.) monitors the axial position of the rotor 1040 relative to the end plates 1545 or other part of the casing 1010. The sensor 1580 and associated controller (e.g., electronic control unit, analog or digital circuitry, a computer such as a PC, etc.) may cause one or more actions (e.g., an audio or visual alarm, deactivation of the compressor) to occur if the sensed distance exceeds a predetermined distance or falls below a predetermined distance FIGS. 55-58 illustrate a compressor 2000 according to an alternative embodiment. The compressor 2000 is generally similar to the above-discussed compressors. Accordingly, a redundant description of similar or identical components is omitted. The compressor 2000 includes a main casing 2010 that defines a compression chamber 2020, a drive shaft 2030, a rotor 2040 mounted to the drive shaft 2030 for rotation with the drive shaft 2030 relative to the casing 2010, a gate 2050 slidingly connected to the casing 2010 for reciprocating movement, and a gate-positioning system 2060. The gate-positioning system 2060 of the compressor 2000 differs from the gate-positioning systems of the above-described compressors.

As shown in FIGS. 55-58, the gate-positioning system 2060 includes: a gate-positioning-system casing 2070 mounted to the main casing 2010 (e.g., via bolts or integral formation) (see FIGS. 56 and 58), a drive pulley 2080 mounted to the driveshaft 2030 for rotation with the drive shaft 2030, a cam shaft 2090 rotationally mounted to the casing 2070 for relative rotation about a cam shaft axis that is parallel to an axis of the main drive shaft 2030, a driven pulley 2095 mounted to the cam shaft 2090 for rotation with the cam shaft 2090 relative to the casings 2070, 2010, a belt 2100 connected to the pulleys 2080, 2095, two cams 2110 mounted to the camshaft 2090 for rotation with the camshaft 2090, cam followers 2120 rotationally mounted to gate supports 2130 for rotation relative to the supports 2130 about axes that are parallel to the rotational axes of the shafts 2030, 2090, and springs 2140 that extend between the casing(s) 2070, 2010 and the gate supports 2130.

Figure 57:
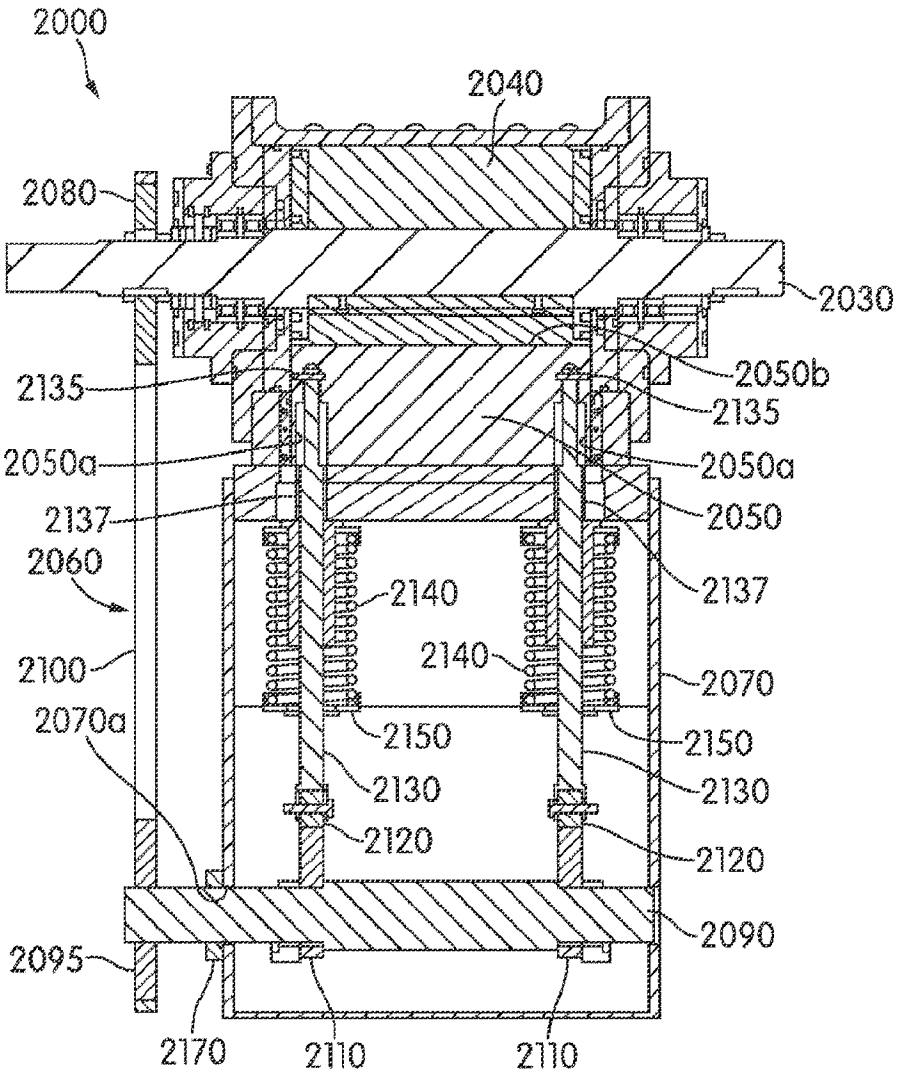
FIG. 57 is a cross-sectional view of the compressor in FIG. 55, taken along an axis of the compressor's drive shaft.

The gate supports 2130 mount to the gate 2050 to drive the reciprocating motion of the gate 2050. As shown in FIG. 57, the gate supports 2130 pass through enlarged lower openings 2050*a* in the gate 2050 and rigidly attach (e.g., via a threaded connection, a retainer key or ring, a retainer pin 2135 (as shown in FIG. 57), etc.) to upper portions of the gate 2050 near an upper sealing edge 2050*b* of the gate 2050. The lower openings 2050*a* are enlarged relative to the gate supports 2130 so that the gate supports 2130 do not contact lower portions of the gate 2050. According to various embodiments, extending the gate supports 2130 through the enlarged lower openings 2050*a* limits the effect that thermal expansion/contraction has on the positioning of the seal 2050*b* of the gate 2050 relative to the gate support 2130 position. In particular, thermal expansion of the gate 2050 below where the gate 2050 mounts to the gate supports 2130 does not affect the positioning of the gate's seal 2050*b* relative to the gate supports 2130. According to various embodiments, this provides more precise and accurate gate seal 2050*b* positioning relative to the rotor 2040 when the gate 2050 thermally expands or contracts during use of the compressor 2000.

Figure 56:
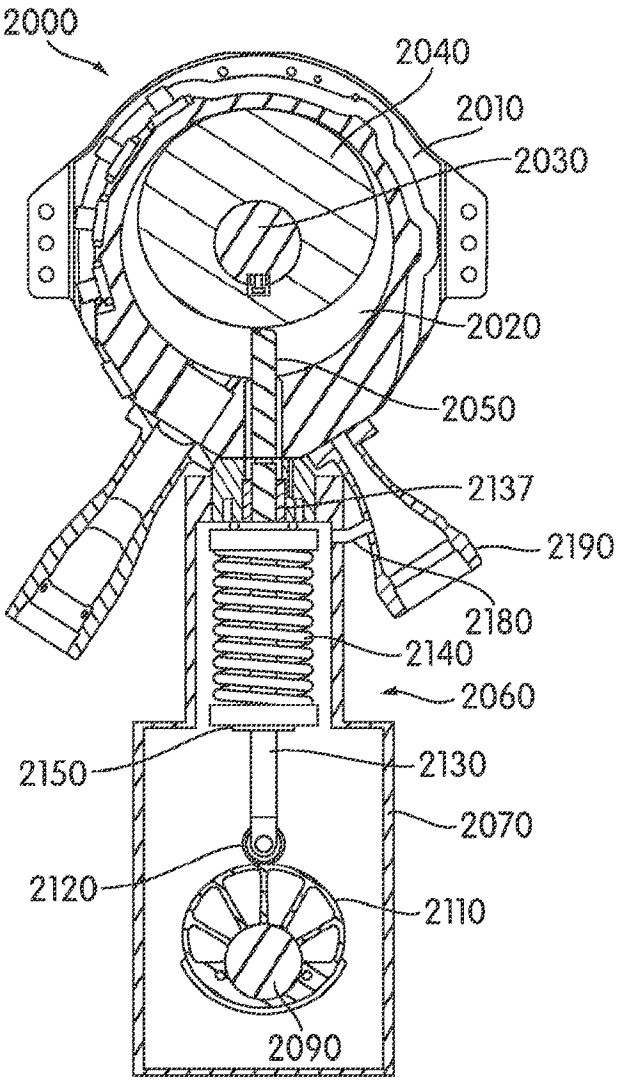
FIG. 56 is a cross-sectional view of the compressor in FIG. 55, taken in a plane that is perpendicular to a drive shaft of the compressor.
Figure 55:
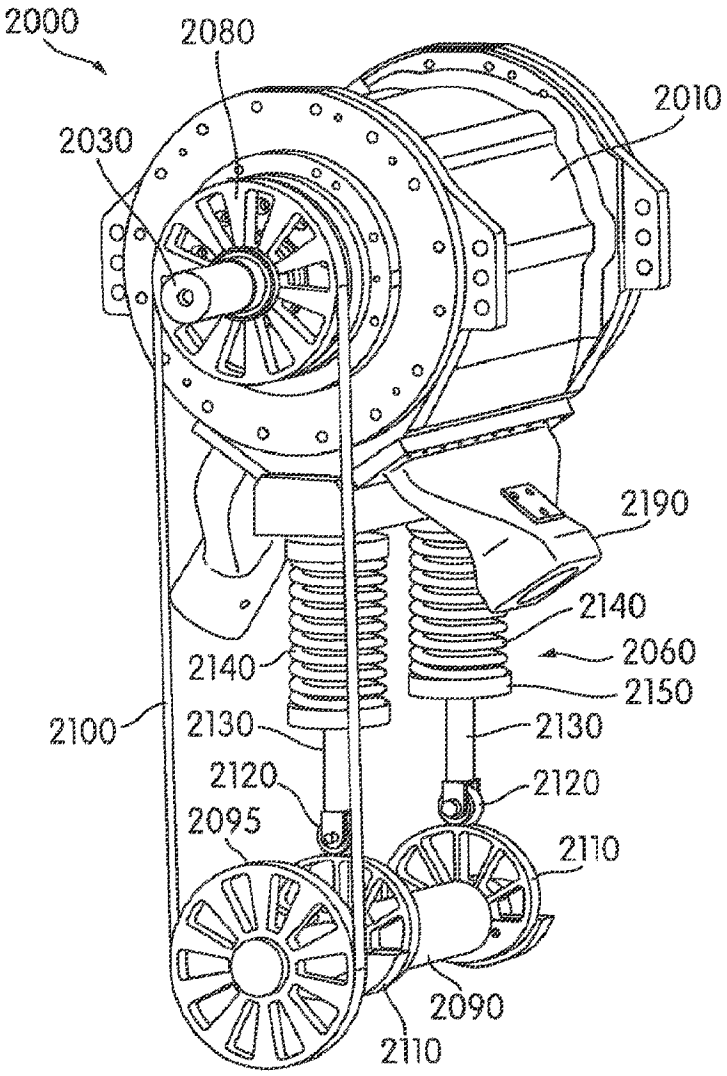
FIG. 55 is a perspective view of a compressor according to an alternative embodiment, with a cam casing removed to display internal components.

As shown in FIGS. 56 and 57, the gate supports 2130 slidingly mount to the casing 2070 and/or 2010 via linear bearings 2137 (or other linear connections such as bushings, etc.) to permit the gate supports 2130 to move in the reciprocating direction of the gate 2050 (up/down as shown in FIGS. 56 and 57). An upper end of the springs 2140 abuts a spring retainer portion of the casing 2070 and/or casing 2010. A lower end of the springs 2140 connects to the gate supports 2130 via spring retainers 2150 or other suitable connectors. As a result, the compression springs 2140 urge the gate supports 2130 and gate 2050 downwardly away from the rotor 2040 and towards the cams 2110.

During operation of the compressor 2000, the drive shaft 2030 rotationally drives the pulley 2080, which rotationally drives the belt 2100, which rotationally drives the pulley 2095, which rotationally drives the shaft 2090, which rotationally drives the cams 2110. Rotation of the cams 2110 drives the cam followers 2120, gate support 2130, and gate 2050 upwardly toward the rotor 2040 against the spring bias of the springs 2140. The cams 2110 are shaped and the belt 2100 and pulleys 2080, 2095 are timed so that the gate positioning system 2060 maintains the seal 2050*b* of the gate 2050 proximate to (e.g., within 5, 4, 3, 2, 1, 0.5, 0.3, 0.1, 0.05, 0.04, 0.03, 0.02, 0.01, 0.005, 0.004, 0.003, 0.002, and/or 0.001 mm of) the rotor 2040 as the rotor 2040 rotates during operation of the compressor 2000. The gate-positioning system 2060 therefore generally works in a similar manner as the gate positioning system illustrated in FIG. 1, except that the relative roles of the springs and cams are reversed in the compressor 2000 (i.e., the cams 2110 urge the gate 2050 toward the rotor 2040, rather than away from it, and the springs 2140 urge the gate 2050 away from the rotor 2040, rather than toward it).

In the gate-positioning system 2060 according to various non-limiting embodiments, a mass of the reciprocating components (e.g., the gate 2050, gate supports 2130, cam followers 2120, portions of the springs 2140 and retainers 2150) is kept relatively low to reduce the forces needed to drive such reciprocation. According to various embodiments, such reduction in reciprocating mass may facilitate higher compressor 2000 operational speeds (in terms of RPMs) and/or smaller springs 2140 and other structural components of the system 2060.

In the illustrated embodiment, the cam shaft 2090 is belt-driven via the pulleys 2080, 2095 and belt 2100. However, according to alternative embodiments, the cam shaft 2090 may be driven by any other suitable mechanism for transferring rotation from the drive shaft 2030 to the cam shaft 2090 (e.g., chain drive, gear drive, etc.) without deviating from the scope of various embodiments.

Figure 58:
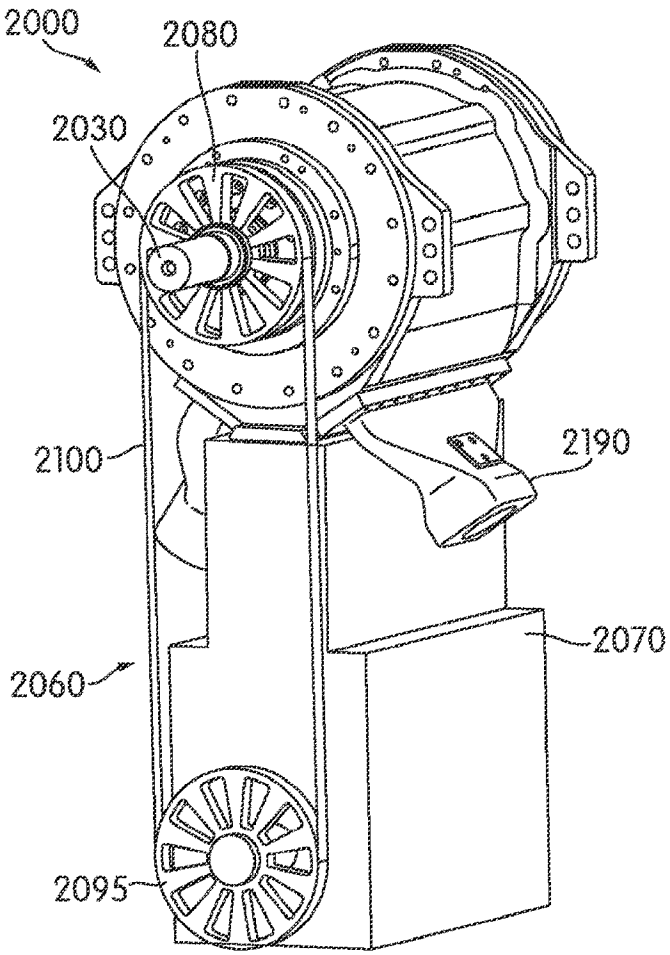
FIG. 58 is a perspective view of the compressor in FIG. 55, showing a cam casing.

As shown in FIGS. 56-58, the casing 2070 encloses many of the components of the gate-positioning system 2060. In the illustrated embodiment, the only working fluid leakage path to the ambient environment via the gate 2050/casing 2010 interface is via the intersection between a hole 2070*a* in the casing 2070 and the cam shaft 2090 on the side of the casing 2070 where the cam shaft 2090 projects through the casing 2070 so that it may be driven by the pulley 2095. As shown in FIG. 57, a hydraulic packing 2170 seals this leakage path/intersection between the cam shaft 2090 and casing 2070. According to various embodiments, the hydraulic packing 2170 may be similar to or identical to the above-discussed hydraulic packing 1590, and may comprise facing radial seals (e.g., similar to or identical to the seals 1600, 1610) with a hydraulic fluid passage (e.g., similar to or identical to the passage 1620) therebetween. The hydraulic pump 1380 may provide pressurized hydraulic fluid to the hydraulic packing 2170 via a port/passageway (e.g., similar to or identical to the port/passageway 1630) that leads into the space between the seals. As a result, the pressure within the hydraulic packing 2170 exceeds a pressure within the casing 2070 so that fluids (e.g., working fluid that leaked past the gate 2050 into the casing 2070 volume) do not leak out of or are discouraged from leaking out of the casing 2070. The casing 2070 may be pressurized by working fluid that escaped from the compression chamber 2020, and that pressure may prevent or discourage further leakage through that flow path.

Additionally and/or alternatively, as shown in FIG. 56, a vent passage 2180 may fluidly connect the interior of the casing 2070 with the inlet (e.g., via the inlet manifold 2190 or a direct connection to the inlet in the casing 2010). Such a vent passage 2180 may help to ensure that a pressure in the casing 2070 remains below a hydraulic pressure in the hydraulic packing 2170 so as to further discourage working fluid in the casing 2070 from leaking past the hydraulic packing 2170.

According to alternative embodiments, the hydraulic packing 2170 may be replaced with any other suitable seal (e.g., conventional hermetic seals that are designed to seal rotating shafts where there is a significant pressure differential between opposing sides of the seal) or eliminated altogether (e.g., if the gate 2050's seal is sufficient) without deviating from the scope of various embodiments.

According to an alternative embodiment, the casing 1010 and 2070 are axially extended to entirely enclose the pulleys 2080, 2095 and cam shaft 2090 such that only the main drive shaft 2030 of the compressor 2000 extends from the casing 2010, 2070, requiring a single mechanical seal like the seal 2170 between the drive shaft 2030 and elongated casing to hermetically seal the compressor 2000.

Figure 60:
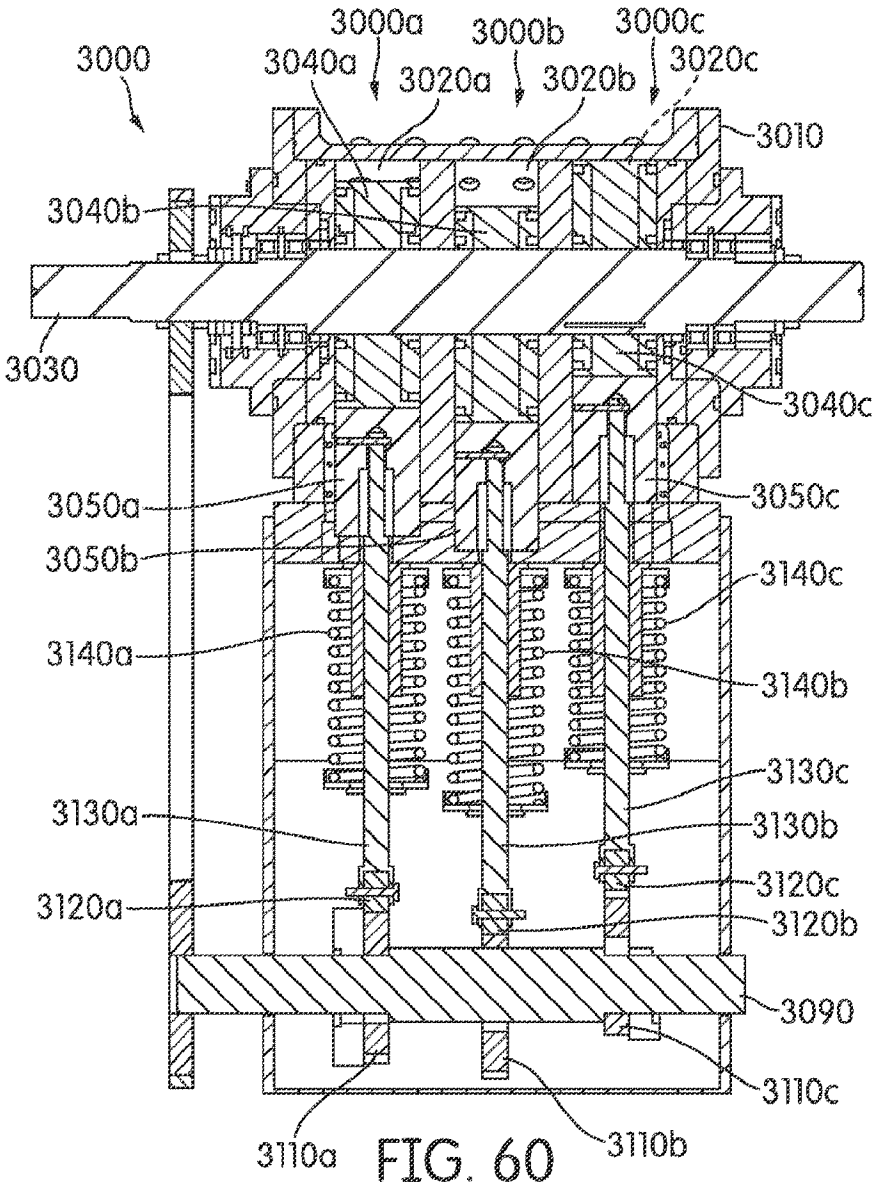
FIG. 60 is a cross-sectional view of the compressor in FIG. 59, taken along an axis of the compressor's drive shaft.
Figure 59:
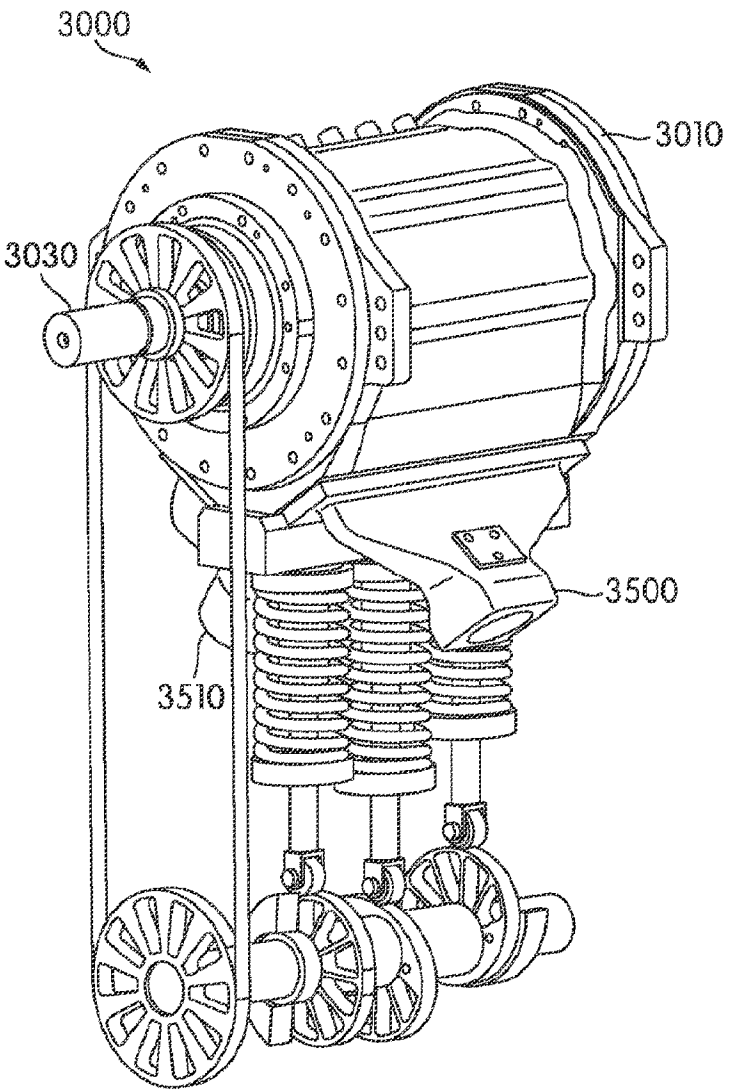
FIG. 59 is a perspective view of a compressor according to an alternative embodiment.

FIGS. 59-60 illustrate a compressor 3000 according to an alternative embodiment. The compressor 3000 is generally similar to the above-discussed compressor 2000. Accordingly, a redundant description of similar or identical components is omitted. The compressor 3000 differs from the compressor 2000 by adding two additional sub-compressors that are axially spaced from each other. Thus, the compressor 3000 comprises three sub-compressors 3000*a*, 3000*b*, 3000*c*. The compressor 3000 includes a main casing 3010 that defines three compression chambers 3020*a*, 3020*b*, 3020*c*, a drive shaft 3030, three rotors 3040*a*, 3040*b*, 3040*c* mounted to the drive shaft 3030 for rotation with the drive shaft 3030 relative to the casing 3010, three gates 3050*a*, 3050*b*, 3050*c* slidingly connected to the casing 3010 for reciprocating movement, and a gate-positioning system 3060 that includes three cams 3110*a*, 3110*b*, 3110*c* mounted to the cam shaft 3090, three cam followers 3120*a*, 3120*b*, 3120*c*, three gate supports 3130*a*, 3130*b*, 3130*c*, and three springs 3140*a*, 3140*b*, 3140*c*. The gate-positioning system 2060 of the compressor 2000 differs from the gate-positioning systems of the above-described compressors. Each of the respective sets of a, b, and c components (e.g., compression chamber 3020*a*, rotor 3040*a*, gate 3050*a*, cam 3110*a*, cam follower 3120*a*, gate support 3130*a*, and spring 3140*a*) work in substantially the same manner as the comparable components of the whole compressor 2000.

The inlet manifold 3500 of the compressor 3000 fluidly connects to the inlets of each sub-compressor 3000*a*, 3000*b*, 3000*c*. According to various embodiments, the working fluid inlets of the three sub-compressors 3000*a*, 3000*b*, 3000*c* fluidly connect to each downstream from the manifold 3500. Similarly, the compressed working fluid outlets of the three sub-compressors 3000*a*, 3000*b*, 3000*c* rejoin in the compressor's discharge manifold 3510. According to various embodiments, check-valves are disposed in each sub-compressor's discharge outlets upstream from where the discharge passageways join together.

According to various embodiments, check-valves are also disposed in each sub-compressor's inlet downstream from where the inlet flow path diverges toward respective sub-compressors 3000*a*, 3000*b*, 3000*c* (e.g., downstream or within the inlet manifold 3500) so as to discourage backflow from one chamber 3020*a*, 3020*b*, 3020*c* into another chamber 3020*a*, 3020*b*, 3020*c* during out-of-phase operation of the sub-compressors 3000*a*, 3000*b*, 3000*c*.

As shown in FIGS. 59 and 60, the compression cycles of the compressors 3000*a*, 3000*b*, 3000*c* are 120 degrees out of phase with each other. Thus, when the sub-compressor 3000*a* begins its compression cycle, the sub-compressor 3000*b* is ⅓ of the way through its cycle, and the sub-compressor 3000*c* is ⅔ of the way through its cycle. Positioning the sub-compressors 3000*a*, 3000*b*, 3000*c* out of phase in this manner reduces the maximum instantaneous torque that must be applied to the compressor 3000, which may reduce the size/power/HP of the engine, motor, or other rotational driver being used to drive the drive shaft 3030 of the compressor 3000. The 3-phase operation of the compressor 3000 may also reduce vibrations as the reciprocating movement of the gate-positioning system are generally balanced across the three sub-compressors 3000*a*, 3000*b*, 3000*c*. The 3-phase operation of the compressor 3000 may also reduce pressure spikes downstream from the compressor 3000 (e.g., in the discharge manifold 3510) because the compressed fluid flow is divided into three sequential bursts for each revolution of the drive shaft 3030 (as opposed to a single larger burst in the compressor 2000). The 3-phase operation of the compressor 3000 may also increase the strength of the casing 3010 and reduce the required reinforcement of the casing 3010 around the gate because the single gate slot of the compressor 2000 is replaced with 3 gate slots with reinforcing structure therebetween. The 3-phase operation of the compressor 3000 may reduce the cost of the compressor 3000 because the narrower gates 3050*a*, 3050*b*, 3050*c* or rotors 3040*a*, 3040*b*, 3040*c* (or other components of the compressor 3000) may be more easily fabricated because they are not as long. The 3-phase operation of the compressor 3000 may reduce the cost of the compressor 3000 because bearings may be disposed between adjacent compression chambers 3020*a*, 3020*b*, 3020*c*, which can reduce drive shaft 3030 deflection, and facilitate less expensive drive shafts 3030 and other components, while still maintaining tight tolerances between the rotor 3040*a*, 3040*b*, 3040*c* and casing 3010.

While the illustrated compressor 3000 includes three sub-compressors 3000*a*, 3000*b*, 3000*c*, the compressor may include greater or fewer sub-compressors without deviating from the scope of various embodiments (e.g., n sub-compressors that operate out of phase by 360/n degrees from each other, where n is an integer greater than 1 and preferably less than 100 (e.g., 2, 3, 4, 5, 6, 7, 8, 9, 10)).

Alternatively, the multi-phase concept of the compressor 3000 may be implemented using three discrete compressors (e.g., any of the above discussed compressors such as the compressors 1000, 2000, 5150) by connecting their respective drive shafts (e.g., via direct co-axial mounting such that the compressors are axially spaced from each other along a common drive shaft, via gears, belts, etc.) such that the compressors 1000, 2000, 5150 are out of phase from each other in the same way that the above-discussed sub-compressors 3000*a*, 3000*b*, 3000*c* are out of phase with each other.

FIGS. 61-65 illustrate a compressor 4000 according to an alternative embodiment. The compressor 4000 is generally similar to the above-discussed compressor 2000, except that the compressor 4000 uses a pivoting gate 4050, rather than a linearly reciprocating gate 1110. Accordingly, a redundant description of similar or identical components is omitted. The compressor 4000 includes a main casing 4010 that defines a compression chamber 4020 (see FIGS. 61-62), a drive shaft 4030 rotationally mounted to the casing 4010, a rotor 4040 (see FIGS. 61-62) mounted to the drive shaft 4030 for rotation with the drive shaft 4030 relative to the casing 4010, a gate 4050 mounted to a gate shaft 4052 for common pivotal movement relative to the casing 4010 about a gate axis 4055, a gate-positioning system 4060, a discharge manifold 4150 in fluid communication with an outlet 4160 into the compression chamber 4020, and an inlet manifold 4170 in fluid communication with an inlet 4180 of the compression chamber 4020.

Figure 62:
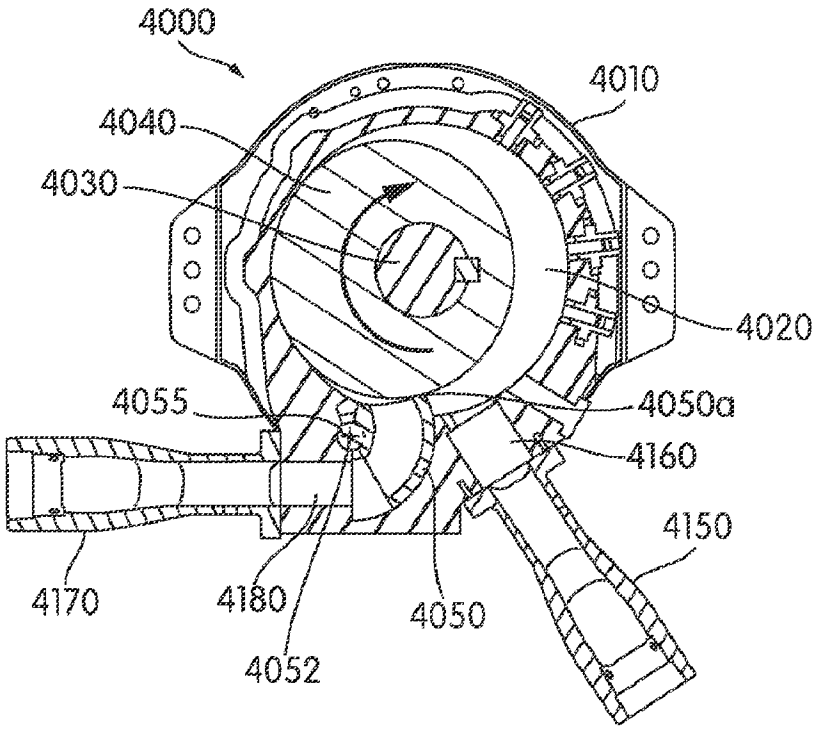
FIGS. 61 and 62 are cross-sectional views of a compressor according to an alternative embodiment, with the cross-sections taken perpendicular to an axis of a drive shaft of the compressor.
Figure 61:
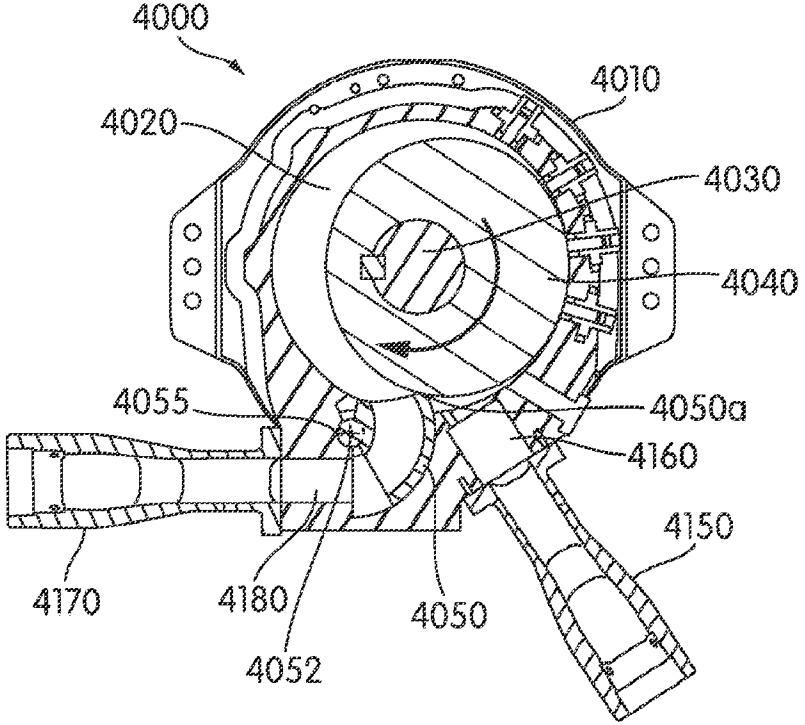

As shown in FIGS. 61-62, the inlet 4180 passes through the gate 4050. This allows for a larger inlet 4180 area as well as a more efficient gas flow path. However, according to alternative embodiments, the inlet 4180 may be spaced from the gate 4050 without deviating from the scope of various embodiments.

Figure 65:
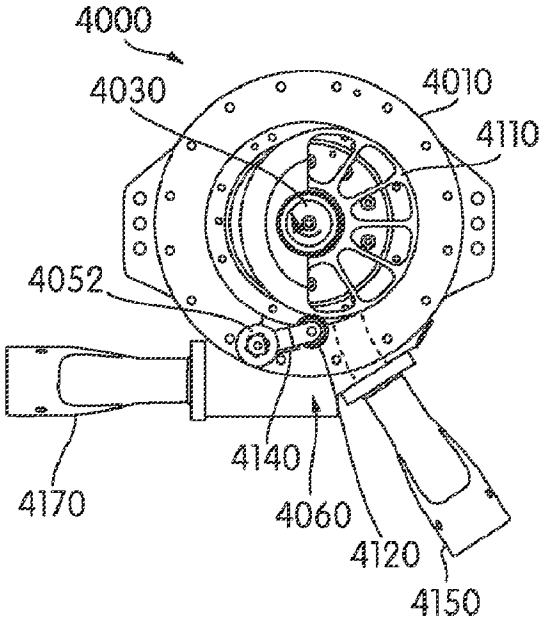
FIGS. 63-65 are end views of the compressor of FIGS. 61 and 62, taken at different points in the compression cycle.
Figure 64:
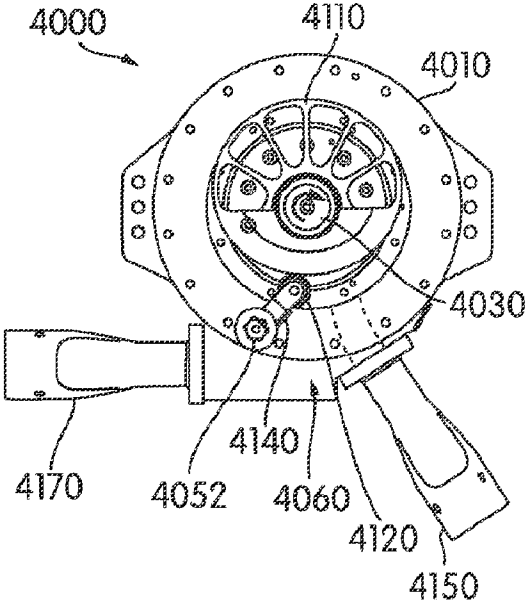
Figure 63:
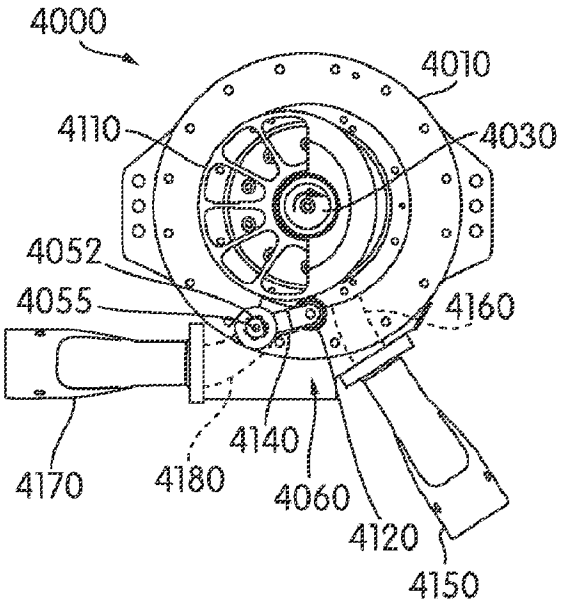

As shown in FIGS. 63-65, the gate-positioning system 4060 includes a cam 4110 mounted to the drive shaft 4030 for rotation with the driveshaft 4030. An outer cam profile of the cam 4110 generally mimics a profile of the rotor 4040 (but may be modified to account for pivotal-position-based changes in the way the cam 4110 drives the cam follower 4120 relative to the gate 4050), a cam follower 4120 that abuts the cam 4110 and is mounted to the gate shaft 4052 for common pivotal movement with the shaft 4052 and gate 4050 relative to the casing 4010 about the axis 4055 (see FIGS. 63-65), and a spring 4140 disposed between the casing 4010 and the gate 4050 to pivotally bias the gate 4050 toward the rotor 4040. As the rotor 4040 rotates, the gate-positioning system 4060 keeps a seal edge 4050*a* of the gate proximate to the rotor 4040. The spring 4140 urges the gate 4050 toward the rotor 4040, while the cam 4110 and follower 4120 counter that force so that the seal edge 4050*a* closely follows the rotor 4040 surface during operation of the compressor 4000.

The pivoting gate 4050 helps the gate 4050 to resist the pressure that builds up on the compressed fluid outlet 4160 side of the gate 4050 within the compression chamber 4020. As shown in FIGS. 61-62, the convex, semi-cylindrical surface of the gate 4050 that is exposed to high pressures in the compression volume of the compression chamber 4020 (the right side as shown in FIGS. 61 and 62) is concentric with the gate shaft 4052 and axis 4055. As a result, pressure loads are transferred through the gate 4050 directly to the shaft 4052 without urging the gate 4050 to pivot. This direct force transfer through the shaft 4052 to the casing 4010 may reduce gate 4050 deflection, and reduce the forces needed to reciprocally pivot the gate 4050 over each compression cycle of the compressor 4000, while keeping the seal edge 4050*a* proximate to the rotor 4040.

According to various embodiments, the gate 4050 and shaft 4052 may be integrally formed.

In the illustrated embodiment, a torsion spring 4140 urges the gate 4050 toward the rotor 4040. However, any other suitable force-imparting mechanism may alternatively be used without deviating from the scope of the present invention (e.g., a compression or tension spring mounted between the casing 4010 and a lever arm attached to the gate 4050 or shaft 4052 to impart torque on the shaft 4052 and gate 4050, a motor, magnets, etc.).

Figure 66:
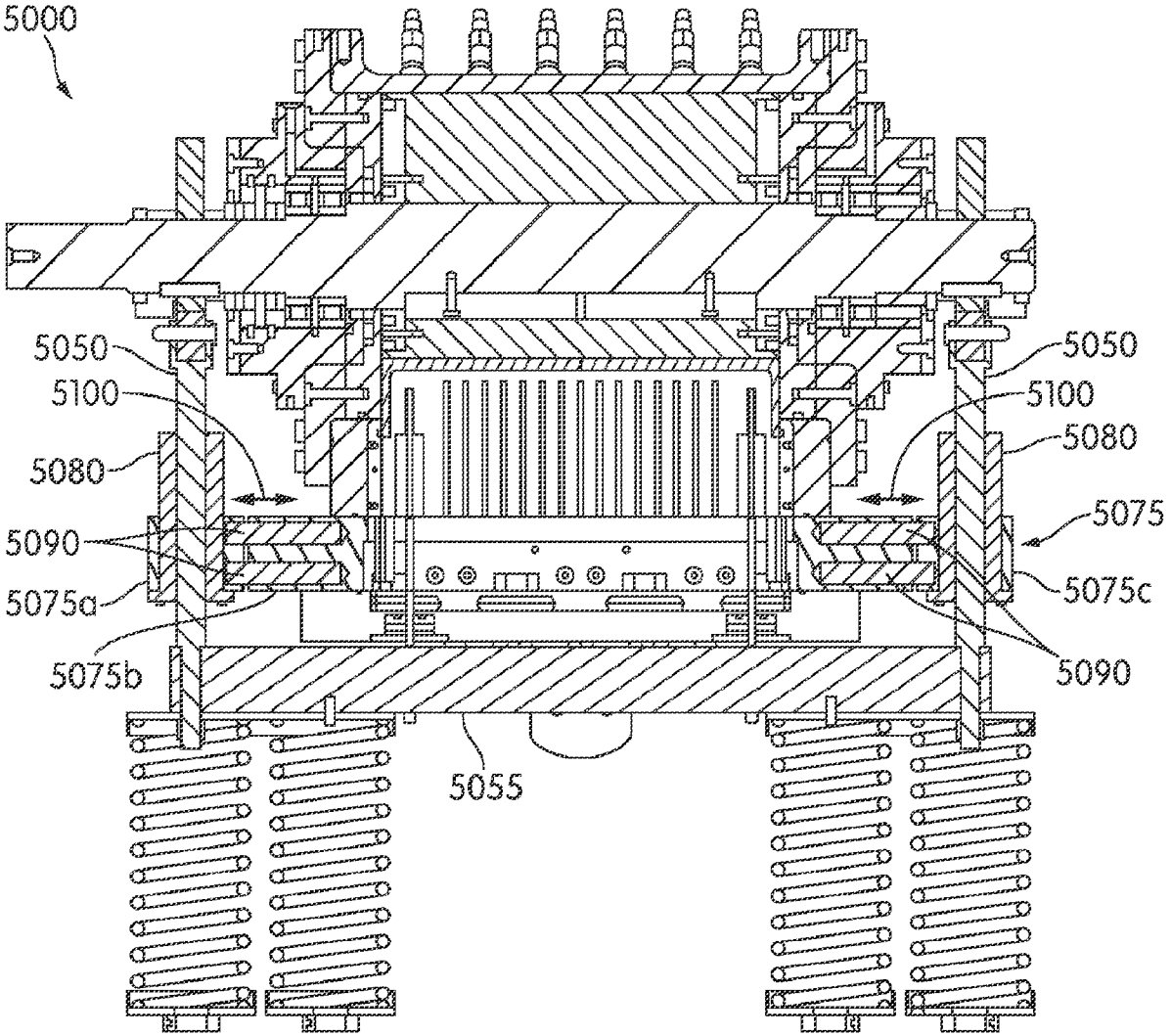
FIG. 66 is a cross-sectional view of a compressor according to an alternative embodiment, taken along an axis of the compressor's drive shaft.

FIG. 66 illustrates a compressor 5000 according to an alternative embodiment. The compressor 5000 is identical to the compressor 1000, except that the compressor 5000 uses a different type of gate support guide 5075 than the gate support guide 1075 of the compressor 1000. A redundant description of identical structures is omitted.

As shown in FIG. 66, the gate support guide 5075 is divided into three parts, 5075*a*, 5075*b*, 5075*c*. Guide parts 5075*a*, 5075*c* comprise gate support bushings or bearings 5080 that guide the gate supports 5050 to permit reciprocating linear motion of the supports 5050 (in the up/down direction as illustrated in FIG. 66). The central guide part 5075*b* is mounted to the casing 1010 (or integrally formed with the casing 1010). The central guide part 5075*b* connects to the guide parts 5075*a*, 5075*c* via linear bearings 5090. The linear bearings 5090 permit the outer guide parts 5075*a*, 5075*c* to move toward and away from the central guide part 5075*b* (i.e., along the arrows 5100 shown in FIG. 66, which extend left/right as shown in FIG. 66). The linear bearings 5090 prevent the outer guide parts 5075*a*, 5075*c* from moving relative to the central guide part 5075*b* in a direction perpendicular to the arrows 5100 (i.e., in a direction into/out of the page as shown in FIG. 66). The linear bearings 5090 are used to correct for relative thermal expansion of different parts of the compressor 5000 (e.g., between the gate support guide 5075 and the gate support cross-arm 5055), which might otherwise cause the gate support bearings 5080 to push or pull the gate supports 5050 in the direction of the arrows 5100 and cause the supports 5050 to bind against the bearings 5080.

According to various alternative embodiments, the linear bearings 5090 are replaced with alternative linear movement devices that permit the gate supports 5050 to move in the direction of the arrows 5100. For example, thermal growth can be accounted for by slightly undersizing the gate support 5050 relative to the linear bearings 5080. Additionally and/or alternatively, the linear bearings 5080 may be fitted into slotted holes in the gate casing 5075 such that the linear bearings 5080 can move axially (in the direction of the arrows 5100) if needed due to thermal growth while movement in a perpendicular direction (i.e., in the direction into the page as shown in FIG. 66) is constrained or eliminated.

FIGS. 70-74 illustrate a compressor 6000 according to an alternative embodiment. The compressor 6000 is similar to or identical to the compressor 1000, except as explained below. A redundant description of structures and features of the compressor 6000 that are identical or similar to structures or features of the compressor 1000 is therefore omitted.

As shown in FIGS. 70-73, the compressor 6000 adds a casing 6010 that encloses many or all moving parts of the compressor 6000 other than the drive shaft 6020 that extends outwardly from one or more ends of the compressor 6000.

Figure 73:
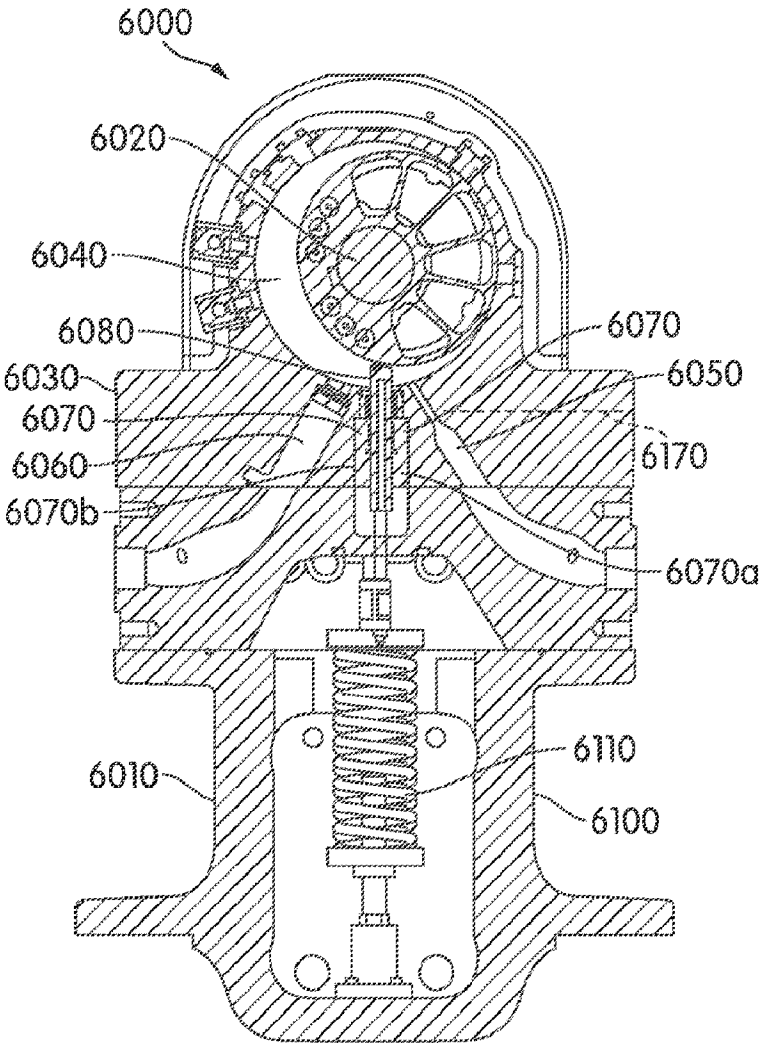
FIG. 73 is a cross-sectional view of the compressor in FIG. 70, taken along the line 73-73 in FIG. 70.

As shown in FIG. 73, an upper portion 6030 of the casing 6010 may be integrally formed with the main casing that defines the compression chamber 6040 of the compressor 6000. Inlet and discharge manifolds 6050, 6060, respectively, may be integrally formed into the upper portion 6030 of the casing 6010. The upper portion 6030 structurally supports the hydrostatic bearing 6070 and gate 6080, and may include reinforcing structures to stiffen the casing and resist deflection caused by pressure from the bearing 6070 and gate 6080.

Figure 71:
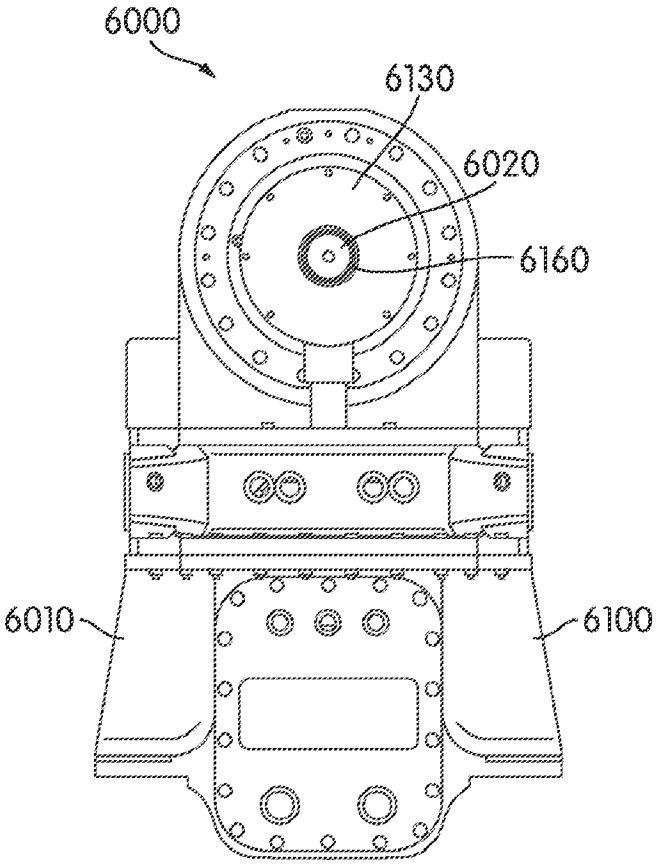
FIG. 71 is an end view of the compressor in FIG. 70.
Figure 70:
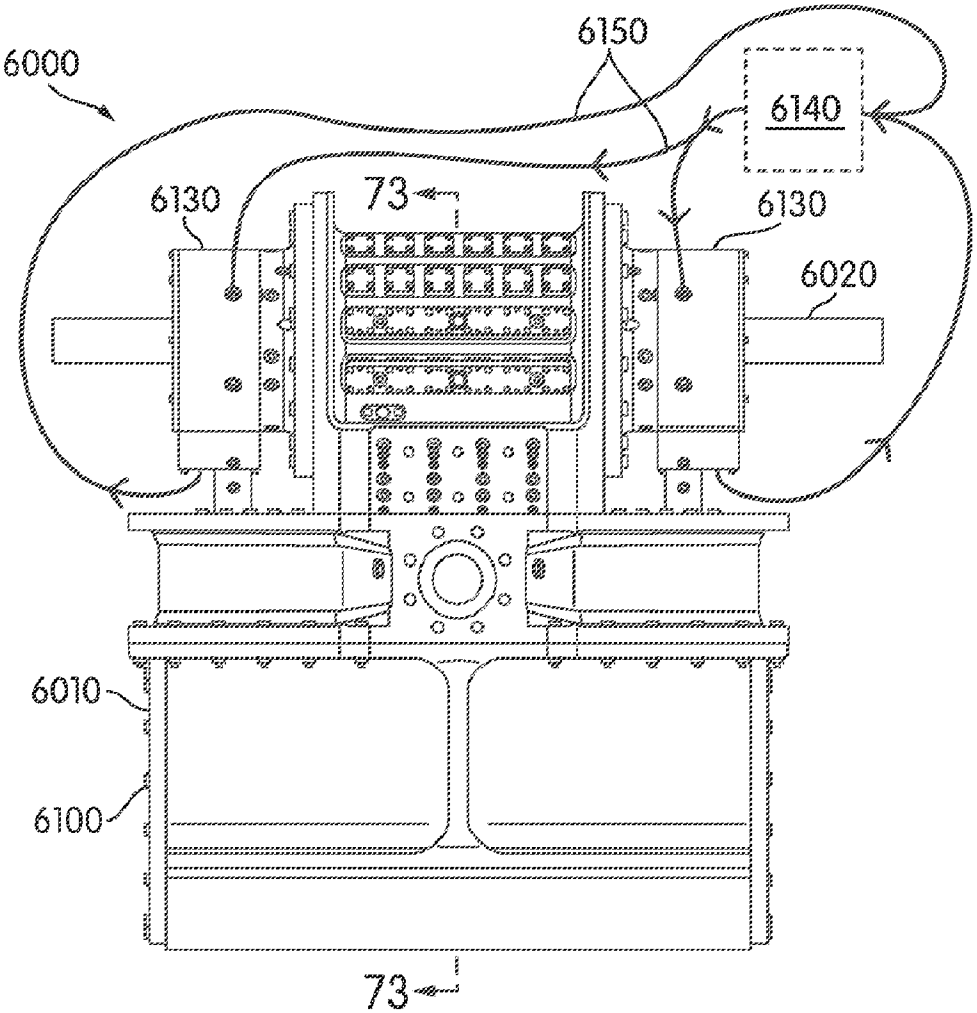
FIG. 70 is a side view of a compressor according to an alternative embodiment.

As shown in FIGS. 70 and 71, the casing 6010 also includes a lower portion 6100 with an internal cavity that houses the springs 6110. The upper portion 6030 may bolt or otherwise removably attach to the lower portion 6100 so that the upper portion 6030 and main components of the compressor 6000 may be removed from the lower portion 6100 (e.g., for maintenance or replacement). The springs 6110 may be removable as a unit along with the upper portion 6030 and main components of the compressor 6000. Alternatively, the springs may remain with the lower portion 6100 when the upper portion 6030 is removed.

According to various embodiments, the lower portion 6100 may include a sump for oil from the compressor's hydraulic and lubrication systems such that fluids reservoirs are provided within the casing 6010.

Figure 72:
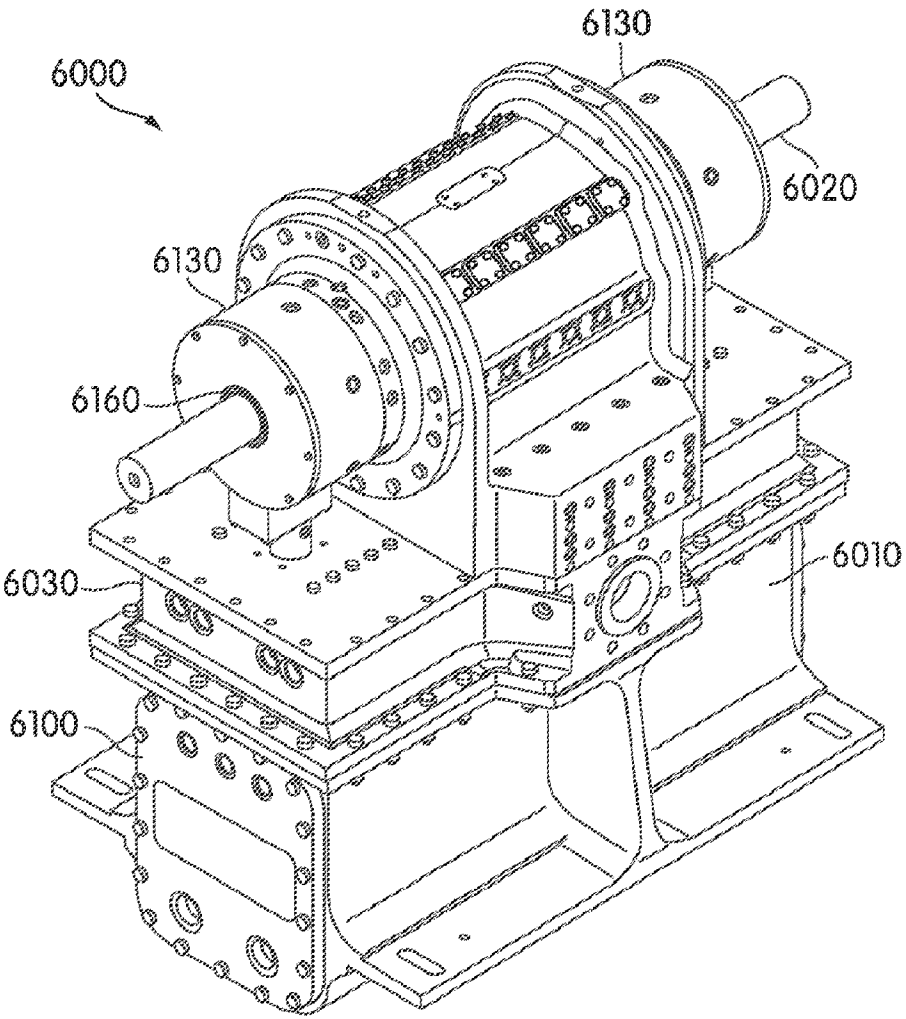
FIG. 72 is a perspective side view of the compressor in FIG. 70.

As shown in FIG. 70, the casing 6010 also includes cam covers 6130 that enclose and protect the cams and cam followers (e.g., cams 1050 and followers 1060, as shown in FIG. 40). A lubrication distribution system 6140 (e.g., an oil pump and oil-filled reservoir) connect via conduits 6150 to the inside of the covers 6130 to apply (e.g., spray or drip) lubricant onto the cams and followers, and in particular the interface between the cams and followers (shown in FIG. 39). In various embodiments, this system may be configured to create an oil bath, wherein some portion of the cams and cam followers may be submerged in oil for part or all of their motion. The system may be configured to create an optimal oil level so as to maximize lubrication provided to the cams and cam followers while minimizing negative effects such as oil splashing, generation of bubbles within the oil, etc. While the system 6140 is illustrated as being on the outside of the casing 6010 in FIG. 70, the entire system 6140 and conduits 6150 may alternatively be disposed inside the casing 6010. As shown in FIG. 72, rotational seals 6160 seal the rotational interface between the shaft 6020 and covers 6130. Such seals 6160 may comprise mechanical seals (e.g., rings). The seals 6160 may comprise multi-part hydraulic seals like the seal 1500, 6200 that provide a drain and hydrostatic over pressure to discourage working fluid that may leak past the drive shaft into the inside of the covers 6130 from leaking further into the ambient environment outside the covers 6130 and casing 6010.

As shown in FIG. 73, oil conduits 6170 in the upper portion 6030 may feed oil to the hydrostatic bearing 6070. The hydrostatic bearing 6070 comprises to separate bearing pads 6070*a,b* (shown on the right and left in FIG. 73) that sandwich the gate 6070 therebetween (rather than a single O or oval shaped bearing). The two-piece bearing 6070 may facilitate grinding of the bearing 6070 and gate 6080 to reduce clearances therebetween when the bearing 6070 and gate 6080 are inserted into a matching slot in the upper portion 6030 of the casing 6010.

Figure 74:
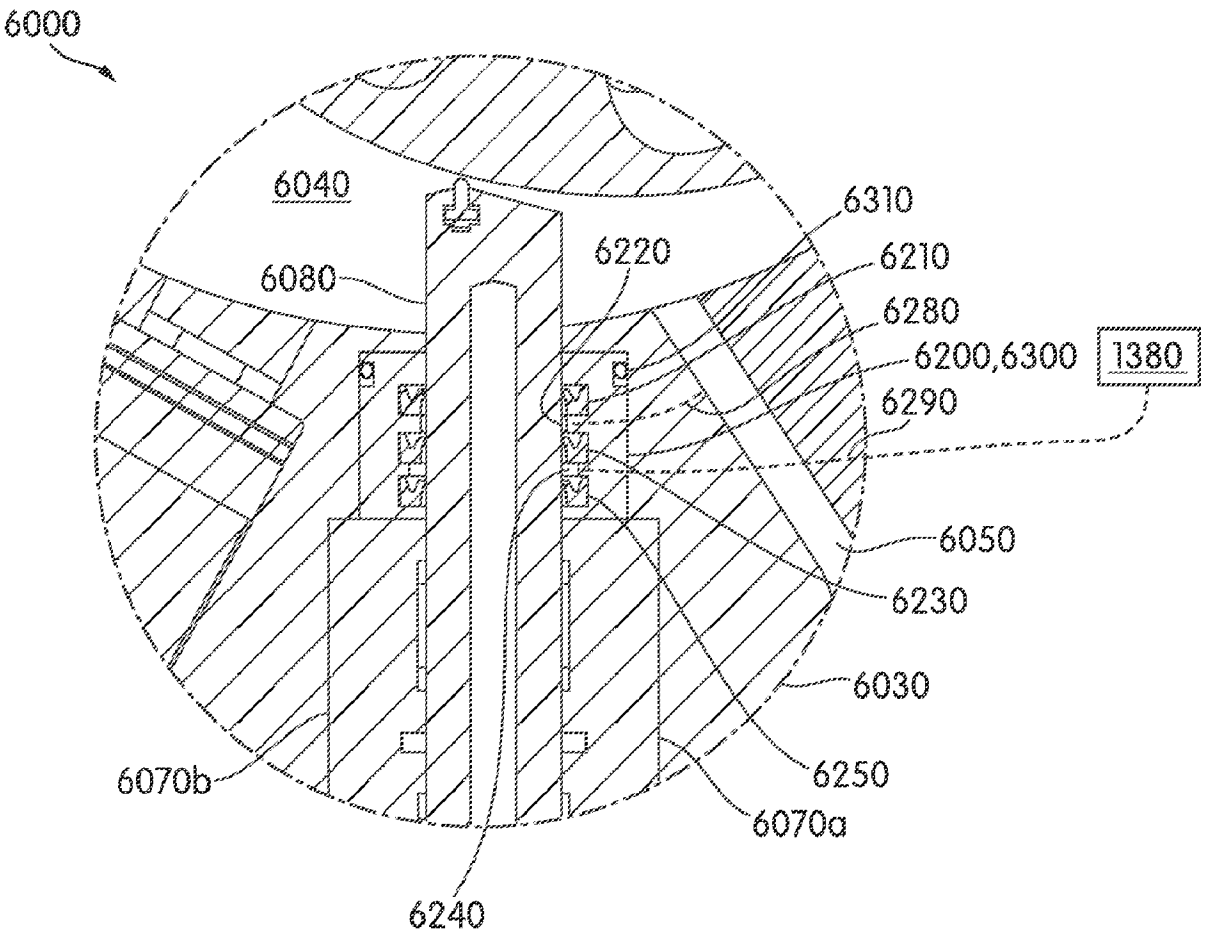
FIG. 74 is a partial, magnified cross-sectional view of FIG. 73.

As shown in FIG. 74, a gate ring mechanical/hydraulic seal 6200 surrounds the gate 6080 and seals an inside of the compression chamber 6040 from the hydrostatic bearing 6070 and lower portion 6100 of the casing 6010. The gate ring hydraulic seal 6200 operates in a similar manner as the seal 1500 to isolate the compression chamber 6040 from an outer environment, except that the seal 6200 seals against the reciprocating gate 6080, rather than the rotating drive shaft. The seal 6200 comprises, in sequential order from the compression chamber 6040 toward the bearing 6070: a first seal 6210, a drain groove (e.g., a vent) 6220, a second seal 6230, a hydraulic fluid groove 6240, and a third seal 6250. According to various embodiments, the seals 6210, 6230, 6250 and grooves 6220, 6240 extend continuously around the entire perimeter of the gate 6080. The seals 6210, 6230, 6250 may each comprise single continuous seals such as O-rings, or may comprise multi-part seals that together form a complete perimeter around the gate 6080.

According to alternative embodiments, the seals 6210, 6230, 6250 and grooves 6220, 6240 do not extend continuously around the gate 6080, but instead are formed by two sets of seals and grooves, one set being disposed on the inlet side of the gate 6080 and one set being disposed on the outlet side of the gate 6080.

As shown in FIG. 74, the drain groove (e.g., vent) 6220 fluidly connects to the inlet manifold 6050 via a fluid passageway 6280 so that working fluid that leaks from the compression chamber 6040 past the first seal 6210 is vented back into the low-pressure inlet manifold 6050 for reinjection back into the compression chamber 6040.

As shown in FIG. 74, the hydrostatic fluid groove 6240 is pressurized by hydraulic fluid (or other suitable fluid) that is pumped into the groove 6240 via a fluid passageway 6290 from a source of pressurized fluid (e.g., hydraulic pump 1380).

As shown in FIG. 74, the seal 6200 includes a housing/body 6300 that supports the seals 6210, 6230, 6250 and grooves/vents 6220, 6240, and defines portions of the passageways 6280, 6290. Other portions of the passageways 6280, 6290 may be defined by the casing portion 6030 or other structures. The seal 6200 and its components are preferably removably inserted into place within the casing portion 6030 as a single unit. As shown in FIG. 74, the seal 6200 is inserted into a mating slot in the casing portion 6030 from below. An additional seal ring 6310 seals the interface between the body 6300 of the seal 6200 and the casing 6030.

The operation of the seal 6200 is described with reference to FIG. 74. For the working fluid (e.g., natural gas being compressed) to leak out of the compression chamber 6040 via the opening through which the gate 6080 extends, the fluid may leak between the seal 6210 and gate 6080. If the working fluid leaks past the seal 6210, the fluid reaches the vent 6220, which returns the fluid back to the low-pressure compressor inlet 6050 via the passageway/port 6280, which is maintained at the pressure of the inlet 6050 via its fluid communication with the inlet 6050. The area between the second and third seals 6230, 6250 is pressurized by hydraulic fluid fed through the passageway 6290 and groove 6240 to a pressure higher than the inlet 6050 pressure, which discourages or prevents the working fluid from further leaking past the seals 6230, 6250 and groove 6240. Leaked working fluid leaks through the groove 6220 and passageway 6280 back to the intake 6050, rather than past the seals 6230, 6250 and groove 6240 because the inlet 6050 is at a significantly lower pressure than the groove 6240. Thus, leakage of the working fluid past the seal 6200 is reduced or preferably eliminated.

According to various alternative embodiments, additional seals like the seals 6210, 6230, 6250 and corresponding vents like the vents 6220, 6240 may be disposed along the leakage path between the first of such seals and the last of such seals, which results in a plurality of drain vents 6220 back to the inlet and/or a plurality of pressurized vents/grooves 6240, with seals separating the different ones of the vents/grooves 6220, 6240. According to various embodiments, the total number of such seals along the leakage path may comprise from 3 to 50 seals.

According to alternative embodiments, the first seal 6210 and vent 6220 may be eliminated so that the mechanical seal 6200 relies on the pressurized groove/vent 6240 to discourage leaks across the seal 6200. According to alternative embodiments, the third seal 6250 and vent/groove 6240 are eliminated, so that the mechanical seal 6200 relies on the vent 6220 to discourage further leakage past the seal 6230.

According to various embodiments, a flywheel may be added to one or both ends of the drive shaft 6020 to reduce torsional loads on the shaft 6020 during operation of the compressor 6000.

According to various embodiments, any of the components or features (e.g., hydrostatic bearing 1300, mechanical seal 1500, compression of multi-phase fluids, etc.) of any of the above-described compressors (e.g., compressors 1000, 2000, 3000, 4000, 5000, 5150, 6000) may be used in any of the other compressors described herein. For example, the discharge manifold 1160 may be mounted to the outlet side 154 of the gate casing 150 of the compressor illustrated in FIG. 28 so as to receive compressed fluid that is expelled through outlet ports 435.

The presently preferred embodiments could be modified to operate as an expander. Further, although descriptions have been used to describe the top and bottom and other directions, the orientation of the elements (e.g. the gate 600 at the bottom of the rotor casing 400) should not be interpreted as limitations on embodiments of the present invention.

While various of the above-described embodiments comprise a rotary compressor that relies on a rotor that is rigidly mounted to a drive shaft so that the rotor and drive shaft rotate together relative to the compression chamber, various of the above-discussed features may be used with other types of compressors (e.g., rolling piston, screw compressor, scroll compressor, lobe, liquid ring, and rotary vane compressors) without deviating from the scope of these embodiments or the invention. For example, the above discussed hydrostatic bearing arrangement 1300 can be incorporated into a variety of other types of compressors that use moving gates/vanes (e.g., rolling piston compressors, rotary vane compressors, etc.) without deviating from the scope of such embodiments or the invention.

While the foregoing written description of various embodiments of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

It is therefore intended that the foregoing detailed description be regarded as illustrative rather than limiting, and that it be understood that it is the following claims, including all equivalents, that are intended to define the spirit and scope of this invention. To the extent that "at least one" is used to highlight the possibility of a plurality of elements that may satisfy a claim element, this should not be interpreted as requiring "a" to mean singular only. "A" or "an" element may still be satisfied by a plurality of elements unless otherwise stated.

The invention claimed is:

1. A compressor comprising:

a casing with an inner wall defining a compression chamber, an inlet leading into the compression chamber, and an outlet leading out of the compression chamber;

a rotor rotatably coupled to the casing for rotation relative to the casing such that when the rotor is rotated, the compressor compresses working fluid that enters the compression chamber from the inlet, and forces compressed working fluid out of the compression chamber through the outlet;

a gate coupled to the casing for reciprocating movement relative to the casing, the gate comprising a sealing edge, the gate being operable to move relative to the casing to locate the sealing edge proximate to the rotor as the rotor rotates such that the gate separates an inlet volume and a compression volume in the compression chamber; and a mechanical seal located at an interface between the gate and casing, the mechanical seal comprising:

first, second, and third seals disposed sequentially along a leakage path between the gate and the casing, with the first seal positioned closer to the compression chamber in a direction from the compression chamber toward a hydraulic bearing located below the third seal, a source of pressurized hydraulic fluid, and a hydraulic fluid passageway that connects the source of pressurized hydraulic fluid to a space along the leakage path between the second and third seals so as to keep the space pressurized with hydraulic fluid.

2. The compressor of claim 1, wherein the mechanical seal further comprises a vent disposed between the first and second seals, the vent being fluidly connected to the inlet so as to direct working fluid that leaks from the compression chamber past the first seal back to the inlet.

3. The compressor of claim 1, wherein the first, second, and third seals are all supported by a removable housing, such that the first, second, and third seals and the removable housing are installed into the casing as a single unit.

4. The compressor of claim 1, wherein the mechanical seal comprises n sequential seals along the leakage path between the gate and casing, wherein $3 \leq n \leq 50$, wherein n includes the first, second, and third seals, wherein one or more spaces between adjacent ones of the seals are filled with pressurized hydraulic fluid from the source of pressurized hydraulic fluid, and wherein one or more spaces between adjacent ones of the seals comprise a vent that is fluidly connected on the inlet.

* * * * *